US005388422A

United States Patent [19]

Hayashida et al.

[11] Patent Number: 5,388,422

[45] Date of Patent: Feb. 14, 1995

[54] AIR-CONDITIONING SYSTEM

[75] Inventors: Noriaki Hayashida; Takashi Nakamura; Hidekazu Tani; Tomohiko Kasai; Junichi Kameyama; Shigeo Takata, all of Wakayama, Japan

[73] Assignee: Mitsubishi Denki Kabushiki Kaisha, Tokyo, Japan

[21] Appl. No.: 36,256

[22] Filed: Mar. 24, 1993

Related U.S. Application Data

[63] Continuation of Ser. No. 814,558, Dec. 30, 1991, Pat. No. 5,237,833.

[30] Foreign Application Priority Data

| | | | |
|---|---|---|---|
| Jan. 10, 1991 | [JP] | Japan | 3-001616 |
| Jan. 21, 1991 | [JP] | Japan | 3-004841 |
| Jan. 28, 1991 | [JP] | Japan | 3-008360 |
| Jan. 31, 1991 | [JP] | Japan | 3-010415 |
| Jan. 31, 1991 | [JP] | Japan | 3-010710 |
| Jan. 31, 1991 | [JP] | Japan | 3-010711 |
| Feb. 5, 1991 | [JP] | Japan | 3-014031 |
| Feb. 5, 1991 | [JP] | Japan | 3-014162 |
| Feb. 5, 1991 | [JP] | Japan | 3-014200 |
| Feb. 20, 1991 | [JP] | Japan | 3-026000 |
| Feb. 20, 1991 | [JP] | Japan | 3-026001 |
| Mar. 28, 1991 | [JP] | Japan | 3-064631 |
| Nov. 15, 1991 | [JP] | Japan | 3-300615 |

[51] Int. Cl.[6] ..... F25B 41/00

[52] U.S. Cl. ..... 62/211; 62/223

[58] Field of Search ..... 62/211, 223

[56] References Cited

U.S. PATENT DOCUMENTS

| | | | |
|---|---|---|---|
| 4,621,505 | 11/1986 | Ares et al. | 62/509 |
| 4,760,707 | 8/1988 | Dennis et al. | 62/197 |

FOREIGN PATENT DOCUMENTS

| | | | |
|---|---|---|---|
| 0119024 | 9/1984 | European Pat. Off. . | |
| 0129640 | 6/1987 | Japan | 62/223 |
| 0096438 | 4/1988 | Japan | 62/211 |
| 2194651 | 3/1988 | United Kingdom . | |

*Primary Examiner*—William E. Wayner

*Attorney, Agent, or Firm*—Oblon, Spivak, McClelland, Maier & Neustadt

[57] ABSTRACT

An air conditioning system in which a single heat source unit (A) comprising a compressor (1), a four-way valve (2), a heat source unit side heat exchanger (3) and an accumulator (4) is connected to a plurality of indoor units (B, C, D) through a first and a second connection pipes (6, 7). Each indoor unit (B, C, D) comprises a suction air temperature detecting device (50) for detecting a suction air temperature of the indoor unit, an opening degree setting device for setting a minimum valve opening degree of the first flow rate controller 9 in accordance with the difference between the target temperature and the suction air temperature and a first valve opening degree control device (52) for controlling the valve opening degree of the first flow rate controller 9 at a predetermined rate to the minimum valve opening degree.

2 Claims, 41 Drawing Sheets

AIR-CONDITIONING SYSTEM

This is a division, of application Ser. No. 07/814,558, filed on Dec. 30, 1991, now U.S. Pat. No. 5,237,833.

BACKGROUND OF THE INVENTION

This invention relates to an air-conditioning system in which a plurality of indoor units are connected to a single heat source unit and particularly to a refrigerant flow rate control unit so that a multi-room heat pump type air conditioning system is provided for selectively operating the respective indoor units in cooling or heating mode of operation, or wherein cooling can be carried out in one or some indoor units while heating can be concurrently carried out in other indoor units.

FIG. 40 is a general schematic diagram illustrating one example of a conventional heat pump type air-conditioning system. In the figure, reference numeral 1 designates a compressor, 2 is a four-way valve, 3 is a heat source unit side heat exchanger, 4 is an accumulator, 5 is an indoor side heat exchanger, 6 is a first connection pipe, 7 is a second connection pipe, and 9 and is a first flow rate controller.

The operation of the above-described conventional air-conditioning system will now be described.

In the cooling operation, a high-temperature, high-pressure refrigerant gas supplied from the compressor 1 flows through the four-way valve 2 and is heat-exchanged with air in the heat source unit side heat exchanger 3, where it is condensed into a liquid. Then, the liquid refrigerant is introduced into the indoor unit through the second connection pipe 7, where it is pressure-reduced by the first flow rate controller 9 and heat-exchanged with air in the indoor side heat exchanger 5 to evaporate into a gas thereby cooling the room.

The refrigerant in the gaseous state is then supplied from the first connection pipe 6 to the compressor 1 through the four-way valve 2 and the accumulator 4 to define a circulating cycle for the cooling operation.

In the heating operation, the high-temperature, high-pressure refrigerant gas supplied from the compressor 1 is flowed into the indoor unit through the four-way valve 2 and the first connection pipe 6 so that it is heat-exchanged with the indoor air in the indoor side heat exchanger 5 to be condensed into liquid thereby heating the room.

The refrigerant thus liquidified is pressure-decreased in the first flow rate controller 9 until it is in the low-pressure, gas-liquid phase state and introduced into the heat source unit side heat exchanger 3 through the second connection pipe 7, where it is heat-exchanged with the air to evaporate into a gaseous state, and is returned to the compressor 1 through the four-way valve 2 and the accumulator 4, whereby a circulating cycle is provided for carrying out the heating operation.

FIG. 41 is a general schematic diagram illustrating another example of a conventional heat pump type air-conditioning system, in which-reference numeral 24 designates a low-pressure-saturation temperature detection means.

In the above conventional air-conditioning system, when the cooling operation is to be carried out, the compressor 1 is controlled in terms of the capacity so that the detected temperature of the low-pressure saturation temperature detecting means 24 is in coincidence with the predetermined value.

However, in the conventional air-conditioning system, all of the indoor units are coincidentally operated in either cooling or heating mode of operation, so that a problem where an area to be cooled is heated and, contrary, where an area to be heated is cooled.

As an improvement of this, an air conditioning system which allows the concurrent cooling and heating operations as illustrated in FIG. 42.

In FIG. 42, A is a heat source unit, B,C and D are indoor units of the same construction and connected in parallel to each other as described later. E is a junction unit comprising therein a first junction portion, a second flow rate controller, a second junction portion, a gas/-liquid separator, a heat exchanger, a third flow rate controller and a fourth flow rate controller.

Reference numeral 20 is a heat source side fan of a variable flow rate for blowing air to the heat source side heat exchanger 3, **6*b*, 6*c* and 6*d* are indoor unit side first connection pipes corresponding to the first connection pipe 6 and connecting the junction unit E to the indoor side heat exchangers 5 of the indoor units B, C and D, respectively, and 7*b*, 7*c* and 7*d* are indoor unit side second connection pipes corresponding to the second connection pipe 7 and connecting the junction unit E to the indoor unit side heat exchangers 5** of the indoor units B, C and D, respectively.

Reference numeral 8 is a three-way switch valve for selectively connecting the indoor unit side first connection pipes **6*b*, 6*c* and 6*d* to either of the first connection pipe 6 or to the second connection pipe 7**.

Reference numeral 9 is a first flow rate controller disposed close to the exchanger 5 and connected to the indoor unit side second connection pipes **7*b*, 7*c* and 7*d* and is controlled by the superheating amount at the outlet side of the indoor unit side heat exchanger 5** in the cooling mode of operation, and is controlled by the subcooling amount in the heating mode of operation.

Reference numeral 10 is a first junction portion including three-way valves 8 connected for switching between the indoor unit side first connection pipes **6*b*, 6*c* and 6*d*, the first connection pipe 6 and the second connection pipe 7**.

Reference numeral 11 is a second junction portion comprising the indoor unit side second connection pipes **7*b*, 7*c* and 7*d*, and the second connection pipe 7**.

Reference numeral 12 designates a gas-liquid separator disposed midpoint in the second connection pipe 7, the gas phase portion thereof being connected to a first opening **8*a* of the three-way valve 8, the liquid phase portion thereof being connected to the second junction portion 11**.

Reference numeral 13 designates a second flow rate controller (an electric expansion valve in this embodiment) connected between the gas-liquid separator 12 and the second junction portion 11.

Reference numeral 14 designates a bypess pipe connecting the second junction portion 11 and the first connection pipe 6, 15 is a third flow rate controller (an electric expansion valve in this embodiment) disposed in the bypass pipe 14, **16*a* is a second heat exchanging portion disposed downstream of the third flow rate controller 15 inserted in the bypass pipe 14 for the heat-exchange in relation to the junctions of the indoor unit side second connection pipes 7*b*, 7*c* and 7*d* in the second junction portion 11**.

**16*b*, 16*c* and 16*d* are-third heat exchanging portions disposed downstream of the third flow rate controller 15 inserted in the bypass pipe 14** for the heat-exchange in relation to the junctions of the indoor unit side second connection pipes 7*b*, 7*c* and 7*d* in the second junction portion 11.

Reference numeral 19 is a first heat exchanging portion disposed downstream of the third flow rate controller 15 inserted in the bypass pipe 14 and downstream of the second heat exchanging portion 16*a* for the heat-exchange in relation to the pipe connected between the gas-liquid separator 12 and the second flow rate controller 13, and 17 is a fourth flow rate controller (an electric expansion valve in this embodiment) connected between the second junction portion 11 and the first connection pipe 6.

Reference numeral 32 is a third check valve disposed between the heat source unit side heat exchanger 3 and the second connection pipe 7 for allowing the flow of the refrigerant only from the heat source unit side heat exchanger 3 to the second connection pipe 7.

Reference numeral 33 is a fourth check valve disposed between the four-way valve 2 of the heat source unit A and the first connection pipe 6 for allowing the flow of the refrigerant only from the first connection pipe 6 to the four-way vale 2.

Reference numeral 34 is a fifth check valve disposed between the four-way valve 2 and the second connection pipe 7 for allowing the flow of the refrigerant only from the four-way valve 2 to the second connection pipe 7.

Reference numeral 35 is a sixth check valve disposed between the heat source unit side heat exchanger 3 and the first connection pipe 7 for allowing the flow of the refrigerant only from the first connection pipe 6 to the heat source unit side heat exchanger 3.

The above-described third, fourth, fifth and sixth check valves 32, 33, 34 and 35, respectively, constitutes a flow path change-over unit 40.

Reference numeral 21 designates a takeoff pipe connected at one end thereof to the liquid outlet pipe of the heat source unit side heat exchanger 3 and to the inlet pipe of the accumulator 4, 22 is a throttle disposed in the takeoff pipe 21, and 23 designates a second temperature detection means disposed between the throttle 22 and the inlet pipe of the accumulator of the takeoff pipe 21.

The conventional air-conditioning system capable of a concurrent heating and cooling operation has the above-described construction. Accordingly, when only the cooling operation is being carried out, the high-temperature, high-pressure refrigerant gas supplied from the compressor 1 flows through the four-way valve 2 and is condensed into a liquid in the heat source unit side heat exchanger 3 with the air supplied from the variable capacity heat source unit side fan 20. Then, the liquid refrigerant is introduced into the respective indoor units B, C and D through the third check valve 32, the second connection pipe 7, the gas-liquid separator 12, the second flow rate controller 13, the second junction portion 11 and through the indoor unit side second connection pipes 7*b*, 7*c* and 7*d*.

The refrigerant introduced into the indoor units B, C and D is decreased in pressure by the first flow rate controller 9 controlled by the superheating amount at the outlet of the indoor unit side heat exchanger 5, where it is heat-exchanged in the indoor unit side heat exchanger 5 with the indoor air to be evaporated into a gas to cool the room.

The gaseous refrigerant is flowed through the indoor unit side first connection pipes 6*b*, 6*c* and 6*d*, the three-way change-over valve 8, the first junction portion 10, the first connection pipe 6, the fourth check valve 33, the four-way valve 2 of the heat source unit and the accumulator 4 into the compressor 1 to define a circulating cycle for the cooling operation.

At this time, the first opening 8*a* of the three-way change-over valve 8 is closed while the second opening 8*b* and the third opening 8*c* are opened. At this time, the first connection pipe 6 is at a low pressure and the second connection pipe 7 is at a high pressure, so that the refrigerant inevitably flows toward the third check valve 32 and the fourth check valve 33.

Also, in this cycle, one portion of the refrigerant that passes through the second flow rate controller 13 is introduced into the bypass pipe 14 and is press-reduced in the third flow rate controller 35 and heat-exchanged in the third heat exchanging portions 16*b*, 16*c* and 16*d* in relation to the indoor unit side second connection pipes 7*b*, 7*c* and 7*d* of the second junction portion 11. Thereafter, the heat-exchanging is carried out in the second heat exchanging portion 16*a* in relation to the indoor unit side second connection pipes 7*b*, 7*c* and 7*d* of the second junction portion 11, and a further heat-exchanging is carried out in the first heat exchanging portion 19 in relation to the refrigerant flowing into the second flow rate controller 13 to evaporate the refrigerant, which then is supplied to the first connection pipe 6 and the fourth check valve 33 to be returned into the compressor 1 through the four-way valve 2 of the heat source unit and the accumulator 4.

On the other hand, the refrigerant within the second junction portion 11 which is heat-exchanged and cooled at the first, second and third heat-exchanging portions 19, 16*a*, 16*b*, 16*c* and 16*d* and is introduced into the indoor units B, C and D to be cooled.

In the mode of operation in which cooling is mainly carried out in the concurrent cooling and heating operations, the refrigerant gas supplied from the compressor 1 is flowed into the heat source unit side heat exchanger 3 through the four-way valve 2, where it is heat-exchanged in relation to the air supplied by the variable capacity heat source unit side fan 20 to become a high-temperature and high-pressure ga-liquid phase. At this time, the pressure obtained on the basis of the saturation temperature detected by the second temperature detecting means 23 is used to adjust the air flow rate of the heat source unit side fan 20 and the capacity the compressor 1.

Thereafter, this refrigerant in the high-temperature, high-pressure gas-liquid phase state is supplied to the gas-liquid separator 12 of the junction unit E through the third check valve 32 and the second connection pipe 7.

Then, the refrigerant is separated into the gaseous refrigerant and the liquid refrigerant, the separated gaseous refrigerant is introduced into the indoor unit D to be heated through the first junction portion 10, the three-way valve 8 and the indoor unit side first connection pipe 6*d*, where it is heat-exchanged in relation to the indoor air in the indoor unit side heat exchanger 5 to be condensed into a liquid to heat the room.

The refrigerant is then controlled by the subcooling amount at the outlet of the indoor unit side heat exchanger 5, flows through the substantially fully opened first flow rate controller 9 where it is slightly pressure-decreased and enters into the second junction portion 11. On the other hand, the liquid refrigerant is supplied to the second junction portion 11 through the second flow rate controller 13, where it is combined with the refrigerant which passes through the indoor unit D to be heated and introduced into each indoor units B and C through the indoor unit side second connection pipes 7b and 7c. The refrigerant flowed into the respective indoor units B and C is pressure-reduced by the first flow rate controller 9 controlled by the superheating amount at the outlet of the indoor unit side heat exchangers B and C and is heat-exchanged in relation to the indoor air to evaporate into vapor to cool the room.

The vaporized refrigerant then flows through a circulating cycle of the indoor unit side first connection pipes 6b and 6c, the three-way valve 8 and the first junction portion 10 to be suctioned into the compressor 1 through the first connection pipe 6, the fourth check valve 33, the four-way valve 2 of the heat source unit and the accumulator 4, thereby to carry out the cooling-dominant operation.

The conventional air-conditioning system constructed as above-described has a problem in that, a disturbance of the refrigerant cycle is generated due to the variation in pressure of the refrigeration cycle and a stable detection of the low-pressure saturation temperature in the heat source unit cannot be achieved due to the variation of the indoor cooling load when the operation is cooling only or due to the variation of the indoor cooling load or heating load when the operation is cooling-dominant. When the operation is cooling-dominant, the refrigerant which passed through the heat source unit side heat exchanger becomes vapor-liquid phase state, preventing a stable detection of the saturation temperature of the refrigerant. Alternatively, when the number of indoor units in the cooling operational mode, when the units are started for cooling operation after a long period of stoppage or when the cooling operation is started immediately after heating operation, a large amount of liquid refrigerant stays in the accumulator or the like, so that a vapor-liquid two-phase state due to lack of refrigerant takes place at the inlet of the first flow rate controller 9, increasing the flow path resistance of the first flow rate controller 9, which causes the decrease in refrigerant pressure, the decrease in the refrigerant circulating amount and the decrease in the low pressure saturation temperature whereby the cooling capacity is disadvantageously decreased and the heating and cooling cannot be selectively carried out by each indoor unit and a stable concurrent cooling and heating operation in which some of the indoor units carry out cooling and some other of the indoor units carry out heating.

In particular, when the air-conditioning system is installed in a large-scale building, the air-conditioning load is significantly different between the interior portion and the perimeter portion, and between the general offices and the OA (office automated) room such as a computer room.

SUMMARY OF THE INVENTION

This invention has been made in order to solve the above-discussed problems and has as its object the provision of an air-conditioning system in which the cooling and heating can be selectively carried out for each indoor units or some of the indoor units can be cooling-operated while the other of the indoor units are being heating-operated.

The air-conditioning system according to the first invention of this application is provided with a suction air temperature detecting means for detecting a suction air temperature of the plurality of indoor units, opening degree setting means for setting a minimum valve opening degree the first flow rate controller in response to a difference between a detected temperature and a predetermined target temperature, and first valve opening degree controlling means for controlling the valve opening degree in response to the above temperature difference.

The air-conditioning system of the second invention of the present application is provided with a second valve opening degree controlling means which decreases, when heating operation load on the indoor unit is increased, the valve opening degree of the second flow rate controller by a predetermined amount corresponding to an amount of increase of the heating operation load and which increases, when heating operation load on the indoor unit is decreased, the valve opening degree of the second flow rate controller by a predetermined amount corresponding to an amount of decrease of the heating operation load.

The air-conditioning system of the third invention of the present application is provide with a third valve opening degree controlling means which decreases, when cooling operation load on the indoor unit is increased, the valve opening degree of the third flow rate controller by a predetermined amount corresponding to an amount of increase of the cooling operation load and which increases, when cooling operation load on the indoor unit is decreased, the valve opening degree of the third flow rate controller by a predetermined amount corresponding to an amount of decrease of the cooling operation load.

The air-conditioning system of the fourth invention of the present invention is provided with a fourth valve opening degree controlling means which provides, when an indoor unit of the plurality indoor units which had been operated is stopped, the first flow rate controller with a valve opening degree which is a predetermined percentage of the valve opening degree immediately before the stopping of the indoor unit, time counting means for counting a predetermined time during which the valve opening degree of the predetermined percentage is to be maintained, and means for closing the first flow rate controller after the lapse of the predetermined time.

The air-conditioning system of the fifth invention of the present invention is provided with a first bypass circuit which is connected between the first connection pipe and the second connection pipe and which is opened during the defrosting operation.

The air-conditioning system of the sixth invention of the present application is provided with a subcooling amount detection means for detecting an indoor unit inlet subcooling amount during the cooling operation, and a compressor capacity controlling means for controlling capacity of the compressor on the basis of a capacitor control target which is varied in accordance with the subcooling amount detected by the subcooling amount detecting means.

The air-conditioning system of the seventh invention of the present application is provided with a subcooling amount detection means for detecting an indoor unit inlet subcooling amount during the cooling operation, a fifth flow rate controlling means disposed in a pipe connected between a lower portion of the accumulator and an outlet side pipe of the accumulator, and a fifth valve opening degree controlling means for controlling the valve opening degree of the fifth flow rate controlling means.

The air-conditioning system of the eighth invention of the present application is provided with a subcooling amount detection means for detecting an indoor unit inlet subcooling amount during the cooling operation, a second bypass circuit connected between a high-pressure gas pipe on an outlet side of the compressor an inlet side pipe of the accumulator, and a sixth valve opening degree controlling means for controlling the valve opening degree of the second bypass circuit in accordance with the subcooling amount detected by the subcooling amount detecting means.

The air-conditioning system of the ninth invention of the present application is provided with a takeoff pipe connected at one end thereof to a liquid outlet side pipe of the heat source unit side heat exchanger and at the other end thereof to an inlet pipe of the accumulator through a throttle device, the takeoff pipe extending through cooling fins of the heat source unit side heat exchanger, and a temperature detector disposed in the takeoff pipe between the throttle device and the inlet pipe of the accumulator.

The air-conditioning system of the tenth invention of the present application is characterized in that the heat source unit side heat exchanger is provided at a refrigerant inlet and outlet portions with first and second valves, respectively, and a heat source unit side bypass pipe bypassing the heat source unit-side heat exchanger through a third valve is connected at one end thereof to a liquid outlet side pipe positioned between the heat source unit side heat exchanger and the takeoff pipe connection portion.

The air-conditioning system of the eleventh invention is provided with a first stop time count means for counting a stop time of an indoor unit which is not being operated during the operation of the compressor, and a second control means for switching the valve unit to connect the indoor unit which is not being operated to the first connection pipe for period of a predetermined second set time when the stop time of the indoor unit exceeds a predetermined first set time.

The air-conditioning system of the twelfth invention is provided with a second stop time count means for counting a stop time of an indoor unit which is not being operated during the operation of the compressor, and a second control means for switching the valve unit to connect the indoor unit which is not being operated to the second connection pipe for period of a predetermined fourth set time and for opening the first flow rate controller of the indoor unit which is not being operated when the stop time of the indoor unit exceeds a predetermined third set time.

In the air-conditioning system according to the first invention of this application, a suction air temperature of the indoor units is detected by a suction air temperature detecting means, a minimum valve opening degree of the first flow rate controller is set in response to a difference between a predetermined target temperature and a detected temperature, and the valve opening degree of the first flow rate controller is controlled in a predetermined percentage, so that the refrigerant supplied to the indoor side heat exchanger can be finely adjusted, and a smooth valve opening degree control can be carried out, thereby to make a smooth valve opening degree adjustment and a stable circulating cycle, intermittent blow of a cold wind.

In the second invention of the present application, a second valve opening degree controlling means controls the valve opening degree of the second flow rate controller 13 in response to an amount of increase or decrease of the heating operation load, an abrupt pressure change in the refrigerant due to the increase and decrease of the heating load and the disturbance of the refrigeration cycle can be prevented.

In the third invention of the present application, a third valve opening degree controlling means controls the valve opening degree of of third flow rate controller 15 in response to increase or decrease of cooling operation load of the indoor unit, so that an abrupt pressure change in the refrigerant due to the increase and decrease of the cooling load and the disturbance of the refrigeration cycle is prevented.

In the air-conditioning system of the fourth invention, the fourth valve opening degree controlling means provides, when an indoor unit which had been operated is stopped, the first flow rate controller with a valve opening degree which is a predetermined percentage of the valve opening degree immediately before the stopping of the indoor unit, and the time counting means counts the predetermined time during which the valve opening degree of the predetermined percentage is to be maintained, so that the other indoor units, junction unit and heat source unit are subject to the self-controlled diversion control to a stable operation, thereby suppressing abrupt change in operating condition.

In the air-conditioning system of the fifth invention, the first bypass circuit which opens during the defrosting operation allows, immediately after the initiation of the defrosting operation, the high-temperature and high-pressure vapor refrigerant filled in the second connection pipe to flow into the accumulator, and on the hand, the high-temperature and high-pressure vapor refrigerant supplied from the compressor to the heat source unit side heat exchanger through the four-way valve is heat-exchanged in the heat source unit side heat exchanger in relation to the frost and turned into liquid, and the refrigerant combined with the high-temperature, high-pressure vapor refrigerant in the second connection pipe is supplied to the accumulator through the four-way valve, so that the refrigerant in the low-pressure, vapor-liquid two-phase state is suctioned from the accumulator into the compressor, where it is completely vaporized.

In the air-conditioning system of the sixth invention, the subcooling amount detection means detects an indoor unit inlet subcooling amount during the cooling operation, and a compressor capacity controlling means changes the capacity control target of the compressor in accordance with the subcooling amount, so that even when the refrigerant at the inlet of the first flow rate controller of the cooling indoor unit is in the vapor-liquid two phase state and the subcooling amount is decreased thereby decreasing the low pressure, the capacity decrease of the compressor is suppressed by lowering the capacity control target to rather increase the capacity whereby the refrigerant insufficient state in the refrigerant circuit can be improved.

In the air-conditioning system of the seventh invention, subcooling amount detection means detects an indoor unit inlet subcooling amount during the cooling operation, and the fifth flow rate controlling means controls the valve opening degree of the fifth flow rate controller, so that even when the refrigerant at the inlet of the first flow rate controller of the cooling indoor unit is in the vapor-liquid two phase state and the subcooling amount is decreased thereby decreasing the low pressure, the refrigerant staying in the accumulator can be supplied to the compressor to increase the refrigerant circulating amount to by increasing the valve opening degree of the fifth flow rate controller, whereby the refrigerant insufficient state in the refrigerant circuit can be improved.

In the air-conditioning system of the eighth invention, the subcooling amount detection means detects indoor unit inlet subcooling amount during the cooling operation, and the sixth valve opening degree controlling means controls the valve opening degree of the second bypass circuit in accordance with the subcooling amount, so that even when the refrigerant at the inlet of the first flow rate controller of the cooling indoor unit is in the vapor-liquid two phase state and the subcooling amount is decreased thereby decreasing the low pressure, the refrigerant staying in the accumulator can be evaporated and supplied to the compressor to increase the refrigerant circulating amount to by opening the second bypass circuit, whereby the refrigerant shortage state in the refrigerant circuit can be improved.

In the air-conditioning system of the ninth invention, the takeoff pipe is arranged to extend through cooling fins of the heat source unit side heat exchanger, so that even when the refrigerant in the vapor-liquid two phase state is supplied from the heat source unit side heat exchanger due to the air flow rate control conditions of the heat source unit side fan, and even when the refrigerant evaporates or fails to condense due to a high air temperature, the refrigerant is heat-exchanged again to become liquid at the takeoff pipe coiled in the fins, whereby a stable and accurate detection can be realized by the second temperature detection means.

In the air-conditioning system of the tenth invention, when the heating-dominant operation in the concurrent cooling and heating operation, the high pressure vapor refrigerant is introduced through the heat source side change-over valve, the second connection pipe and the first junction unit to the respective indoor units for heating, and thereafter the refrigerant partially flows into the indoor unit for cooling to cool the room from where the refrigerant flows into the first connection pipe through the first junction unit. On the other hand, the remaining refrigerant joins the refrigerant passed through the indoor unit for cooling to flow into the first connection pipe to return to the heat source unit. After the refrigerant returned to the heat source unit, it flows through the first flow path through the heat source unit side change-over valve, the heat source unit side bypass pipe and the change-over valve.

Also, in the cooling-dominant operation, the high-pressure vapor is heat-exchanged by a proper amount in the first and the second heat changing elements to provide a two-phase state refrigerant and flows through the change-over valve, the heat exchanger side bypass pipe and the second connection pipe. The vapor refrigerant is introduced into the indoor unit for heating through the the first junction unit for heating and then flowed into the second junction unit. On the other hand, the liquid refrigerant flows through the second flow rate controller to join with the refrigerant which has passed through the indoor unit for heating at the second junction unit to flow into each indoor unit for cooling to cool the room and thereafter introduced into the heat source unit through the first junction unit and the first connection pipe to return t the compressor.

Further, in the heating only operation, the refrigerant is introduced into each indoor unit through the first junction unit to heat the room and returns to the heat source unit from the second junction unit.

Also, in the cooling only operation, the refrigerant is heat-exchanged in the first and the second heat exchanging elements, further heat-exchanged in the third heat exchanging element through the changer-over valve, and is introduced into each indoor unit through the second junction unit to cool the room and returns to the heat source unit from the first junction unit.

In the defrosting operation, the refrigerant is heat-exchanged at the first and the second heat exchanging elements, further heat-exchanged at the third heat exchanging element through the change-over valve, and is introduced into each indoor unit through the second junction unit t return to the heat source unit through the first junction unit.

In the air-conditioning system of the eleventh invention, the first stop time count means counts a stop time of the indoor unit which is not being operated during the operation of the compressor, and, when the stop time of the indoor unit exceeds a predetermined first set time, the first control means switches the change-over valve to connect the indoor unit which is not being operated, to the second connection pipe for a period of a predetermined second set time, thereby to cause the liquid refrigerant staying in the indoor side heat exchanger of the indoor unit being stopped to the first connection pipe.

In the air-conditioning system of the eleventh invention, the second stop time count means counts a stop time of the indoor unit which is not being operated during the operation of the compressor, and, when the stop time of the indoor unit exceeds a predetermined third set time, the second control means switches the change-over valve to connect the indoor unit which is not being operated, to the second connection pipe for a period of a predetermined fourth set time, thereby to cause the liquid refrigerant staying in the indoor side heat exchanger of the indoor unit being stopped to the second connection pipe.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENTS

The description of the embodiments of the air-conditioning system of the present invention will now be made in terms of the drawings.

Embodiment 1

Figure 1:
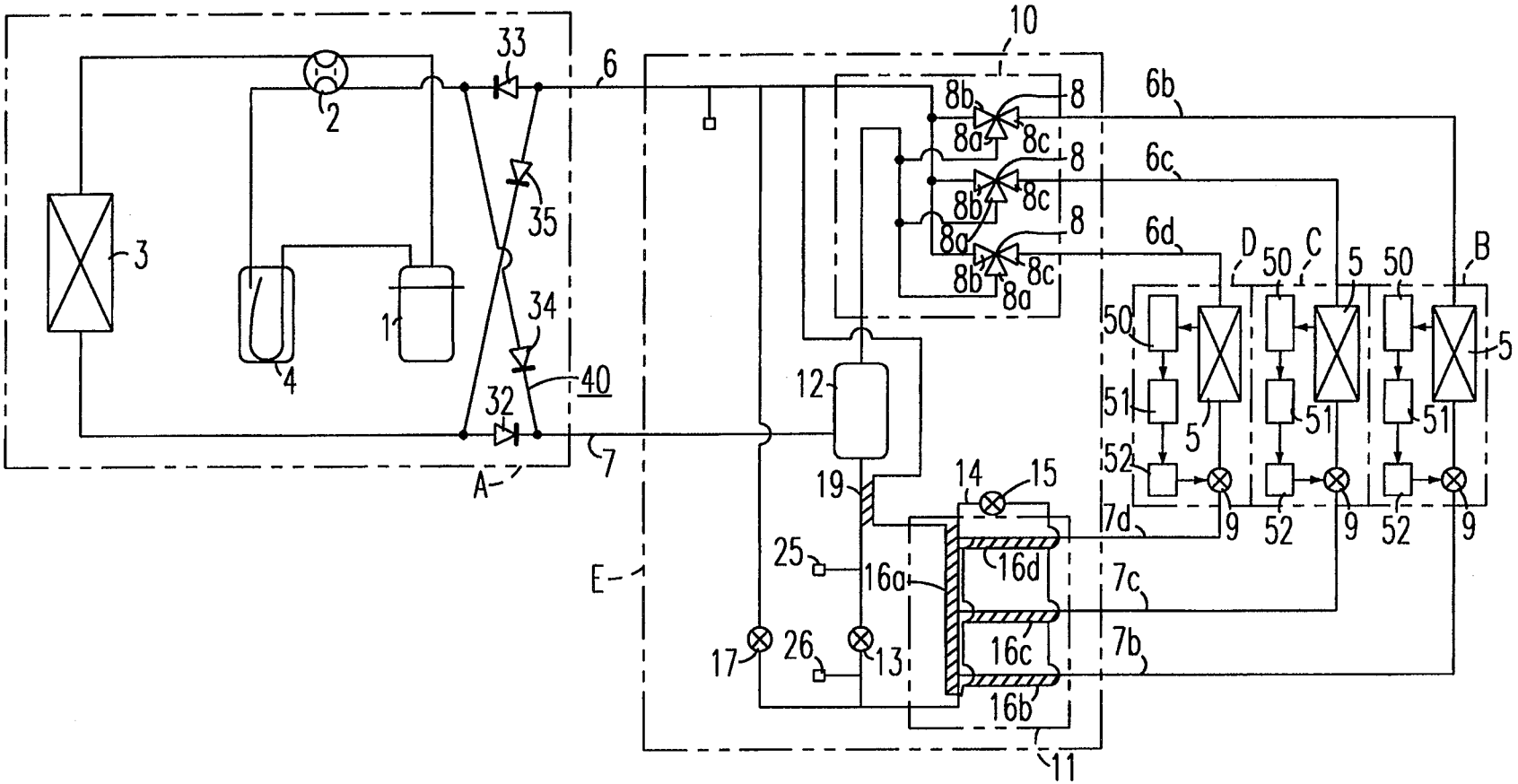
FIG. 1 is a general-schematic diagram illustrating the refrigeration lines of the air-conditioning system of a first embodiment of the present invention.
Figure 2:
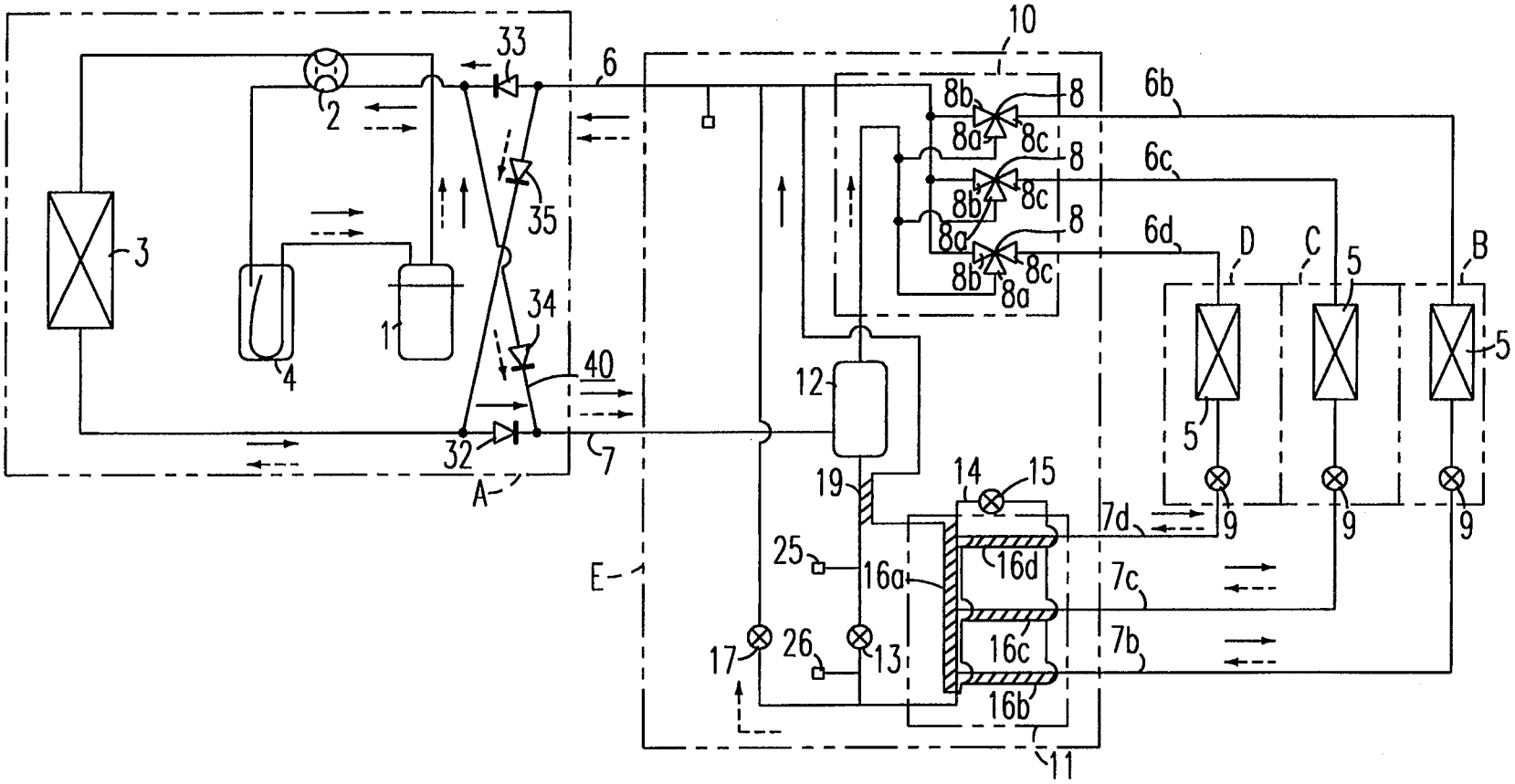
FIG. 2 is a refrigerant circuit diagram for explaining the operation states for cooling only and heating only in the air-conditioning system of the first embodiment of the present invention.
Figure 3:
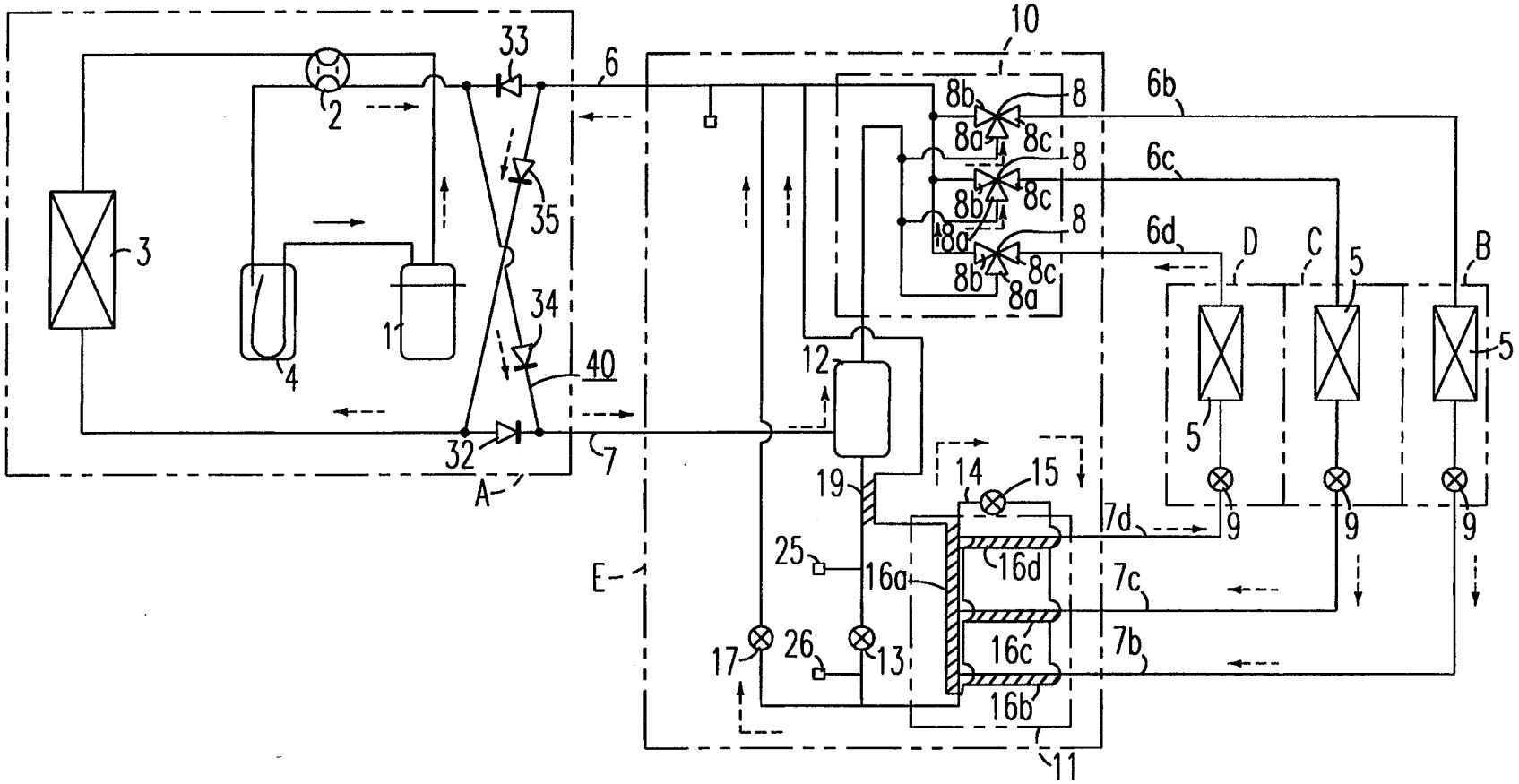
FIG. 3 is refrigerant circuit diagram for explaining the operational state for the heating-dominant operation in the air-conditioning system of the first embodiment of the present invention.
Figure 4:
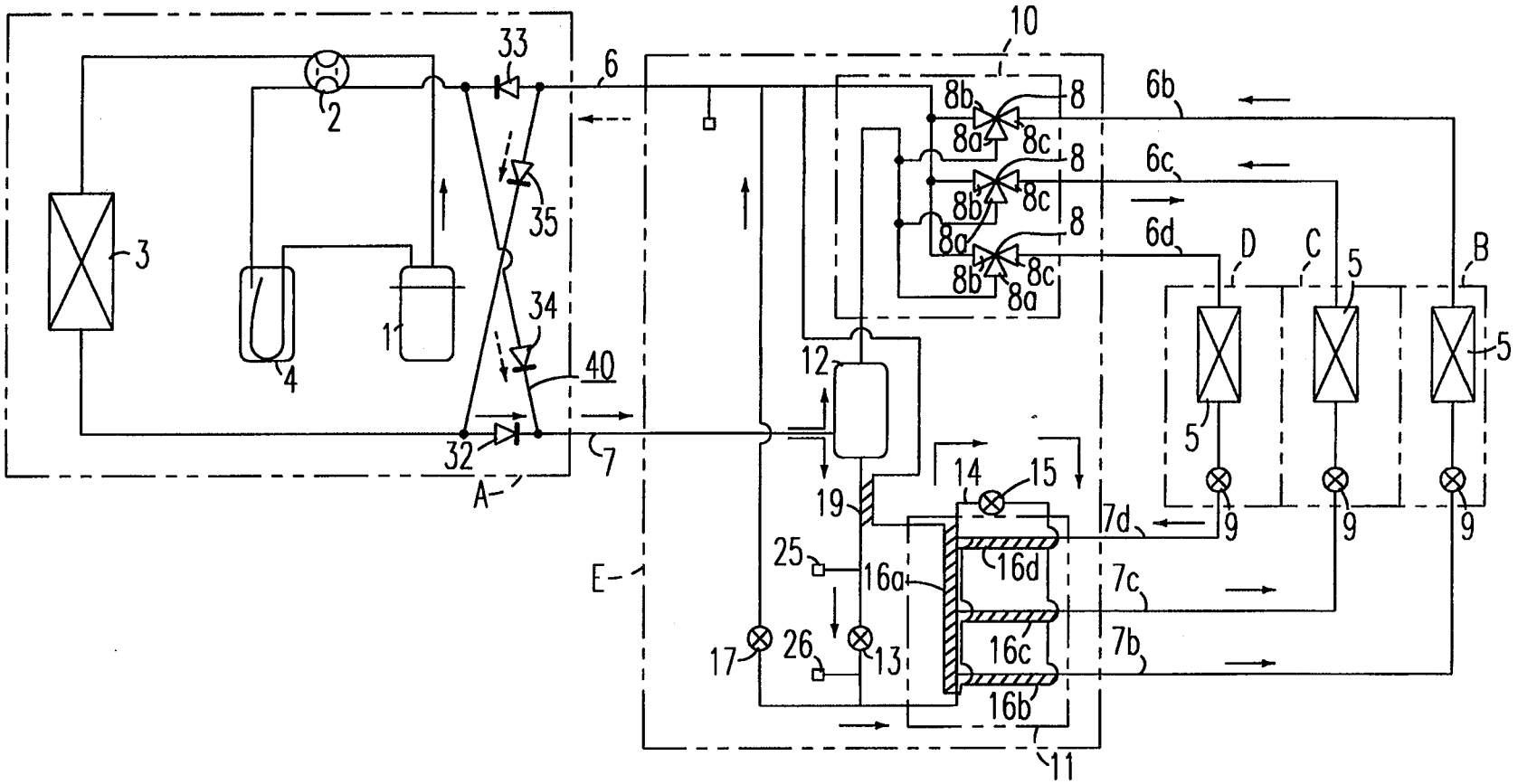
FIG. 4 is a refrigerant circuit diagram for explaining the operational state for the cooling dominant operation in the air-conditioning system of the first embodiment of the present invention.

FIG. 1 is a general schematic diagram of the refrigerant lines in one embodiment of the first invention. FIGS. 2 to 4 illustrate the operational state in the cooling and the heating operations of the first embodiment illustrated in FIG. 1, and FIG. 2 illustrates the cooling or heating only operational states, FIGS. 3 and 4 illustrate the concurrent cooling and heating operation, FIG. 3 being operational state diagram for the heating dominant operation (where the heating operation capacity is larger than the cooling operation capacity) and FIG. 4 being operational state diagram for the cooling dominant operation (where the cooling operation capacity is larger than the heating operation capacity).

While this first embodiment will be described in terms of a heat source unit having three indoor units, the heat source unit having at least two indoor units will equally be applicable.

In FIG. 1, reference character A designates a heat source unit, B, C and D designate similarly constructed heat source units connected in parallel to each other as will be described in more detail later. E, which will be described in more detail later, is a junction unit including a first junction portion, a second flow rate controller, a second junction portion, a vapor-liquid separator, a heat exchanger, a third flow rate controller and a four flow rate controller.

Also, reference numeral 1 designates a compressor, 2 is a four-way valve for changing the refrigerant flow direction of the heat source unit, 3 designates a heat source unit side heat exchanger, 4 designates an accumulator connected to the compressor 1 through the four-way valve 2 and the heat source unit A comprises the compressor 1, the four-way valve 2, the heat source unit side heat exchanger 3 and the accumulator 4.

Also, reference numeral 5 designate indoor unit side heat exchangers disposed in three indoor units B, C and D, **6*b*, 6*c* and 6*d* are indoor unit side first connection pipes corresponding to the first connection pipe 6 for connecting the junction unit E to the respective indoor unit side heat exchangers 5 of the indoor units B, C and D, 7 is a second connection pipe thinner than the first connection pipe 6 for connecting the junction unit E to the heat source unit side heat exchanger 3** of the heat source unit A.

Also, reference characters **7*b*, 7*c* and 7*d* are indoor unit side second connection pipes corresponding to the second connection pipe 7 for connecting the junction unit E to the indoor unit side heat exchanger 5** of the respective indoor units B, C and D.

Reference numeral 8 designates three-way changeover valve which is a valve unit capable of selectively connecting the indoor unit side first connection pipes **6*b*, 6*c* and 6*d* to either of the first connection pipe 6 and the second connection pipe 7, and isolating the indoor unit side first connection pipes 6*b*, 6*c* and 6*d* from the first connection pipe 6 and the second connection pipe 7**.

Reference numerals 9 designate first flow rate controllers connected to the indoor unit side second connection pipes **7*b*, 7*c* and 7*d* for being controlled by the superheat amount at the outlet side of the indoor unit side heat exchanger 5 during the cooling operation (by a first valve opening degree control means 52 which will be described later, in this embodiment) and by the subcooling amount at the outlet side of the indoor unit-side heat exchangers 5 during the heating operation. The first flow rate controllers 9 are connected to the indoor unit side second connection pipes 7*b*, 7*c* and 7*d***.

Reference numeral 10 designates a first junction portion comprising the three-way valves for selectively connecting the indoor unit side first connection pipes **6*b*, 6*c* and 6*d* to either the first connection pipe 6 or the second connection pipe 7**.

Reference numeral 11 designates a second junction portion comprising the indoor unit side second connection pipes **7*b*, 7*c* and 7*d* and the second connection pipe 7**.

Reference numeral 12 designates a vapor-liquid separator inserted into the second connection pipe 7, a vapor phase region thereof being connected to a first opening **8*a* of the three-way valve 8 and a liquid phase regin thereof being connected to the second junction portion 11**.

Reference numeral 13 designates a second flow rate controller (an electrical expansion valve in this embodiment) capable of closing and opening and connected between the vapor-liquid separator 12 and the second junction portion 11.

Reference numeral 14 designates a bypass pipe connecting the first connection pipe 6 to the second junction portion 11, 15 is a third flow rate controller (an electrical expansion valve in this embodiment) inserted into the bypass pipe 14, **16*a* is a second heat exchanging portion disposed downstream of the third flow rate controller 15 inserted into the bypass pipe 14 for carrying out heat-exchange with respect to the indoor unit side second connection pipes 7*b*, 7*c* and 7*d* in the second junction portion 11**.

Reference numerals **16*b*, 16*c* and 16*d* are third heat-exchanging portions disposed downstream of the third flow rate controller 15 inserted into the bypass pipe 14 for heat-exchanging in relation to the respective indoor unit side second connection pipes 7*b*, 7*c* and 7*d* in the second junction portion 11**.

Reference numeral 19 designates a first heat exchanging portion disposed downstream of the third flow rate controller 15 of the bypass pipe 14 and the second heat exchanging portion **16*a* for carrying out heat-exchanging in relation to the pipe connecting the vapor-liquid separator 12 and the second flow rate controller 13, and reference numeral 17 designates a fourth flow rate controller (an electrical expansion valve in this embodiment) capable opening and closing the connection between the second junction portion and the first connection pipe 6**.

On the other hand, reference numeral 32 is a third check valve disposed between the heat source unit side heat exchanger 3 and the second connection pipe 7 for allowing the refrigerant to flow only from the heat source side heat exchanger 3 to the second connection pipe 7.

Reference numeral 33 is a fourth check valve disposed between the four-way valve 2 of the heat source unit A and the first connection pipe 6 for allowing the refrigerant to flow only from the first connection pipe 6 to the four-way valve 2.

Reference numeral 34 designates a fifth check valve disposed between the four-way valve 2 of the heat source unit A and the second connection pipe 7 for allowing the refrigerant to flow only from the first connection pipe 6 to the four-way valve 2.

Reference numeral 35 designates a sixth check valve disposed between the heat source unit side heat exchanger 3 and the first connection pipe 6 for allowing the refrigerant to flow only from the heat source unit side heat exchanger 3 to the first connection pipe 6.

The above-described third, fourth, fifth and sixth check valves 32, 33, 34 and 35, respectively, constitute a flow path change-over unit 40.

Reference numeral 25 designates a first pressure detecting means disposed between the first junction portion 10 and the second flow rate controller 13, and 26 is a second pressure detecting means disposed between the second flow rate controller 13 and the fourth flow rate controller 17.

Reference numeral 50 designates a suction air temperature detecting means for detecting suction air of the indoor unit side heat exchanger 5, 51 designates an opening degree setting means for setting a minimum opening degree in accordance with a difference between the suction air temperature detected by the suction air temperature detecting means 50 and the target temperature set beforehand for the indoor unit, and 52 designates a first valve opening degree control means for controlling opening degree corresponding to the minimum opening degree, which constitutes a control device for the first flow rate controller 9 by the suction air temperature detecting means 50, the opening degree setting means 51 and the first valve opening degree control means 52.

The operation of the above first embodiment will now be described.

First, the cooling only operation will be described in conjunction with FIG. 2. As illustrated by solid arrows in FIG. 2, the high temperature, high pressure refrigerant gas supplied from the compressor 1 flows through the four-way valve 2, heat-exchanged in relation to outdoor air in the heat source unit side heat exchanger 3 to be condensed into liquid, and flows through the third check valve 32, the second connection pipe 7, the vapor-liquid separator 12, the second flow rate controller 13, the second junction portion 11 and indoor unit side second connection pipes **7*b*, 7*c* and 7*d*** to be supplied into the respective indoor units B, C and D.

The refrigerant flowed into the respective indoor units B, C and D is pressure-reduced by the respective first flow rate controllers 9 and heat-exchanged in the indoor unit side heat exchangers 5 in relation to the indoor air to evaporate into vapor to cool the room.

The refrigerant in the vapor state follows the circulating cycle from the indoor unit side first connection pipes **6*b*, 6*c* and 6*d* to the compressor 1 through the three-way valve 8, the first junction portion 10, the first connection pipe 6, the fourth check valve 33, the heat source side four-way valve 2 and the accumulator 4** to achieve the cooling operation.

At this time, the first opening **8*a* of the three-way valve 8 is closed, and the second opening 8*b* and the third opening 8*c* are opened, and since the first connection pipe 6 is at a low pressure and the second connection pipe 7 is at a high pressure, the refrigerant flows through the third check valve 32 and the fourth check valve 33**.

In this cycle, a portion of the refrigerant passed through the second flow rate controller 13 enters into the bypass pipe 14 and is pressure-reduced to a low pressure at the third flow rate controller 15. The refrigerant then is heat-exchanged in the third heat exchanging portions **16*b*, 16*c* and 16*d* in relation to the indoor unit side second connection pipes 7*b*, 7*c* and 7*d* of the second junction portion 11, and is heat-exchanged in the second heat exchanging portion 16*a* in relation to the meeting portions of the indoor unit side second connection pipes 7*b*, 7*c* and 7*d* of the second junction portion 11, and is further heat-exchanged in the first heat exchanging portion 19 in relation to the refrigerant flowing into the second flow rate controller 13, the evaporated refrigerant being suctioned into the compressor 1 through the first connection pipe 6, the fourth check valve 33, the four-way valve 2 of the heat source unit and the accumulator 4**.

On the other hand, the refrigerant at the second junction portion 11 which is heat-exchanged and cooled at the first, the second and the third heat exchanging portions 19, **16*a*, 16*b*, 16*c* and 16*d*** and sufficiently subcooled flows into the indoor units B, C and D to be operated for cooling.

Next, the heating-only operation will be described in conjunction with FIG. 2. As illustrated by dashed-line arrows in FIG. 2, the high temperature, high pressure refrigerant gas supplied from the compressor 1 flows through the four-way valve 2, the fifth check valve 34, the first connection pipe 6, the vapor-liquid separator 12, the first junction portion 10, the three-way valve 8 and the indoor unit side first connection pipes **6*b*, 6*c* and 6*d*** to flow into the indoor units B, C and D to be heat-exchanged in relation to indoor air into liquid to heat the room.

The refrigerant in the liquid state flows through the first flow rate controller 9 which is controlled in the substantially fully-opened state by the subcooling amount at the outlet of the respective indoor unit side heat exchanger 5, flows through the indoor unit side second connection pipes **7*b*, 7*c* and 7*d* into the second junction portion 11 to joint together to further flow through the fourth flow rate controller 17**.

At this time, the refrigerant is pressure-reduced to a low-pressure vapor-liquid two phase state at either of the first flow rate controllers 9 or the third and the fourth flow rate controllers 15 and 17.

The refrigerant pressure-reduced to a low pressure follows the circulating cycle from the first connection pipe 6 to the compressor 1 through the sixth check valve 6 of the heat source unit A, the heat source unit side heat exchanger 3, where it is heat-exchanged in relation to the outdoor air to evaporate into a gaseous state and further flows through the four-way valve 2 and the accumulator 4.

At this time, the second opening **8*b* of the three-way valve 8 is closed, and the first opening 8*b* and the third opening 8*c* are opened, and since the first connection pipe 6 is at a low pressure and the second connection pipe 7 is at a high pressure, they are communicated to the fifth check valve 34 and the sixth check valve 35 because it is in communication with the suction side of the compressor 1 and the outlet side of the compressor 1**, respectively.

The heating-dominant operation in the concurrent cooling and heating operation will now be described in conjunction with FIG. 3. In this case, the description will be made as to where the two indoor units B and C are to be operated for heating and the indoor unit D is to be operated for cooling. As shown by the dotted arrows in the figure, the high temperature, high pressure refrigerant gas supplied from the compressor 1 is supplied to the junction unit E through the four-way valve 2, the fifth check valve 34 and the second connection pipe 7, and then introduced into the indoor units B and C to be operated for heating through the vapor-liquid separator 12, the first junction portion 10, the three-way valve 8 and the indoor unit side first connection pipes 6*b* and 6*c*, and the refrigerant is heat-exchanged in the indoor unit side heat exchanger 5 in relation to the indoor air to be condensed into liquid to heat the room.

The condensed liquid refrigerant flows through the first flow rate controller 9, which is controlled to the substantially fully opened state by the subcooling amount at the outlet of the indoor unit side heat exchangers 5 of the indoor units B and C, to be slightly pressure-reduced and introduced into the second junction portion 11.

One portion of this refrigerant flows through the indoor unit side second connection pipe 7*d* to enter into the indoor unit D to be operated for cooling, and flows through the first flow rate controller 9 controlled by the first valve opening degree control means 52 which will be described later to be pressure-reduced, and then flows into the indoor unit side heat exchanger 5 to be heat-exchanged to evaporate into a gaseous state to cool the room, and then flows into the first connection pipe 6 through the first connection pipe 6*d* and the three-way valve 8.

On the other hand, the other refrigerant flows through the fourth flow rate controller 17, which is controlled so that a pressure-difference between the detected pressures of the first pressure detecting means 25 and the second pressure detecting means 26 is within a predetermined range, and combined with the refrigerant flowed through the indoor unit D to be operated for cooling, to flow into the heat source side heat exchanger 3 through the thick first connection pipe 6 and the sixth check valve 35 of the heat source unit A, where it is heat-exchanged in relation to the outdoor air to evaporate into the gaseous state.

This refrigerant follows a circulating cycle extending to the compressor 1 through the four-way valve 2 of the heat source unit and the accumulator 4, whereby the heating-dominant operation is carried out.

At this time, the vapor pressure of the indoor unit side heat exchanger 5 of the indoor unit D to be operated for cooling and the pressure difference of the heat source unit side heat exchanger 3 is reduced because the thick first connection pipe 6 is substituted.

Also, at this time, the second opening 8*b* of the three-way valve 8 connected to the indoor units B and C is closed and the first opening 8*a* and the third opening 8*c* are opened, and the first opening 8*a* of the indoor unit D is closed and the second opening 8*b* and the third opening 8*c* are opened.

Also, at this time, since first connection pipe 6 is at a low pressure and the second connection pipe 7 is at a high pressure, the refrigerant flows into the fifth check valve 34 and the sixth check valve 35.

In this cycle, one portion of the liquid refrigerant flows from the meeting portion of the indoor unit side second connection pipes 7*b*, 7*c* and 7*d* of the second junction portion 11 to the bypass pipe 14, pressure-reduced at the third flow rate controller 15, and heat-exchanged at the third heat exchanging portions 16*b*, 16*c* and 16*d* in relation to the indoor unit side second connection pipes 7*b*, 7*c* and 7*d* of the second junction portion 11 and at the-second heat exchanging portion 16*a* in relation to the meeting portions of the indoor unit side second connection pipes 7*b*, 7*c* and 7*d* of the second junction portion 11, and further heat-exchanged in the first heat exchanging portion 19 in relation to the refrigerant flowing into the second flow rate controller 13, the evaporated refrigerant being supplied to the first connection pipe 6 and the sixth check valve 35 from where it is suctioned by the compressor 1 through the heat source unit four-way valve 2 and the accumulator 4.

On the other hand, the refrigerant at the second junction portion 11, which is heat-exchanged in the second and the third heat exchanging portions 16*a*, 16*b*, 16*c* and 16*d* to be sufficiently subcooled, is supplied to the indoor unit D to be operated for cooling.

Next, the cooling-dominant operation in the concurrent cooling and heating operation will now be described in conjunction with FIG. 4 in terms of the operation where two indoor units B and C are to be operated for cooling and the indoor unit D is to be operated for heating. As illustrated by solid-line arrows in FIG. 4, the refrigerant gas supplied from the compressor 1 flows through the four-way valve 2 to the heat exchanger 3, where it is heat-exchanged in relation to outdoor air to become two phase high-pressure and high-temperature state.

After this, the refrigerant in the high-temperature, high-pressure two phase state is supplied to the vapor-liquid separator 12 of the junction unit E through the third check valve 32 and the second connection pipe 7.

The refrigerant is then separated into the gaseous refrigerant and the liquid refrigerant, and the separated gaseous refrigerant flows through the first junction portion 10, the three-way valve 8 and the indoor unit side first connection pipe 6*d* into the indoor unit D to be operated for heating, where it is heat-exchanged in the indoor unit side heat exchanger 5 in relation to-the indoor air to be condensed into liquid to heat the room.

The refrigerant further flows through the first flow rate controller 9 controlled by the subcooling amount at the outlet of the indoor unit side heat exchanger 5 to be a substantially fully opened state to be slightly pressure-reduced to become an intermediate pressure (intermediate) between the high and the low pressure and flows into the second junction portion 11.

On the other hand, the remaining refrigerant flows through the second flow rate controller 13, which is controlled so that a pressure difference between the high pressure and the intermediate pressure is maintained constant on the basis of the detected pressures of the first pressure detecting means 25 and the second pressure detecting means 26, flows into the second junction portion 11 to be combined with the refrigerant flowed through the indoor unit D to be operated for heating, and flows into the indoor units B and C through the indoor unit side second connection pipes 7*b* and 7*c*. The refrigerant flowed into the respective indoor units B and C is pressure-reduced to a low pressure by the first flow rate controller 9 controlled by a first valve opening degree controlling means 52 which will be described later to be heat-exchanged in relation to the indoor air to evaporate into the gaseous state to cool the room.

This refrigerant in the gaseous state follows a circulating cycle extending to the compressor 1 through the indoor unit side first connection pipes 6*b* and 6*c*, the three-way valve 8, the first connection pipe 10, the first connection pipe 6, the fourth check valve 33, the four-way valve 2 of the heat source unit and the accumulator 4, whereby the cooling-dominant operation is carried out.

Also, at this time, the first opening 8*a* of the three-way valve 8 connected to the indoor units B and C is closed and the second opening 8*b* and the third opening 8*c* are opened, and the second opening 8*b* of the indoor unit D is closed and the first opening 8*b* and the third opening 8*c* are opened.

Also, at this time, since the first connection pipe 6 is at a low pressure and the second connection pipe 7 is at a high pressure, the refrigerant flows into the third check valve 32 and the fourth check valve 33.

In this cycle, one portion of the liquid refrigerant flows from the meeting portion of the indoor unit side second connection pipes 7*b*, 7*c* and 7*d* of the second junction portion 11 to the bypass pipe 14, pressure-reduced to a low pressure at the third flow rate controller 15, and heat-exchanged at the third heat exchanging portions 16*b*, 16*c* and 16*d* in relation to the indoor unit side second connection pipes 7*b*, 7*c* and 7*d* of the second junction portion 11 and at the second heat exchanging portion 16*a* in relation to the meeting portions of the indoor unit side second connection pipes 7*b*, 7*c* and 7*d* of the second junction portion 11, and further heat-exchanged in the first heat exchanging portion 19 in relation to the refrigerant flowing into the second flow rate controller 13, the evaporated refrigerant being supplied to the first connection pipe 6 and the fourth check valve 33 from where it is suctioned by the compressor 1 through the heat source unit four-way valve 2 and the accumulator 4.

On the other hand, the refrigerant at the second junction portion 11, which is heat-exchanged in the first, the second and the third heat exchanging portions 19, 16*a*, 16*b*, 16*c* and 16*d* to be sufficiently subcooled, is supplied to the indoor unit D to be operated for cooling.

The description will now be made as to the control of the first flow rate controller 9 of the indoor unit to be operated for cooling.

Figure 5:
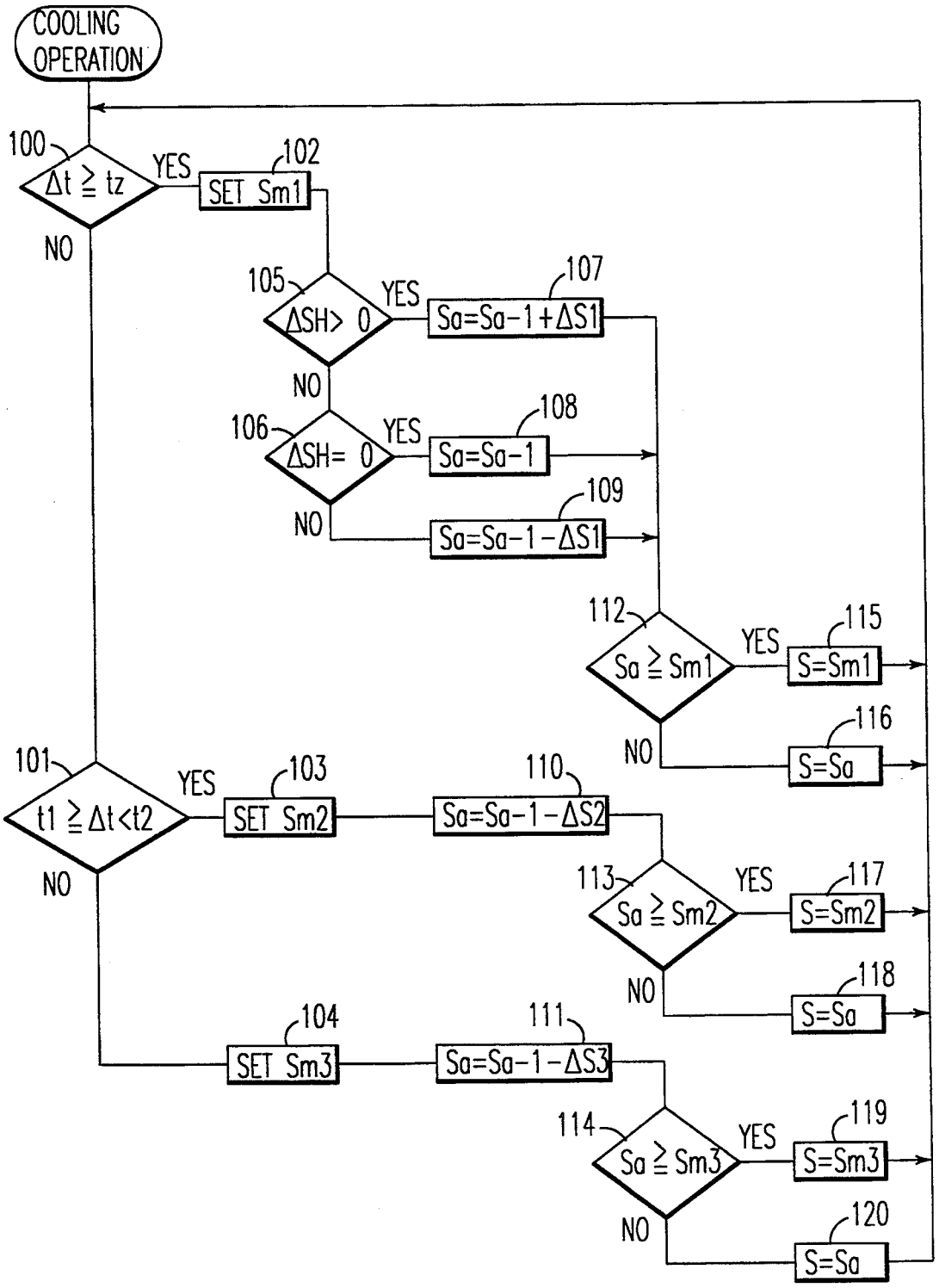
FIG. 5 is a flow chart illustrating the control of the valve opening degree of the first flow rate controller in the air-conditioning system of the first embodiment of the present invention.

FIG. 5 is a flow chart illustrating the control of the valve opening degree setting means 51 and the first valve opening degree control means 52.

Firstly, a control process of the first flow rate controller 9 by the opening degree setting means 51 and the first valve opening degree controlling means 52 will now be described.

In the first embodiment, three minimum opening degrees are set in accordance with a temperature difference $\Delta t \geqq t_a - t_0$ between a target temperature $t_0$ previously set in the indoor units and a detected temperature $t_a$ of the suction air temperature detecting means 50.

The first minimum valve opening degree $Sm_1$ is provided where the temperature difference $\Delta t$ is $\Delta t \geqq t_2$ and the rated cooling capacity is required to the indoor units. Therefore, in this case, the opening degree controlled in response to an outlet superheat SH at the outlet of the indoor unit side heat exchanger 5. That is, when the difference $\Delta SH = SH - SHm$, which is the difference between a target superheat SHm previously set for the indoor unit and the outlet superheat SH, can be expressed as $\Delta SH > 0$, it is determined that the refrigerant is short and the opening degree is increased. Contrary, when $\Delta SH < 0$, it is determined that the refrigerant is excessive and the opening degree is decreased. When $\Delta SH = 0$, it is determined that the refrigerant amount is proper and the opening degree is maintained.

The second minimum opening degree $Sm_2$ is for the case where the temperature difference $\Delta t$ is expressed as $t_1 \leqq \Delta t < t_2$ and is set to be smaller than the first minimum valve opening degree $Sm_1$. This is because the cooling capacity required in the indoor unit is less than the case where $\Delta t = t_2$ and only the refrigerant of the corresponding amount is needed to be supplied. That is, in this case, if only the first minimum valve opening degree $Sm_1$ can be set and the opening degree control is carried out by the superheating amount, the amount of the refrigerant is too large, so that the indoor units repeat running and stopping because of unbalanced required cooling capacity, disturbing the stability of the circulating cycle and degrading the comfort due to intermittent blow of cold wind. As above described, by providing the second minimum valve opening degree $Sm_2$ and decreasing the opening degree at a predetermined rate, an opening degree suitable for flowing the amount of the refrigerant which matches the required capacity and, also, by gradually controlling the opening degree, the stability of the circulating cycle is not disturbed.

The third minimum valve opening degree $Sm_3$ is for where the temperature difference $\Delta t$ is expressed as $\Delta t < t_1$, which is smaller than the second minimum valve opening degree. This is because the cooling capacity required to the indoor unit may be made further smaller than that in the case of $t_1 \leqq \Delta t < t_2$, and it is only required to flow an amount of the refrigerant in accordance with the capacity. The concept of opening degree setting and the opening degree control is similar to the case where $t_1 \leqq \Delta t \leqq t_2$, so that the description thereof is omitted.

The control state of a first valve opening degree control means 52 of the first flow rate controller 9 in accordance with the first embodiment will be described in conjunction with a flow chart shown in FIG. 5.

The indoor unit to be operated for cooling determines in a step 100 the temperature difference $\Delta t = t_a - t_0$ between the predetermined target temperature $t_0$ and the suction air temperature $t_a$ detected by the suction air temperature detecting means 50 to proceed to a step 102 when $\Delta t \geqq t_2$ and to a step 101 when $\Delta t < t_2$. In the step 102, the first minimum valve opening degree $Sm_1$ is set and determines in a step 105 a difference $\Delta SH = SH - SHm$ between the outlet superheat SH of the indoor side heat exchanger 5 and the predetermined target superheat SHm to proceed, when $\Delta SH > 0$, to a step 107 where a provisional opening degree $S_a$ which is a sum of the previous provisional opening degree $S_{a-1}$ and the first opening degree correction-$\Delta S_1$ and further to a step 112. When $\Delta SH < 0$ in the step 105, a step 106 is followed and when $\Delta SH = 0$, a step 108 is followed in which the provisional opening degree $S_a$ is taken as the previous provisional opening degree $S_{a-1}$ to further proceed to a step 112. Also, in the step 106, when $\Delta SH < 0$, the provisional opening degree $S_a$ which is a subtraction of the first opening degree correction $\Delta S_1$ from the previous provisional opening degree $S_{a-1}$ is calculated in a step 109 to proceed to the step 112. In the step 112, the provisional opening degree $S_a$ is compared with the first minimum valve opening degree $Sm_1$ and when it is equal to or less than $Sm_1$, a step 115 is selected to output $Sm_1$ as the opening degree S, and when it is larger than $Sm_1$, a step 116 is selected to output $S_a$ as the opening degree S. When proceeded to the step 101, a step 103 is selected when $\Delta t$ is $t_1 \leqq \Delta t < t_2$ to provide the second minimum valve opening degree $Sm_2$, from where a step 110 is pursued to calculate the provisional opening degree $S_a$ which is a subtraction of the second opening degree correction $\Delta S_2$ from the previous provisional opening degree $S_{a-1}$ to further proceed to a step 113. In the step 113, the provisional opening degree Sa is compared with the second minimum valve opening degree $Sm_2$ and the process proceeds to a step 117 when it is equal to or less than $Sm_2$ to provide an output of $Sm_2$ as the opening degree S and proceeds to a step 118 when it is larger than $Sm_2$ to provide an output of $S_a$ as the opening degree S.

When the process proceeds to the step 104 without satisfying the condition of the step 101, a third minimum valve opening degree $Sm_3$ is set, and the process proceeds to a step 111 where the provisional opening degree $S_a$ is calculated by a subtraction of the third opening degree correction $\Delta S_3$ from the previous provisional opening degree $S_{a-1}$ and further proceeds to a step 114. In the step 114, the provisional opening degree $S_a$ is compared with the third minimum valve opening degree $Sm_3$ and proceeds to a step 119 when it is equal to or less than $Sm_3$ to provide-an output of $Sm_3$ as an output and proceeds to a step 120 . When it is larger than $Sm_3$ to provide an output of the opening degree S.

As should be readily apparent from the foregoing, in this embodiment, three different minimum opening degrees can be set based upon the temperature difference $\Delta t$. The values for $t_1$ and $t_2$ are preselected constants, and are utilized such that the first minimum valve opening degree $Sm_1$ is set where the temperature difference $\Delta t$ is large (i.e., $\Delta t \geqq t_2$), with the second minimum valve opening degree $Sm_2$ set where $\Delta t$ is in a moderate or middle range ($t_1 \leqq \Delta t < t_2$), and with the third minimum value opening degree $Sm_3$ set where $\Delta t$ is small ($\Delta t < t_1$). In addition, as should also be apparent from the foregoing, the magnitude of change or the rate at which the first flow rate controller is moved to the selected minimum opening degree is controlled by the first valve opening degree control means 52 and is also dependent upon the selected minimum opening degree (and thus $\Delta t$), with the opening decreased by $\Delta S_2$ or $\Delta S_3$, respectively, for moderate and small values of $\Delta t$. In addition, for a large $\Delta t$ the movement to a stable opening degree is dependent upon the difference between a target superheat SHm and the outlet superheat SH as shown in FIG. 5. Thus, the opening degree setting means selects a minimum valve opening, with the first valve opening degree controlling means controlling movement of the valve to the selected minimum valve opening (for small and moderate $\Delta t$ values) at a predetermined rate which is determined by the first valve opening degree controlling means. Since the stable opening degree is dependent upon the outlet superheat SH (for a large $\Delta t$), the first flow rate controller is not always moved to the set minimum value $Sm_1$ for a large $\Delta t$, but may be moved to another stable opening degree (e.g., as discussed hereinearlier where $\Delta SH=0$). When At is moderate or small, the rate of movement to the set minimum is based upon the magnitude of $\Delta t$.

Thus, according to the first embodiment, suction air temperature detecting means 50 for detecting a suction air temperature of the indoor units, opening degree setting means 51 for setting a minimum valve opening degree of the first flow rate controller 9 in accordance with a difference between a detected temperature and a predetermined target temperature, and first valve opening degree controlling means 52 for controlling the valve opening degree in accordance with the temperature difference, so that the amount of the refrigeration supplied to the indoor side heat exchanger 5 can be properly regulated, enabling a continuous stable operation of the indoor units and surpression of disturbance to other indoor units, the junction unit and the heat source unit, whereby the cooling and heating operations can be selectively carried out with a plurality of indoor units and cooling by some of the indoor units and heating by the remaining indoor units can concurrently and stably be carried out.

Second Embodiment

Figure 6:
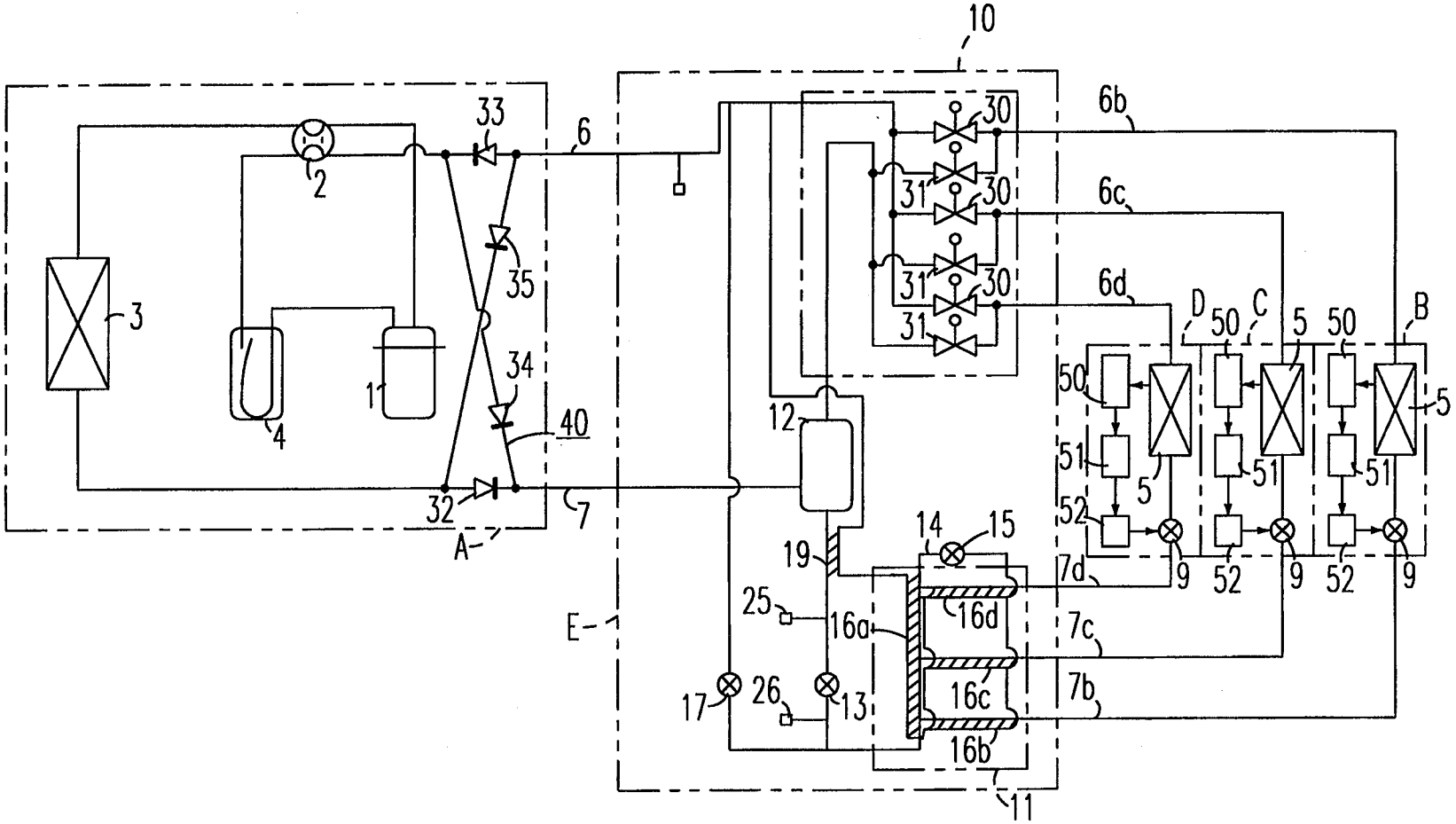
FIG. 6 is a schematic diagram generally illustrating the refrigerant lines of the air-conditioning system of the second embodiment of the present invention.

While the three-way valve 8 is provided in the above-described first embodiment in order to selectively connect the indoor unit side first connection pipes **6*b*, 6*c* and 6*d* to the first connection pipe 6 or to the second connection pipe 7, in this second embodiment, a switch valve such as two solenoid valves 30 and 31 as illustrated in FIG. 6** is provided to obtain a similar advantageous effect.

Third Embodiment

Figure 7:
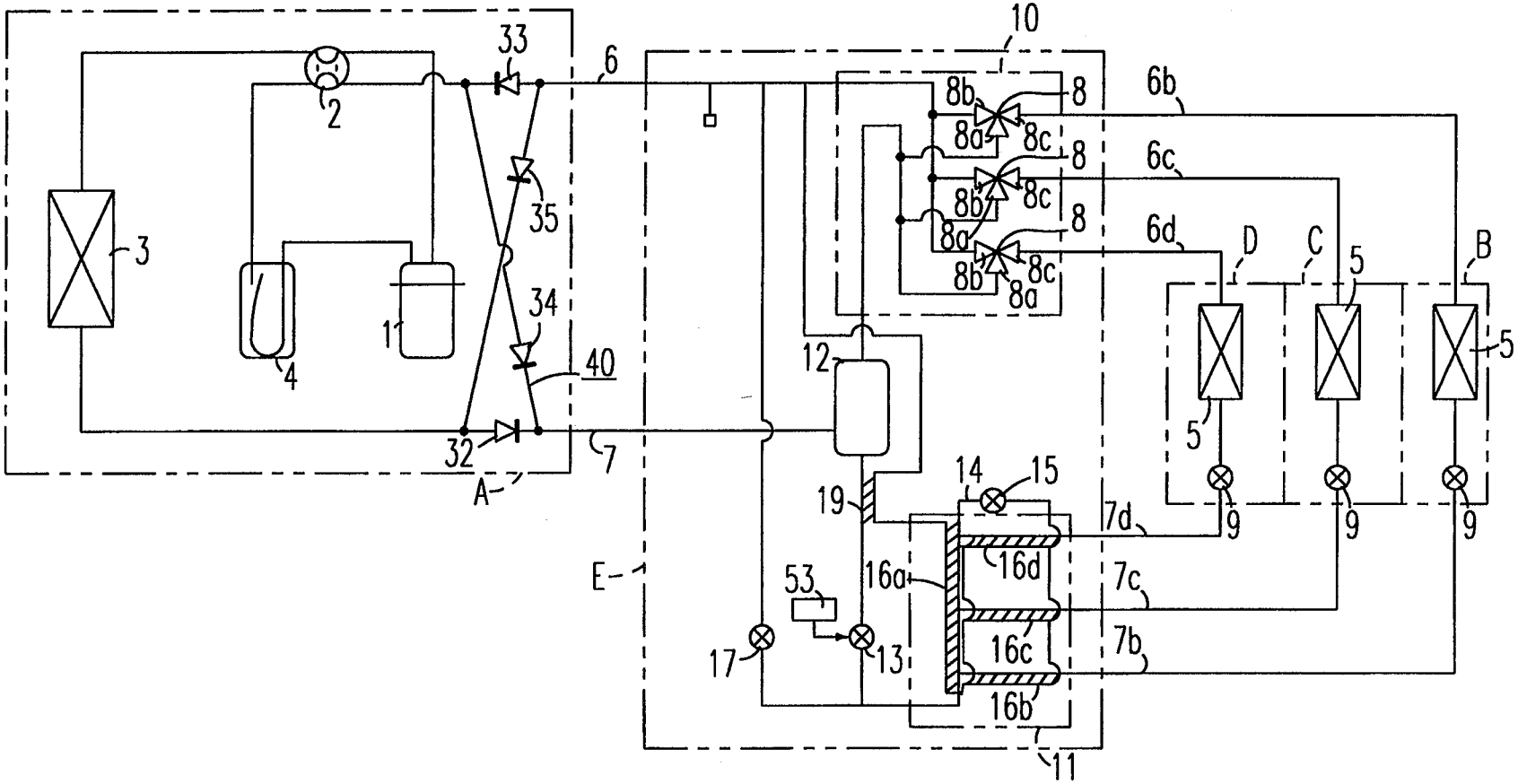
FIG. 7 is a schematic diagram generally illustrating the refrigerant lines of the air-conditioning system of the third embodiment of the present invention.

FIG. 7 is a general schematic diagram illustrating the refrigerant lines of one embodiment of an air-conditioning system of the second invention of the present application.

In the figure, reference numeral 53 designates a second valve opening degree control means which decreases the valve opening degree of the second flow rate controller 13 by an amount of increase of the heating operation load when the heating operation load on the indoor unit is increased and which increases the valve opening degree of the second flow rate controller 13 by an amount of decrease of the heating operation load when the heating operation load on the indoor unit is decreased.

In the third embodiment, the cooling-only or the heating-only operations and functions, the heating-dominant (where the heating operation capacity is higher than the cooling operation capacity) operation and function and the cooling-dominant (where the cooling operation capacity is higher than the heating operation capacity) operation and function are similar to those described in conjunction with the above first embodiment.

The description will now be made as to the flow rate control of the second flow rate controller 13 by the second valve opening degree control means 53 upon the variation in the number of heating indoor units in the concurrent cooling and heating operation (heating-dominant) when the heating capacity is higher than the cooling capacity.

For example, when the indoor units B and C are in the heating operation and the indoor unit D is in the cooling operation, three parallel flow paths extending through the indoor units B and C and the second flow rate controller 13 are presented as flow path in the heating operation portion. When the indoor unit B halts its operation, the first flow rate controller 9 of the indoor unit B is fully closed to provide two flow paths extending through the indoor unit C and the second flow rater controller 13, respectively. Thus, the flow paths decreases and the refrigerant pressure changes, causing disturbance of the refrigerant cycle. As a counter measure for this, when the indoor unit B halts its operation, the valve opening degree of the second flow rate controller 13 is increased to increase the flow therethrough so that the refrigerant which was flowing through the indoor unit B is shifted to flow through the second flow rate controller 13, whereby it is condensed in the first heat exchanging portion 19.

When the indoor unit B is in halt, the indoor unit C is operating for heating and when the indoor unit D is operating for cooling, two parallel flow paths extending through the indoor unit C and the second flow rater controller 13, respectively for the heating operation portion. When the indoor unit B initiates its operation, the first flow rate controller 9 of the indoor unit B opens, so that three flow paths extending through the indoor units B and C and the second flow rate controller 13. Thus, since the flow paths increase and the refrigerant pressure changes, the refrigerant cycle is disturbed. As a counter measure for this, when the indoor unit B starts its operation, the valve opening degree of the second flow rate controller 13 is decreased to decrease the flow therethrough so that the refrigerant which was flowing through the second flow rate controller 13 is shifted to flow through the indoor unit B.

Figure 8:
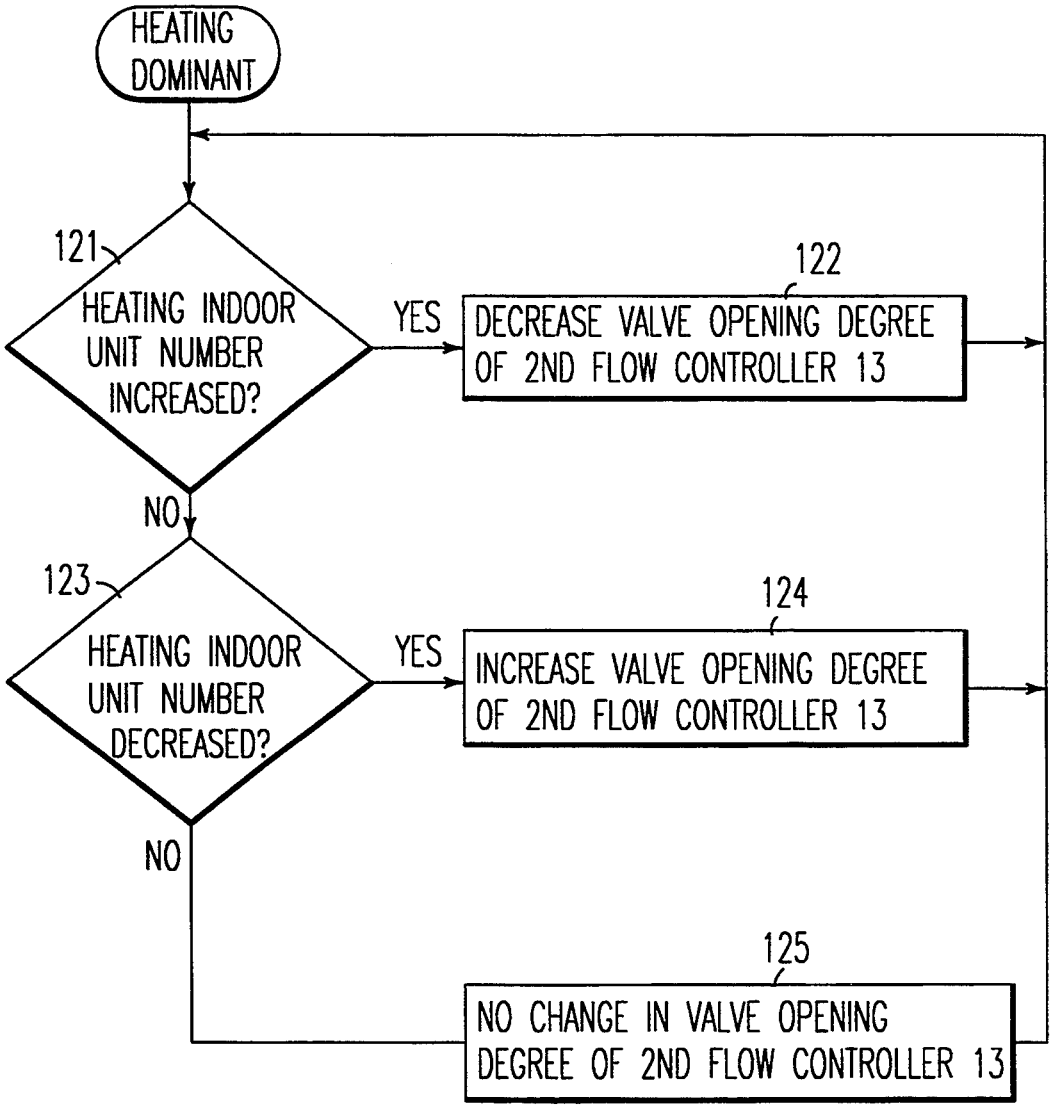
FIG. 8 is a flow chart illustrating the control of the valve opening degree of the second flow rate controller in the air-conditioning system of the third embodiment of the present invention.

The contents of the control of the second flow rate controller 13 by the second valve opening degree control means 53 in the heating-dominant operation in the concurrent cooling and heating operation will now be described in terms of the flow chart shown in FIG. 8.

In a step 121, whether or not the number of the heating indoor units is increased is determined and, when increased, the process proceeds to a step 122 and, when not increased, the process proceeds to a step 123. In the step 122, the valve opening degree of the second flow rate controller 13 is decreased and returns to the step 121. In the step 123, whether or not the number of the heating indoor units is decreased is determined and, when decreased, the process proceeds to a step 124 and, when not decrease, the process proceeds to a step 125. In the step 124, the valve opening degree of the second flow rate controller 13 is increased and returns to the step 121. In the step 125, the valve opening degree of the second flow rate controller 13 is not changed and returns to the step 121.

Thus, the flow control of the second flow rate controller 13 is carried out by the second valve opening control means 53 in correspondence with the change in the number of the heating indoor units. While the description has been made in terms of the heating-dominant operation, similar advantageous results can be obtained either in the heating operation and in the cooling-dominant operation.

Thus, according to the above-described third embodiment, the second valve opening degree controlling means 53 which decreases, when heating operation load on the indoor unit is increased, the valve opening degree of the second flow rate controller by a predetermined amount corresponding to an amount of increase of the heating operation load, and which increases, when heating operation load on the indoor unit is decreased, the valve opening degree of the second flow rate controller by a predetermined amount corresponding to an amount of decrease of the heating operation load, so that, even when the heating load is increased or decreased, an abrupt pressure change of the refrigerant can be suppressed and the disturbance of the refrigerant cycle can be reduced, enabling a continuous stable operation. Also, the fear of damages of the compressor 1 because of the pressure increase upon the decrease of the heating operation load on the indoor unit.

Fourth Embodiment

Figure 9:
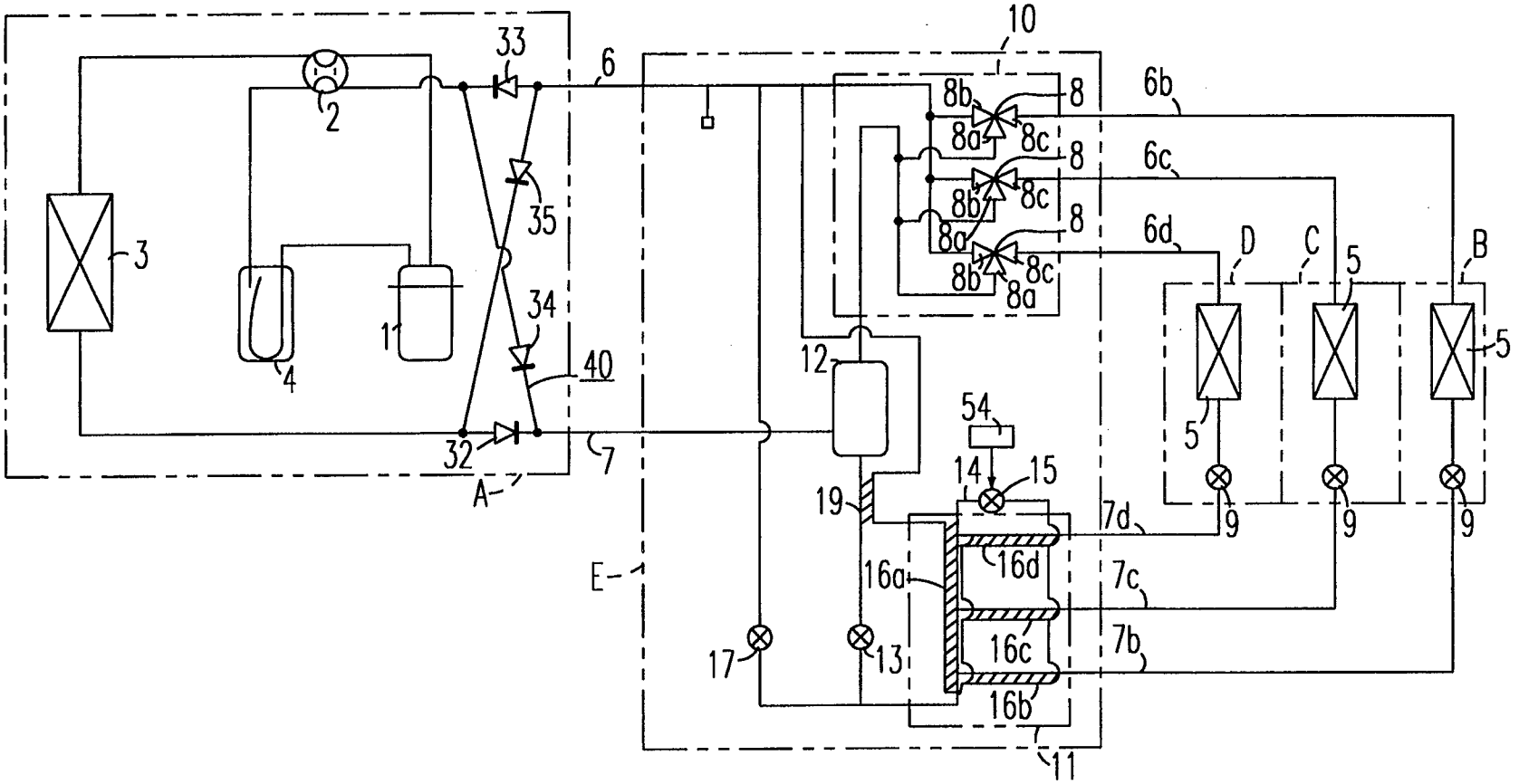
FIG. 9 is a schematic diagram generally illustrating the refrigerant lines of the air-conditioning system of the fourth embodiment of the present invention.

FIG. 9 is a general schematic view of the refrigerant lines of one embodiment of the air-conditioning system of the third invention of this application.

In the figure, reference numeral 54 designates a third valve opening degree controlling means which decreases, when cooling operation load on the indoor unit is increased, the valve opening degree of the third flow rate controller 15 by a predetermined amount corresponding to an amount of increase of the cooling operation load, and which increases, when cooling operation load on the indoor unit is decreased, the valve opening degree of the third flow rate controller by a predetermined amount corresponding to an amount of decrease of the cooling operation load.

In the fourth embodiment, the cooling-only or the heating-only operations and functions, the heating-dominant operation and function and the cooling-dominant operation and function are similar to those described in conjunction with the above first embodiment.

The description will now be made as to the flow rate control of the flow rate controller 13 by the third valve opening degree control means 53 upon the variation in the number of cooling indoor units in the concurrent cooling and heating operation.

For example, when the indoor unit D is in the heating operation and the indoor units B and C are in the cooling operation, two flow paths extending through the indoor units C and the third flow rate controller 15 are provided. This causes the flow path to decrease which generates the pressure change in refrigerant, the low pressure decreases to disturb the refrigerant cycle. As a counter measure for this, when the indoor unit B halts its operation, the valve opening degree of the third flow rate controller 15 is increased to increase the flow therethrough so that the refrigerant which was flowing through the indoor unit B is shifted to flow through the third flow rate controller 15, whereby it is evaporated in the first, second and third heat exchanging portions 16*a*~16*d* and 19.

When the indoor unit D is in the heating operation, the indoor unit B is in halt and when the indoor unit C is operating for cooling, two parallel flow paths extending through the indoor unit C and the third flow rate controller 15, respectively for the cooling operation portion. When the indoor unit B initiates its cooling operation, the first flow rate controller 9 of the indoor unit B opens, so that three flow paths extending through the indoor units B and C and the third flow rate controller 15. Thus, since the flow paths increase and the refrigerant pressure changes to increase the low pressure, the refrigerant cycle is disturbed. As a counter measure for this, when the indoor unit B starts its operation, the valve opening degree of the third flow rate controller 15 is decreased to decrease the flow therethrough so that a part of the refrigerant which was flowing through the third flow rate controller 15 is shifted to flow through the indoor unit B.

Figure 10:
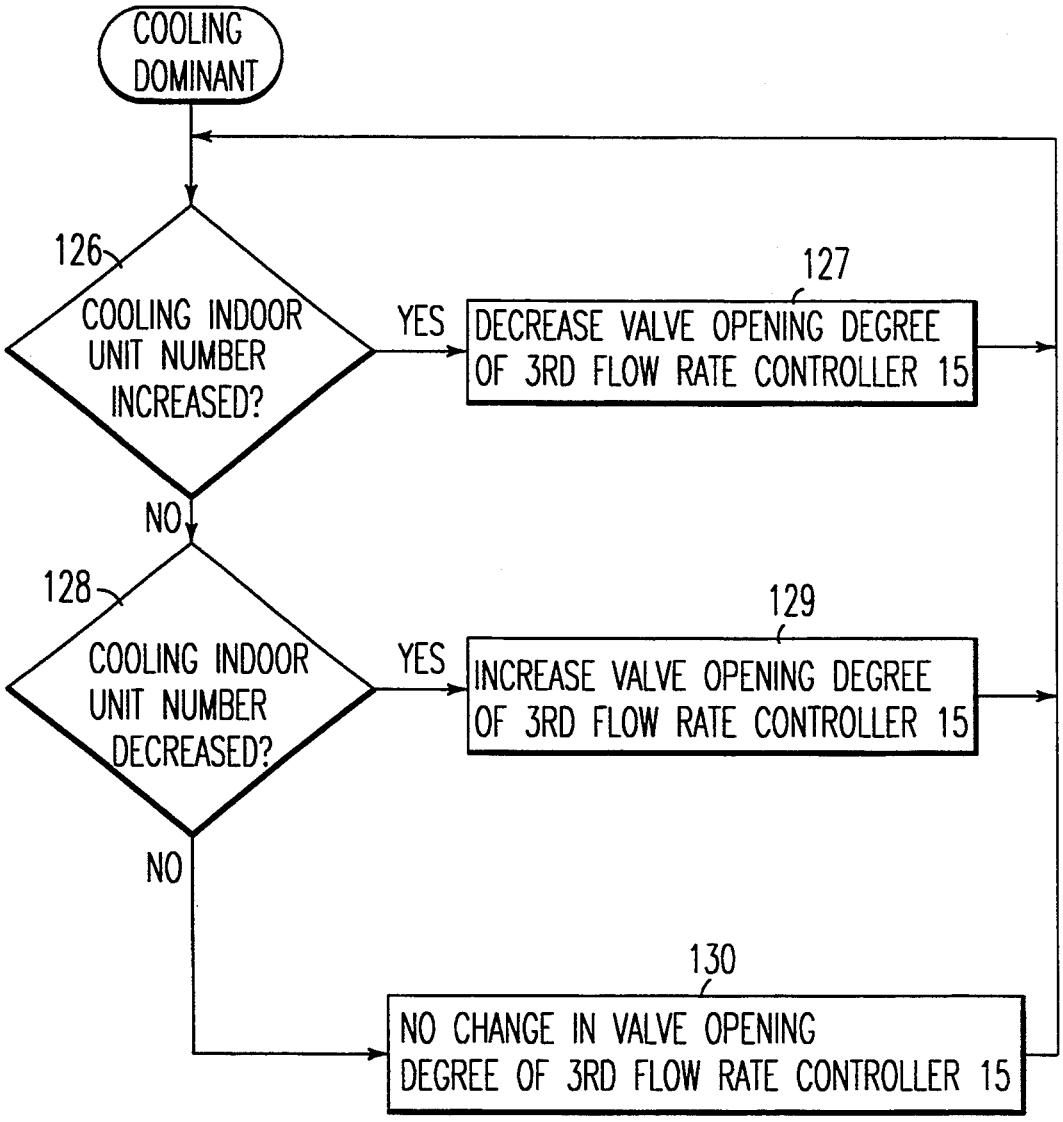
FIG. 10 is a flow chart illustrating the control of the valve opening degree of the third flow rate controller in the air-conditioning system of the fourth embodiment of the present invention.

The contents of the control of the third flow rate controller 15 by the third valve opening degree control means 54 in the heating-dominant operation in the concurrent cooling and heating operation will be described in terms of the flow chart shown in FIG. 10.

In step 126, whether or not the number of the cooling indoor units is increased is determined and, when increased, the process proceeds to a step 127 and, when not increased, the process proceeds to a step 128. In the step 127, the valve opening degree of the third flow rate controller 15 is decreased and returns to the step 126. In the step 128, whether or not the number of the heating indoor units is decreased is determined and, when decreased, the process proceeds to a step 129 and, when not decrease, the process proceeds to a step 130. In the step 129, the valve opening degree of the third flow rate controller 15 is increased and returns to the step 126. In the step 130, the valve opening degree of the third flow rate controller 15 is not changed and returns to the step 126.

Thus, the flow control of the third flow rate controller 15 is carried out by the third valve opening control means 54 in correspondence with the change in the number of the cooling indoor units. While the description has been made in terms of the cooling-dominant operation, similar advantageous results can be obtained either in the cooling operation and in the heating-dominant operation.

Thus, according to the above-described fourth embodiment, the third valve opening degree controlling means 54 which decreases, when cooling operation load on the indoor unit is increased, the valve opening degree of the third flow rate controller 15 by a predetermined amount corresponding to an amount of increase of the cooling operation load, and which increases, when cooling operation load on the indoor unit is decreased, the valve opening degree of the third flow rate controller 15 by a predetermined amount corresponding to an amount of decrease of the cooling operation load, so that, even when the cooling load is increased or decreased, an abrupt pressure change of the refrigerant can be suppressed and the disturbance of the refrigerant cycle can be reduced, enabling a continuous stable operation. Also, the fear of damages of the compressor 1 because of the exhaust temperature rise due to the pressure decease upon the decrease of the cooling operation load on the indoor unit.

Fifth Embodiment

Figure 11:
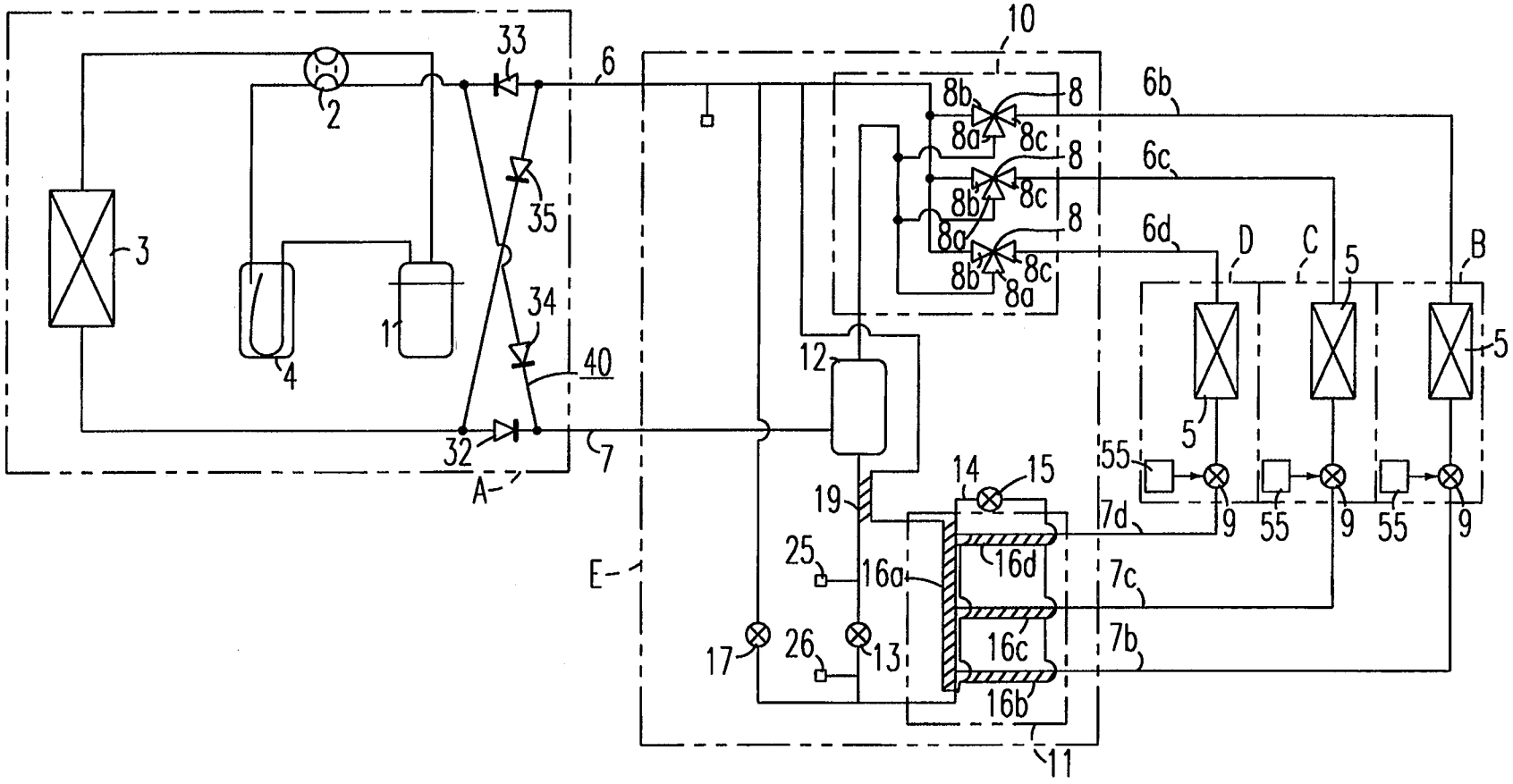
FIG. 11 is a schematic diagram generally illustrating the refrigerant lines of the air-conditioning system of the fifth embodiment of the present invention.
Figure 12:
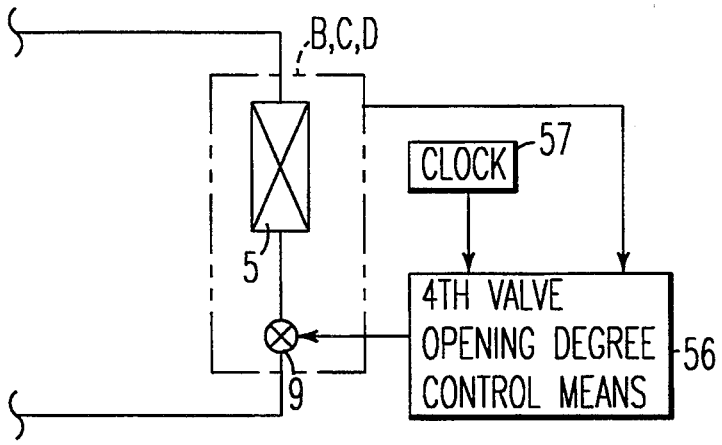
FIG. 12 is a schematic diagram illustrating the control mechanism of the first flow rate controller in the air-conditioning system of the fifth embodiment of the present invention.

FIG. 11 is a general schematic view illustrating the refrigerant lines of one embodiment of the air-conditioning system of the fourth invention of this application, and FIG. 12 is a schematic diagram illustrating a control mechanism for the first flow rate controller 9 of FIG. 11.

In the figures, reference numeral 55 designates the control mechanism for controlling the valve opening degree of the first flow rate controller 9, which comprises a fourth valve opening degree controlling means 56 which provides, when an indoor unit of the plurality indoor units which had been operated for heating (cooling) is stopped, the first flow rate controller 9 with a valve opening degree which is a predetermined percentage of the valve opening degree immediately before the stopping of the indoor unit, and a time counting means 57 for counting-a time during which the valve opening degree of the predetermined percentage is to be maintained.

The cooling-only and the heating-only operations as well as the heating-dominant and the cooling-dominant operations in the fifth embodiment are similar to those of the previously described first embodiment.

The control of the first flow rate controller 9 by the control mechanism 55 when the indoor unit which was being in the heating operation or in the cooling operation is stopped will be described.

When the indoor unit which was in the heating operation (the cooling operation) is stopped, the opening degree of the first flow rate controller 9 is controlled so that it does not abruptly become a closed state. This is because, if the indoor unit which was to be stopped abruptly looses its condensing capacity (evaporating capacity in the cooling operation), the high pressure (the low pressure in the cooling operation) of the air-conditioning system rises (lowers in the cooling operation) extremely causing troubles such as an excessive temperature rise (freezing in the cooling operation) of the heat exchanger of other indoor unit in the heating operation (the cooling operation) or damages to the compressor. Therefore, in the fifth embodiment, when the indoor units in the heating operation (the cooling operation) is to be stopped, the fourth valve opening degree controlling means 56 supplies an opening degree P which is an opening degree Pa just before the stop divided by a predetermined factor A (factor B in the cooling operation). While the operating state of the air-conditioning system is slightly too high in the high-pressure (slightly too low in the low-pressure in the cooling operation), other indoor units, the junction unit and the heat source unit carry out the diverging self-control into a stable operation while the time counting means 57 maintains the opening degree P for a predetermined period of time, thereby suppressing an excessively large change in operation. When the time counting means 57 counts the predetermined time, the fourth valve opening degree controlling means 56 outputs again a closing signal to the first flow rate controller 9 to bring the indoor unit into a halt.

Figure 13:
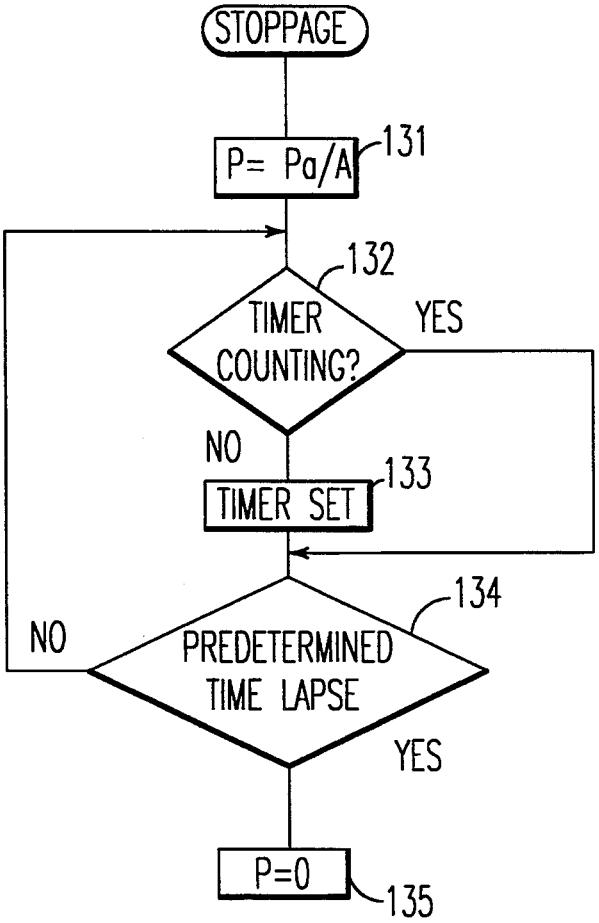
FIG. 13 is a flow chart illustrating the control of the valve opening degree of the first flow rate controller in the air-conditioning system of the fifth embodiment of the present invention.
Figure 14:
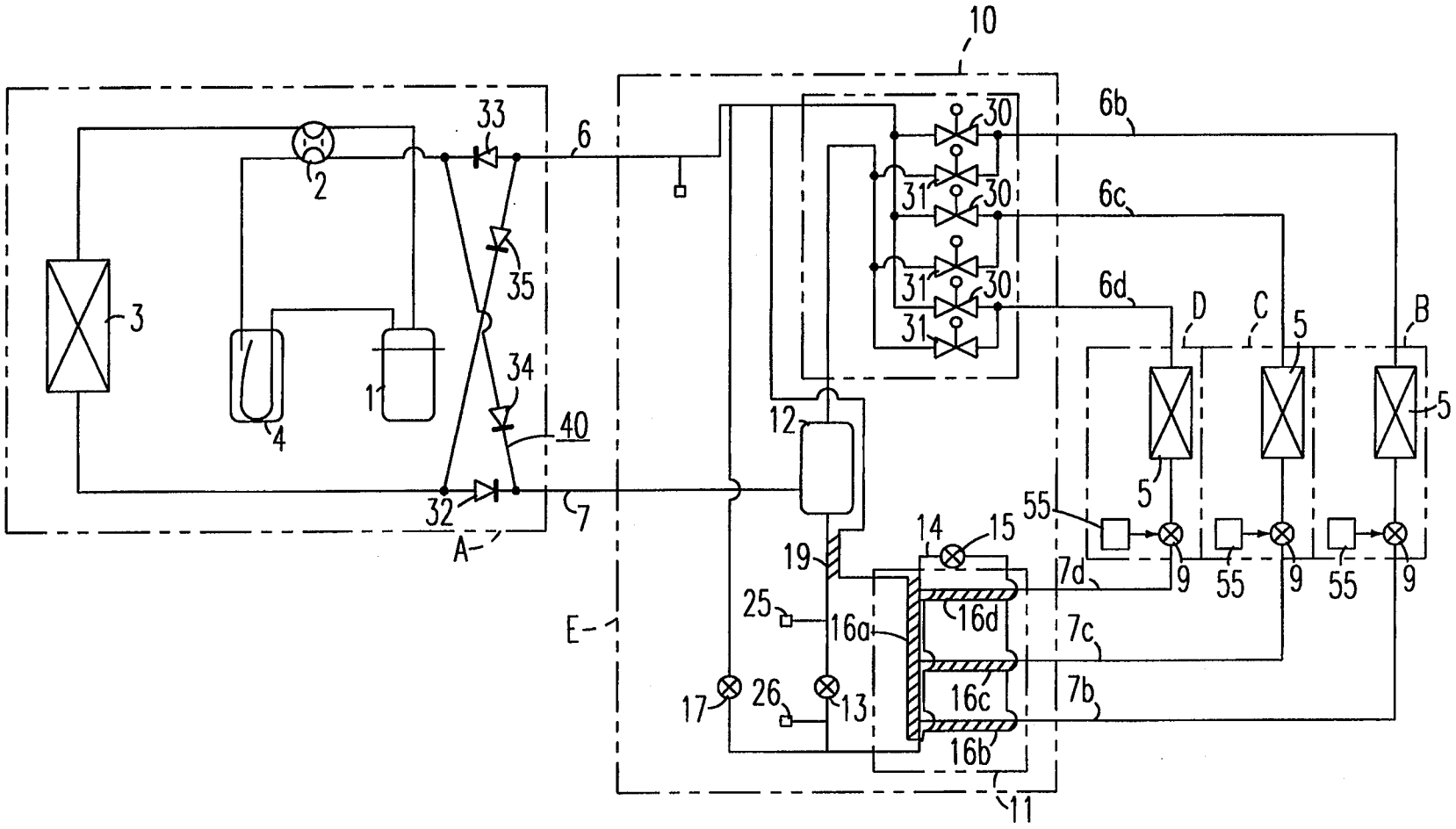
FIG. 14 is a schematic diagram generally illustrating the refrigerant lines of the air-conditioning system of the sixth embodiment of the present invention.

The control process of a fourth valve opening degree controlling means 56 of the first flow rate controller 9 in the above fifth embodiment will now be described in conjunction with a flow chart shown in FIG. 13.

When the indoor units in the heating operation (the cooling operation) comes to a halt, a step 131 supplies an output of the opening degree P which is the opening degree Pa immediately before the halt devided by a factor A to the first flow rate controller 9 and the process proceeds to a step 132. The step 132 determines if the time is being counted or not and, if not, the process proceeds to a step 133 to initiate time counting. The step 132 determines that the time is being counted, the process proceeds to a step 134. In the step 134, whether or not the counted time is predetermined time is determined and, if not, the step returns to the step 132. When the step 134 determines that the counted time reaches the predetermined time, the process proceeds to a step 135 to provide an output of the opening degree P=0.

Thus, according to the above-described fifth embodiment, a fourth valve opening degree controlling means 56 which provides, when an indoor unit of the plurality indoor units which had been operated is stopped, the first flow rate controller 9 with a valve opening degree which is a predetermined percentage of the valve opening degree immediately before the stopping of the indoor unit, and time counting means for counting a predetermined time during which the valve opening degree of the predetermined percentage is to be maintained. Therefore, an excessive increase of the high pressure (an excessive decrease of the low pressure in the cooling operation) due to an excessive reduction of the condensing capacity (the evaporating capacity in the cooling operation) when the indoor unit in the heating operation comes to a halt can be prevented and influences on other indoor units, the junction portion and the heat source unit can be suppressed, and the air-conditioning system, in which a plurality of indoor units carry out the selective cooling and heating operations and, alternatively, the concurrent cooling and heating operation is carried out with groups of the indoor units, can operate stably and continuously.

Sixth Embodiment

While, in the above fifth embodiment, the three-way valve 8 is provide for selectively connecting the indoor unit side first connection pipes 6b, 6c and 6d to the first connection pipe 6 or the second connection pipe 7, in the sixth embodiment, the switch valves such as two solenoid valves 30 and 31 are provided as illustrated in FIG. 6 for realizing the above-mentioned selective connection and obtaining similar advantageous results.

Seventh Embodiment

Figure 15:
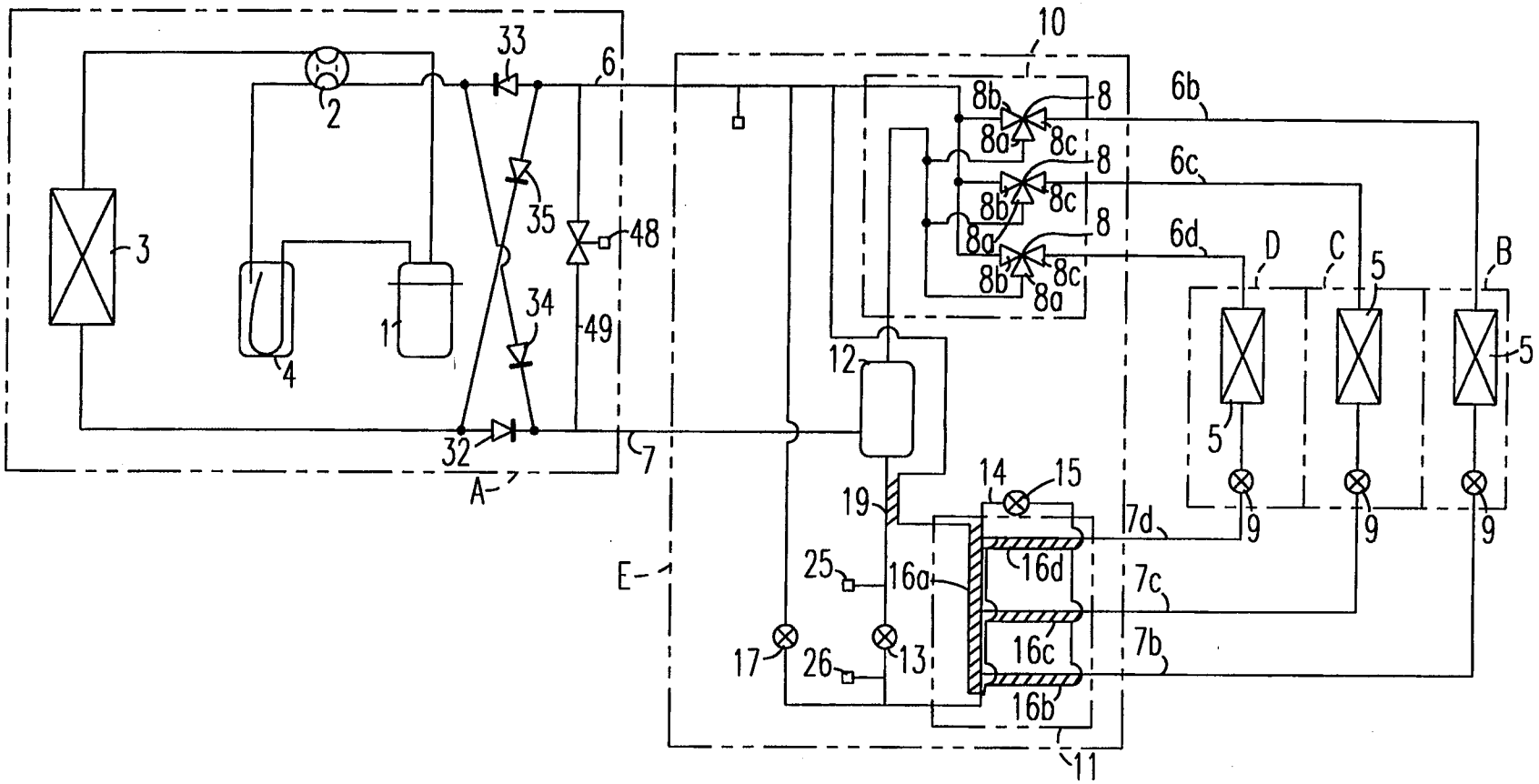
FIG. 15 is a schematic diagram generally illustrating the refrigerant lines of the air-conditioning system of the seventh embodiment of the present invention.
Figure 16:
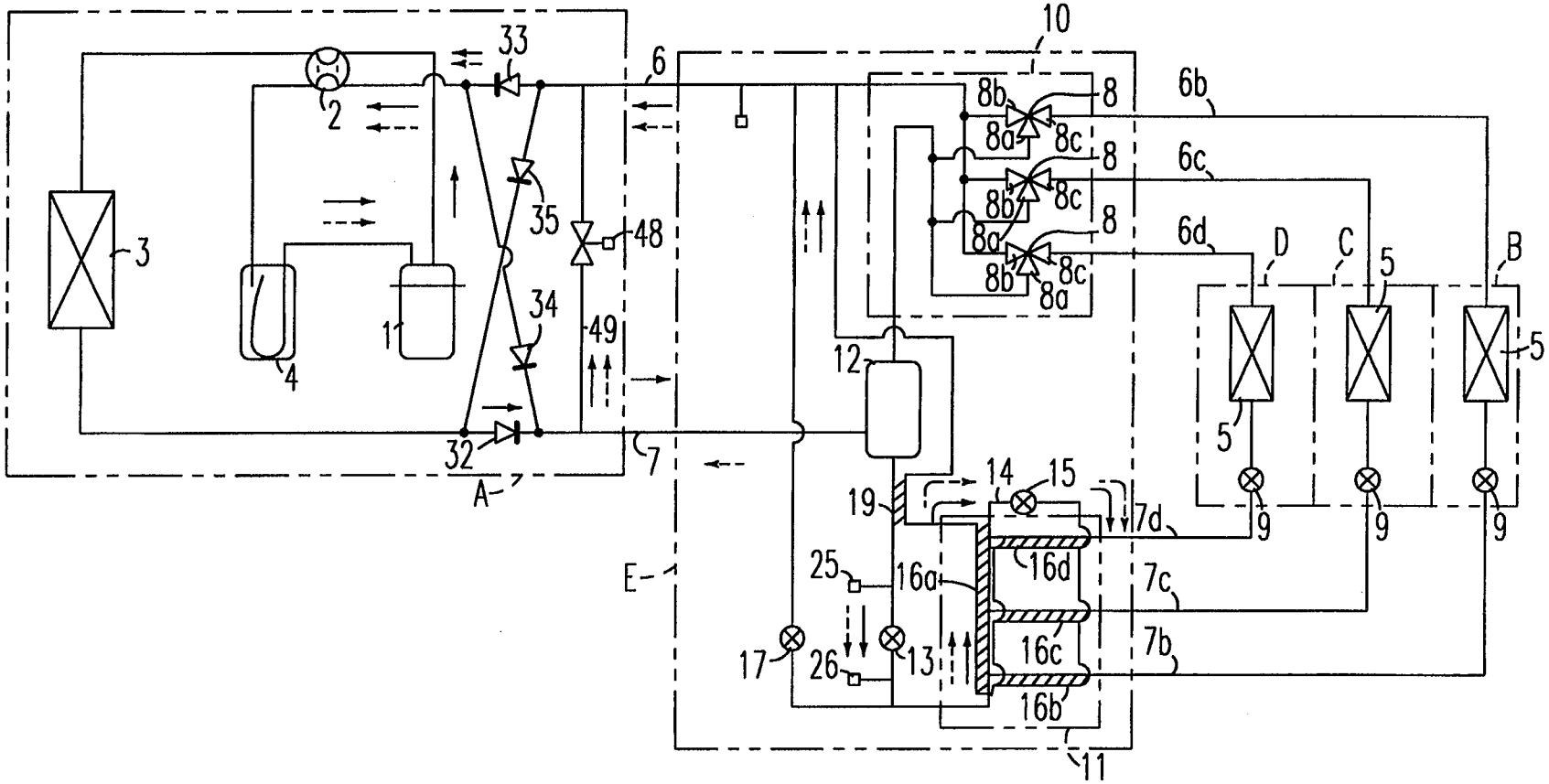
FIG. 16 is a refrigerant circuit diagram for explaining the defrosting operation state in the air-conditioning system of the seventh embodiment of the present invention.

FIG. 15 is a general schematic diagram illustrating the refrigerant lines of one embodiment of the air-conditioning system of the fifth invention of this application, and FIG. 16 is an operational state diagram illustrating the defrost operation.

In the figures, reference numeral 49 designates a first bypass circuit connected between the first connection pipe 6 and the second connection pipe 7, and 48 designates a sixth solenoid valve inserted into the pipe of the first bypass circuit 49 for closing and opening the first bypass circuit 49.

The cooling-only and the heating-only operations as well as the heating-dominant and the cooling-dominant operations in the seventh embodiment are, with the first bypass circuit 49 brought into a closed state by the sixth solenoid valve 48, similar to those of the previously described first embodiment.

The defrost operation will now be described on the basis of FIG. 16.

When the defrost operation is initiated, the second flow rate controller 13, the third flow rate controller 15 and the sixth solenoid valve 48, which are inserted into the first bypass circuit 49 connected between the second connection pipe 7 and the first connection pipe 6 or connected between the four-way valve 2 and the suction side of the compressor 1, are opened, so that major part of the high temperature, high pressure vapor refrigerant filled in the second connection pipe 7 immediately after the initiation of the defrost operation as illustrated by the dashed-line arrows in FIG. 16 flows to the low-pressure side through the first bypass circuit 49, the fourth check valve 33 and the four-way valve 2 to enter into the accumulator 4, and the slight remaining refrigerant is pressure-reduced to the low pressure through the vapor-liquid separator 12, the second flow rate controller 13 and the third flow rate controller 15 to flow into the accumulator 4 through the first connection pipe 6, the fourth check valve 33 and the four-way valve 2.

After the vapor refrigerant in the second connection pipe 7 has been drawn to the low-pressure side, the high temperature, high pressure refrigerant vapor 4 supplied from the compressor 1 as illustrated by the solid arrows flows through the four-way valve 2 and, after the refrigerant is heat-exchanged with frost at the heat source unit side heat exchanger 3 and condensed into liquid, the refrigerant flows through the third check valve 32 and the major portion thereof flows through the first bypass circuit 49 to be pressure-reduced to the low pressure, and the other small portion of the refrigerant flows through the second connection pipe 7 and the vapor-liquid separator 12 in the named order, pressure-reduced at the second flow rate controller 13 or the third flow rate controller 15 to the-low pressure and flows into the heat source unit through the first connection pipe 6. The refrigerant passed through the first bypass circuit 49 and the refrigerant passed through the junction unit E are combined at the inlet portion of the fourth check valve 33 and flows into the compressor 1 through the fourth check valve 33, the four-way valve 2 and the accumulator 4.

Since the circulation cycle is thus formed, the front formed on the heat source unit side heat exchanger 3 can be quickly and reliably melted by picking up heat of the refrigerant filled in the second connection pipe 7 before the initiation of the defrosting operation, the heat in the second connection pipe 7 itself, and the heat in the junction unit E. Also, the most of the high-temperature, high-pressure vapor refrigerant which is filled in the second connection pipe 7 immediately after the initiation of the defrost operation flows into the low-pressure side through the first bypass circuit 49, and since only small amount of the refrigerant flows through the second and the third flow rate controllers 13 and 15, the noise which is generated when the high-temperature, high-pressure vapor refrigerant flows through the second and the third flow rate controllers 13 and 15. However, the heat in the junction unit E can be sufficiently recovered. Also, since the most of the refrigerant condensed into liquid by heat-exchanging in relation to the frost in the heat source unit side heat exchanger 3 is pressure-reduced to the low pressure through the first bypass circuit 49, the amount of the refrigerant which is pressure-reduced to the low pressure in the second flow rate controller 13 or the third flow rate controller 15, and since the refrigerant which flows into the second and the third flow rate controller 13 and 15 is liquid because it is sufficiently cooled beforehand in the first and the second heat exchanging portions 19 and **16*a*, the noise generated by the refrigerant flowing through the second and the third flow rate controllers 13 and 15**.

During the defrosting operation, most of the refrigerant condensed and liquidified in the heat source unit side heat exchanger 3 flows through the first bypass circuit 49 but the remaining refrigerant flows through the bypass circuit 14 to which the third flow rate controller 15 is connected because it is in the open state to recover heat in the junction unit E, thereby to improve the defrosting capacity.

According to the seventh embodiment, the provision is made of the first bypass circuit 49 which is connected between the first connection pipe 6 and the second connection pipe 7 and which opens when during the defrosting operation, so that the heat of the refrigerant filled in the second connection pipe 7 immediately before the defrosting operation and the heat of the second connection pipe 7 itself can be recovered, thereby to quickly and reliably melt the frost formed on the heat source unit side heat exchanger 3.

Also, immediately after the initiation of the defrosting operation, the high-temperature and high-pressure vapor refrigerant filled in the second connection pipe 7 flows through the first bypass circuit 49 to the low-pressure side, so that there is no noise generated by the high-temperature and high-pressure vapor refrigerant in the junction unit E. Also, since the refrigerant condensed and liquidified by the heat-exchange in relation to the frost in the heat source unit side heat exchanger 3 is pressure-reduced to the low pressure through the first bypass circuit 49, no noise of the refrigerant is generated in the junction unit E, realizing the reduction of noise of the junction unit E during the defrosting operation.

Further, since a bypass pipe 14 connected at one end to the second junction portion 11 and at the other end to the first connection pipe 6 through the third flow rate controller 15 is provided for constituting the circuit including the third flow rate controller 15 during the defrosting operation, the heat in the junction unit E can be recovered and the defrost capacity is improved.

Eighth Embodiment

Figure 17:
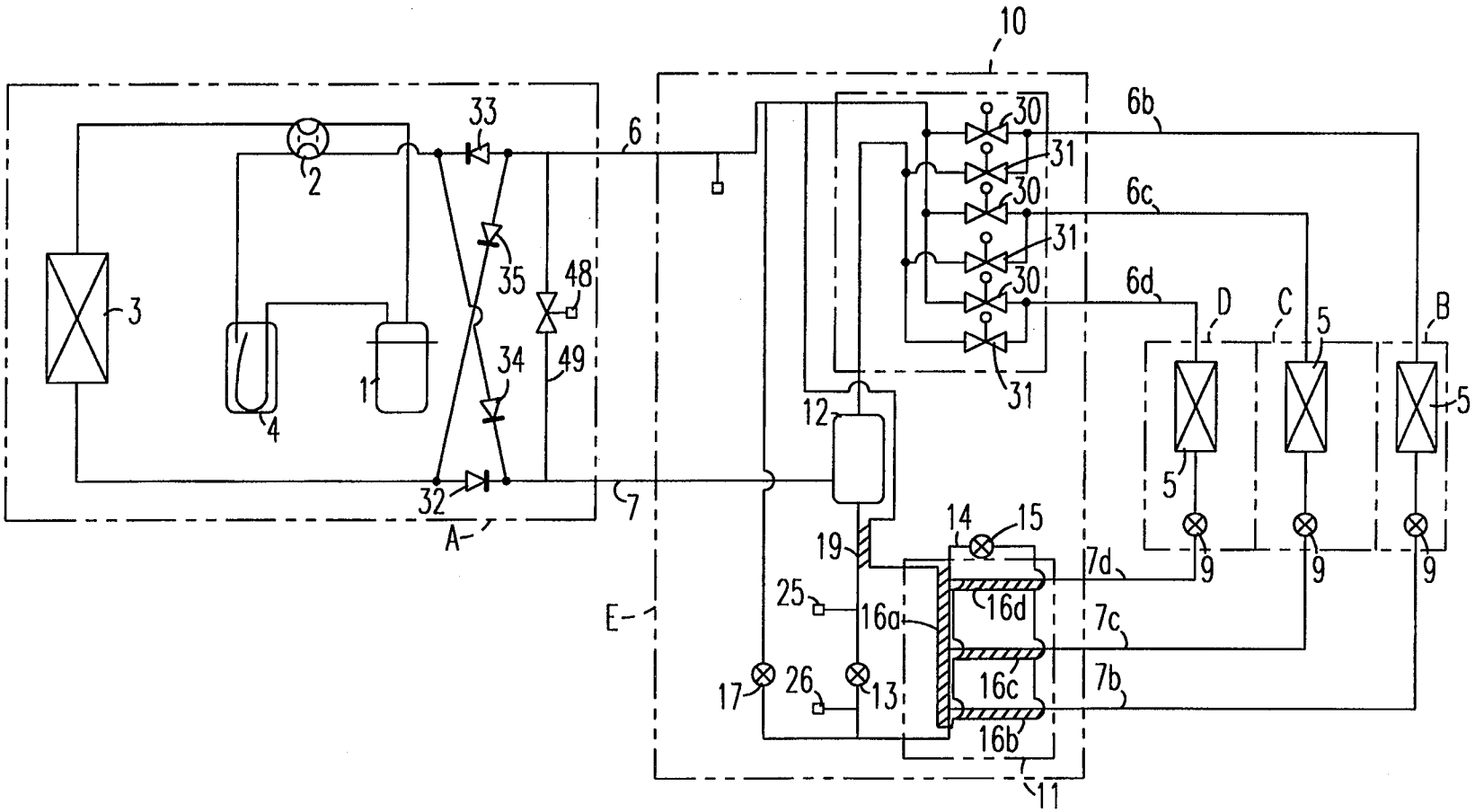
FIG. 17 is a schematic diagram generally illustrating the refrigerant lines of the air-conditioning system of the eighth embodiment of the present invention.

While the three-way valve 8 is provided for selectively connecting the indoor unit side first connection pipes 6*b*, 6*c* and 6*d* to the first connection pipe 6 or to the second connection pipe 7 in the above seventh embodiment, in this eighth embodiment, a change-over valve such as two solenoid valves 30 and 31 is in selective connection as illustrated in FIG. 17 and similar advantageous results can be obtained.

Ninth Embodiment

Figure 18:
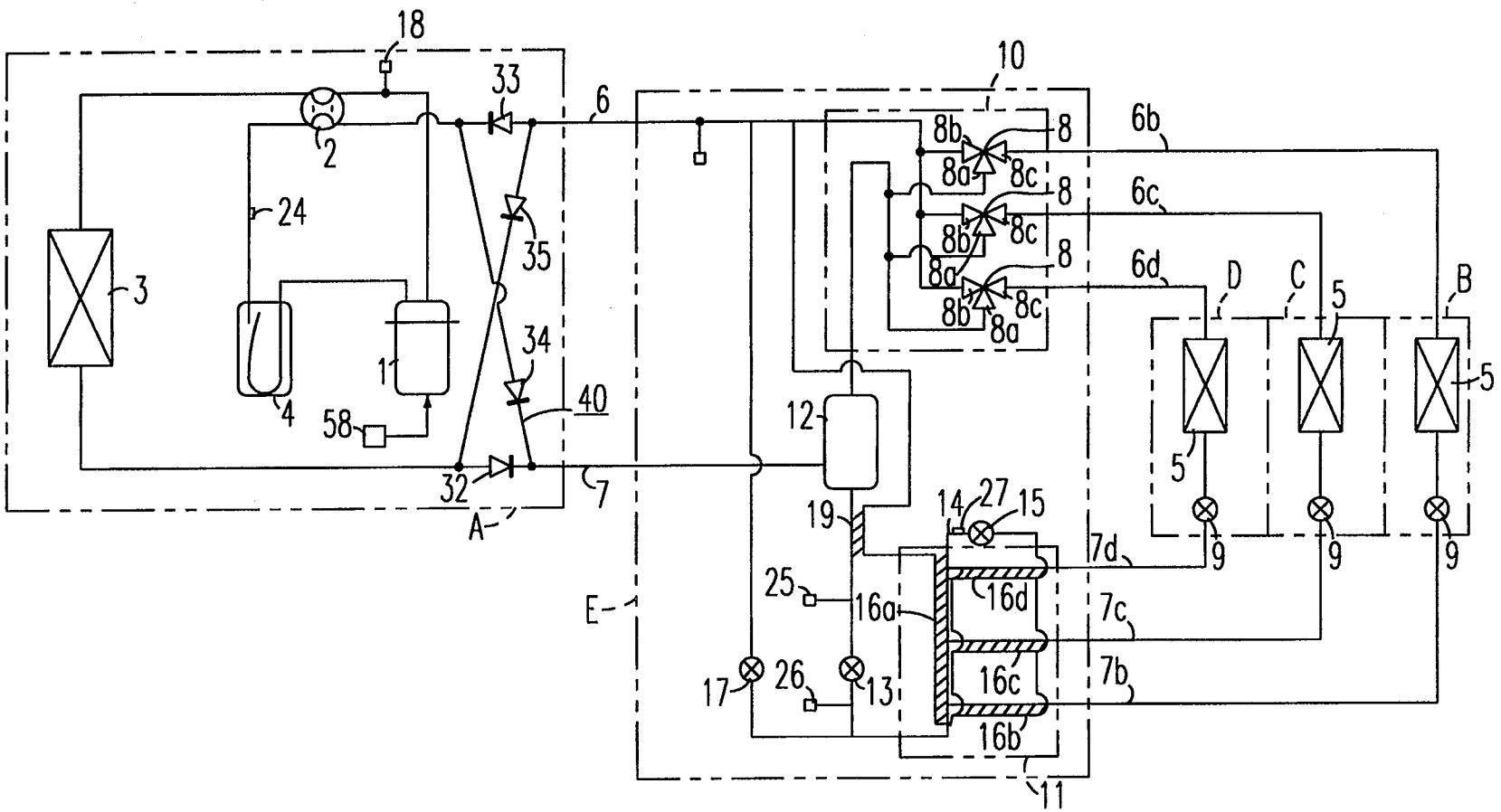
FIG. 18 is a schematic diagram generally illustrating the refrigerant lines of the air-conditioning system of the ninth embodiment of the present invention.
Figure 19:
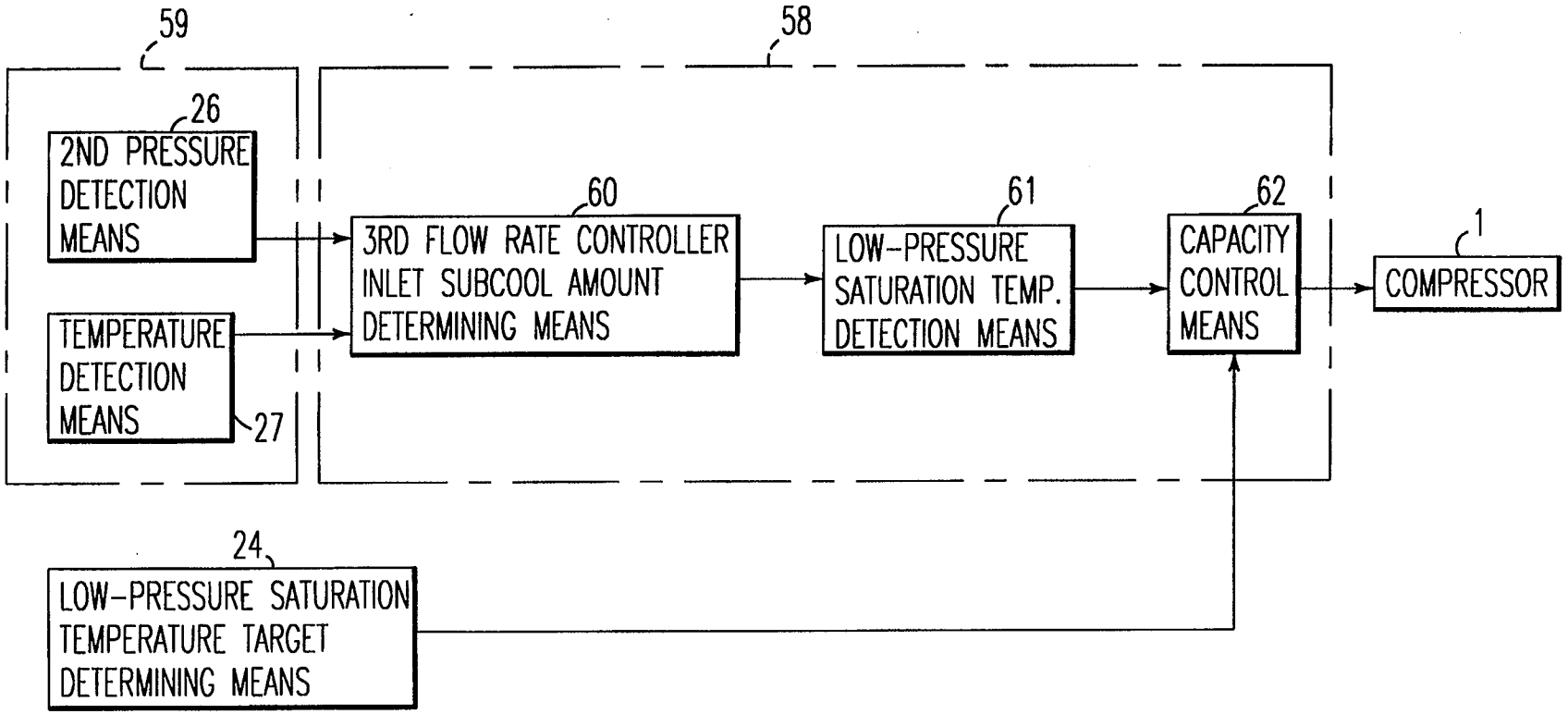
FIG. 19 is a block diagram illustrating the compressor capacity control system in the cooling-only and the cooling-dominant operations in the air-conditioning system of the ninth embodiment of the present invention.
Figure 20A:
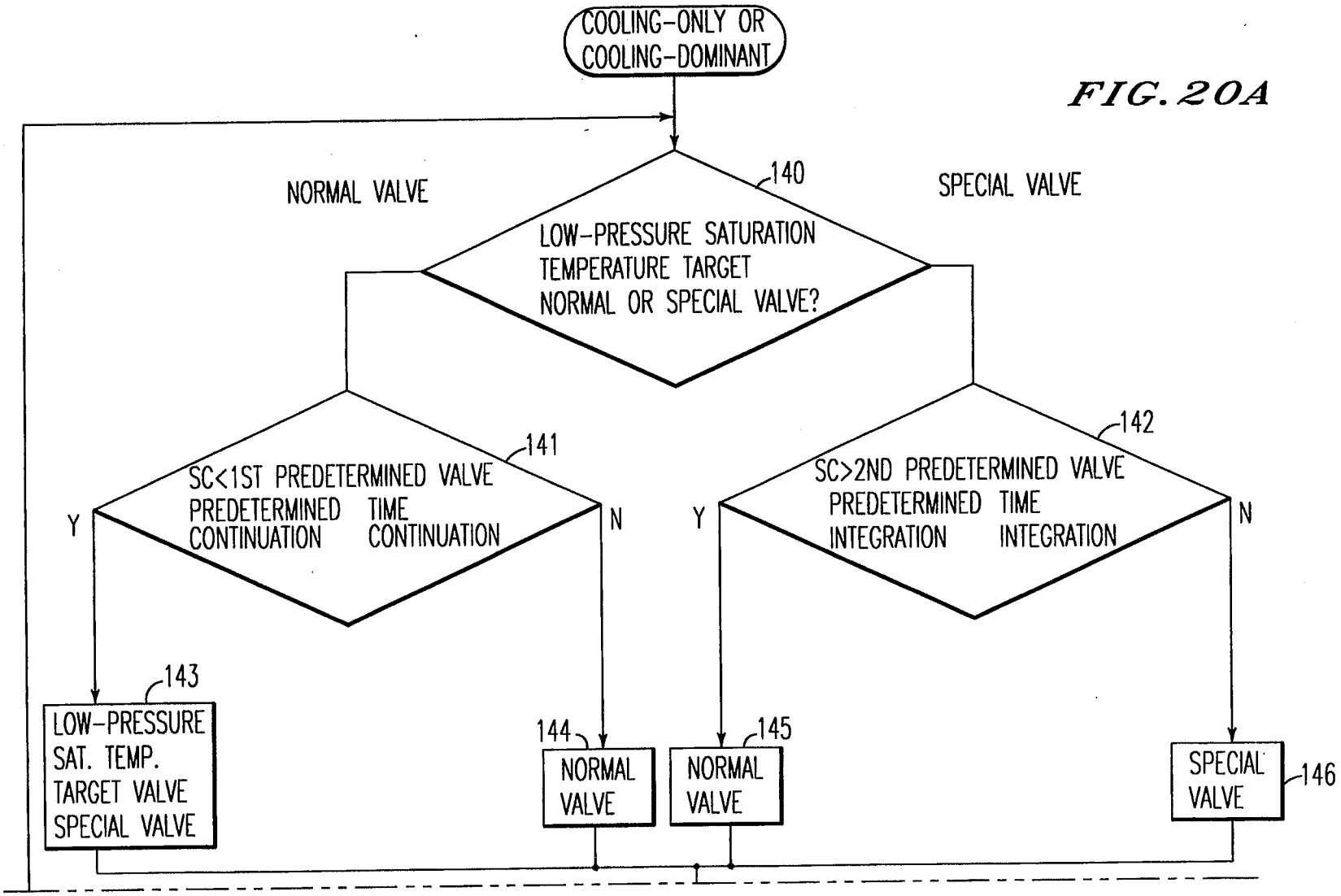
FIG. 20 is a flow chart illustrating the compressor capacity control flow in the cooling-only and the cooling-dominant operations in the air-conditioning system of the ninth embodiment of the present-invention.
Figure 20B:
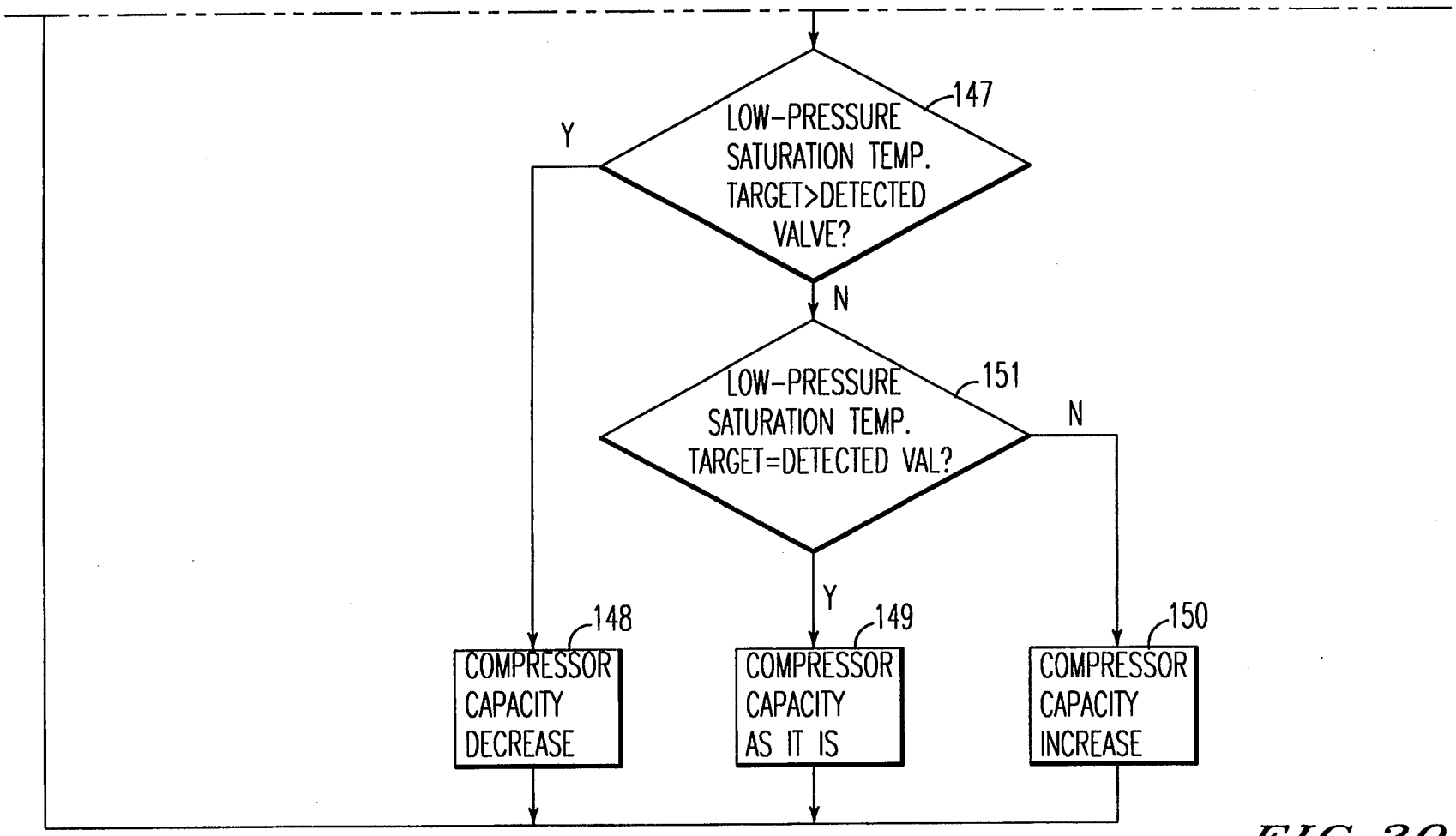

FIG. 18 is a general schematic diagram illustrating the refrigerant lines of one embodiment of the air-conditioning system of the sixth invention of this application, and FIGS. 19 and 20 are a block diagram and a flow chart illustrating compressor capacity control system during the cooling-only operation and the cooling-dominant operation, respectively.

In the figures, reference numeral 18 designates a fourth pressure detecting means inserted into a pipe which connects the compressor 1 and the four-way valve 2 and in always at a high pressure, 24 is a low-pressure, saturation temperature detecting means disposed in a pipe connected between the four-way valve 2 and the accumulator 4, 27 is a first temperature detecting means inserted into the bypass pipe 14 connected between the third flow rate controller 15 and the second heat exchanging portion 16*a*, which constitute a subcool amount detecting means 59 for detecting the subcool amount at the indoor unit inlet during the cooling operation from the second pressure detecting means 26 and the first temperature detecting means 27.

Reference numeral 58 designates a compressor capacity controlling means comprising a third flow rate controller inlet subcool amount determination means 60, a low-pressure saturation temperature target determination means 61 and a capacity controlling means 62.

The cooling-only and the heating-only operations as well as the heating-dominant and the cooling-dominant operations in the ninth embodiment are, similar to those of the previously described first embodiment except for the following operations.

In the heating-dominant operation during the concurrent heating and cooling operation, the compressor 1 supplies the high-temperature and high-pressure refrigerant vapor with the detected pressure at the fourth pressure detecting means 18 regulated to be at a predetermined value.

Also, in the cooling-dominant operation during the concurrent heating and cooling operation, the compressor 1 supplies the refrigerant vapor with the capacity controlled so that the detected temperature at the low-pressure saturation temperature detecting means 24 is at a predetermined value.

Next, the capacity control of the compressor 1 in the case of the cooling-only operation and the cooling-dominant operation in the concurrent cooling and heating operation will now be described in conjunction with FIGS. 19 and 20.

From the detected pressure of the second pressure detecting means 26 and the detected temperature of the first temperature detecting means 27, the third flow rate controller inlet subcool amount is determined as a sample value of the subcool amount at the inlet of the cooling indoor unit by the third flow rate controller inlet subcool amount determining means 60 in accordance with [subcool amount]=[saturation temperature of the detected pressure]−[detected temperature]. And, according to the subcool amount obtained, a low-pressure saturation temperature target value is determined as the capacity control target value by a low-pressure saturation temperature target value determining means 61 in this ninth embodiment, and the capacity control of the compressor 1 is achieved by the capacity control means 62 in response to the difference between the low-pressure saturation temperature target value and the detected temperature of the low-pressure saturation temperature detection means 24.

Step 140 judges whether the present low-pressure saturation temperature target value is a normal value or an abnormal value lower than the normal value, and the process proceeds to step 141 if it is a normal value and the process proceeds to step 142 if it is an abnormal value.

In step 141, when the condition that the above-described third flow rate controller inlet subcool amount SC (herein after referred to as SC) is smaller than the first predetermined value is maintained for a predetermined continuous period of time, the process proceeds to step 143 and, if such is not the case, the process proceeds to step 144.

In step 143, the low-pressure saturation temperature target value is made as an abnormal value equal to or lower than the low-pressure saturation temperature generated upon the decrease of the low-pressure due to the small SC, which abnormal value being lower than the normal value.

In step 144, the low-pressure saturation temperature target value is kept at the normal value.

In step 142, when the condition SC>the second predetermined value (which is set to be larger than the first predetermined value) is integrated for a period of time equal to or longer than a predetermined integration time, then the process proceeds to step 145 and, if such is not the case, the process proceeds to step 146.

In step 145, the low-pressure saturation temperature target value is set to be a normal value.

In step 146, the low-pressure saturation temperature target value is kept to be an abnormal value which is lower than the normal value.

After the low-pressure saturation temperature target value is determined as above described, it is compared with the detected temperature of the low-pressure saturation temperature detection means 24 in steps 147 and 151, and the process proceeds to step 148 if the target value>the detected value, to step 149 if the target value=the detected value, and to step 150 if the target value<the detected value.

In step 148, the compressor capacity is decreased by a predetermined amount.

In step 149, the compressor capacity is unchanged.

In step 150, the compressor capacity is increased by a predetermined amount.

Thus, according to the above ninth embodiment, the inlet subcool amount of the inlet of the third flow rate controller 15 is used as a sample value of the subcool amount at the inlet of the cooling indoor units to decrease, when the subcool amount is equal to or lower than the predetermined value, the low-pressure saturation temperature target value which is the capacity control target value for the compressor 1. Therefore, upon the initiation of cooling operation after a long period of halt, upon the switching from the heating operation to the cooling operation and upon the increase of the number of the indoor units in operation, the compressor capacity is controlled to increase rather than to decrease to ensure a sufficient amount of refrigeration circulation to improve the refrigerant shortage in the circuit even when the refrigerant is in the 2-phase state because of the refrigerant distribution amount shortage at the inlets of the cooling indoor unit first flow rate controller 9 and the third flow rate controller 15, which provides a high flow path resistance and a decrease in the low-pressure.

While an example of a multi-room heat pump type air conditioning system has been used in the above ninth embodiment, the present invention is of course equally applicable to heat pumps and coolers having a single outer unit for a single indoor unit.

Tenth Embodiment

Figure 21:
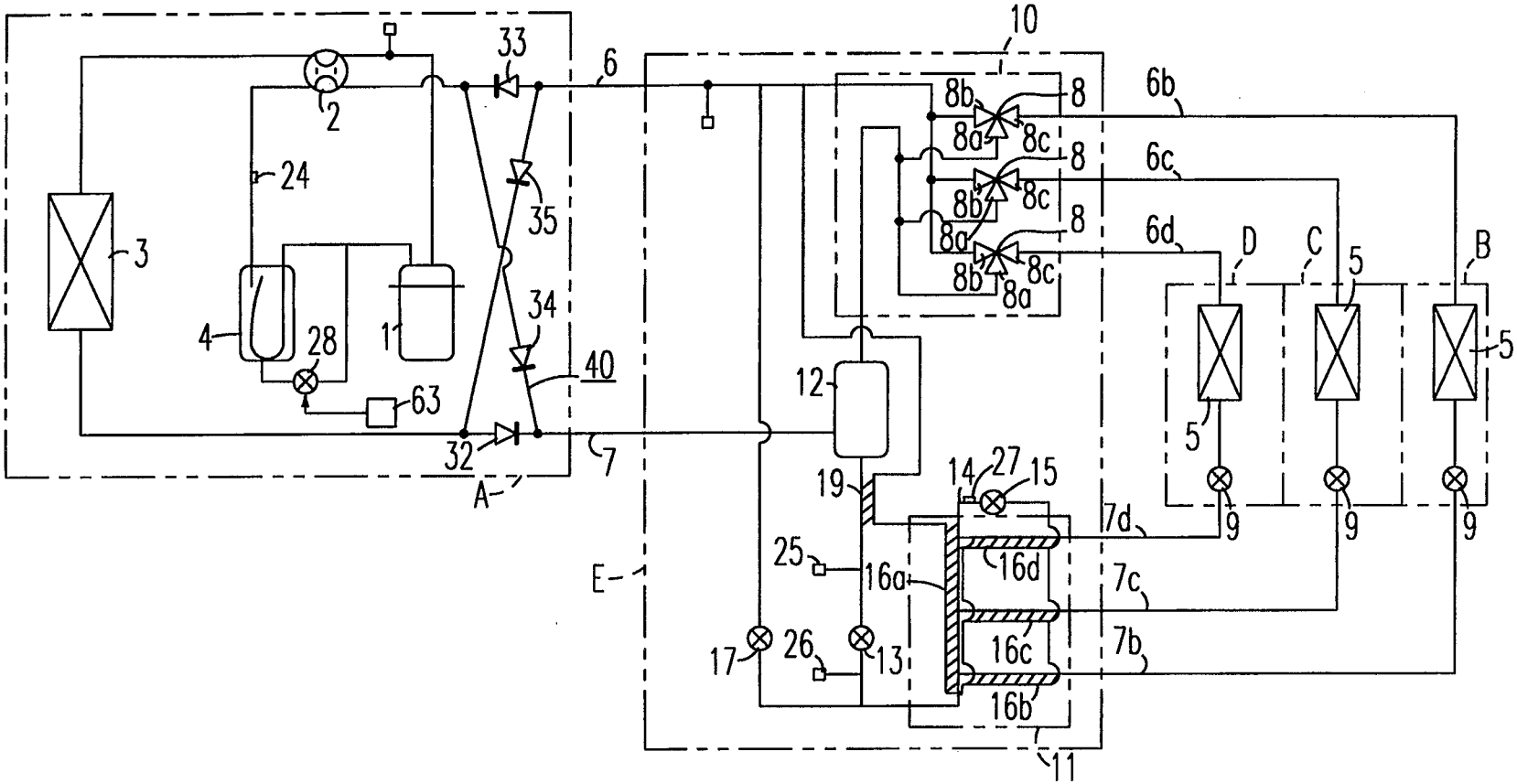
FIG. 21 is a schematic diagram generally illustrating the refrigerant lines of the air-conditioning system of the tenth embodiment of the present invention.

FIG. 21 is a general schematic diagram illustrating the refrigerant lines of one embodiment of the air-conditioning system of the seventh invention of this application.

In the figure, reference numeral 28 designates a fifth flow controller inserted into a pipe which connects the lower portion of the accumulator 4 and the outlet pipe of the accumulator 4, 63 designates a fifth valve opening degree control means for controlling the valve opening degree of the fifth flow rate controller 28 in response to the subcool amount detected by the indoor unit inlet side refrigerant subcool amount detecting means 59 composed of the second pressure detecting means and the first temperature detecting means 27.

The cooling-only and the heating-only operations as well as the heating-dominant and the cooling-dominant operations in the tenth embodiment are, similar to those of the previously described ninth embodiment.

Next, the opening degree control of the fifth flow rate controller 28 in the case of the cooling-only operation and the cooling-dominant operation in the concurrent cooling and heating operation will now be described in conjunction with FIGS. 22 and 23.

Figure 22:
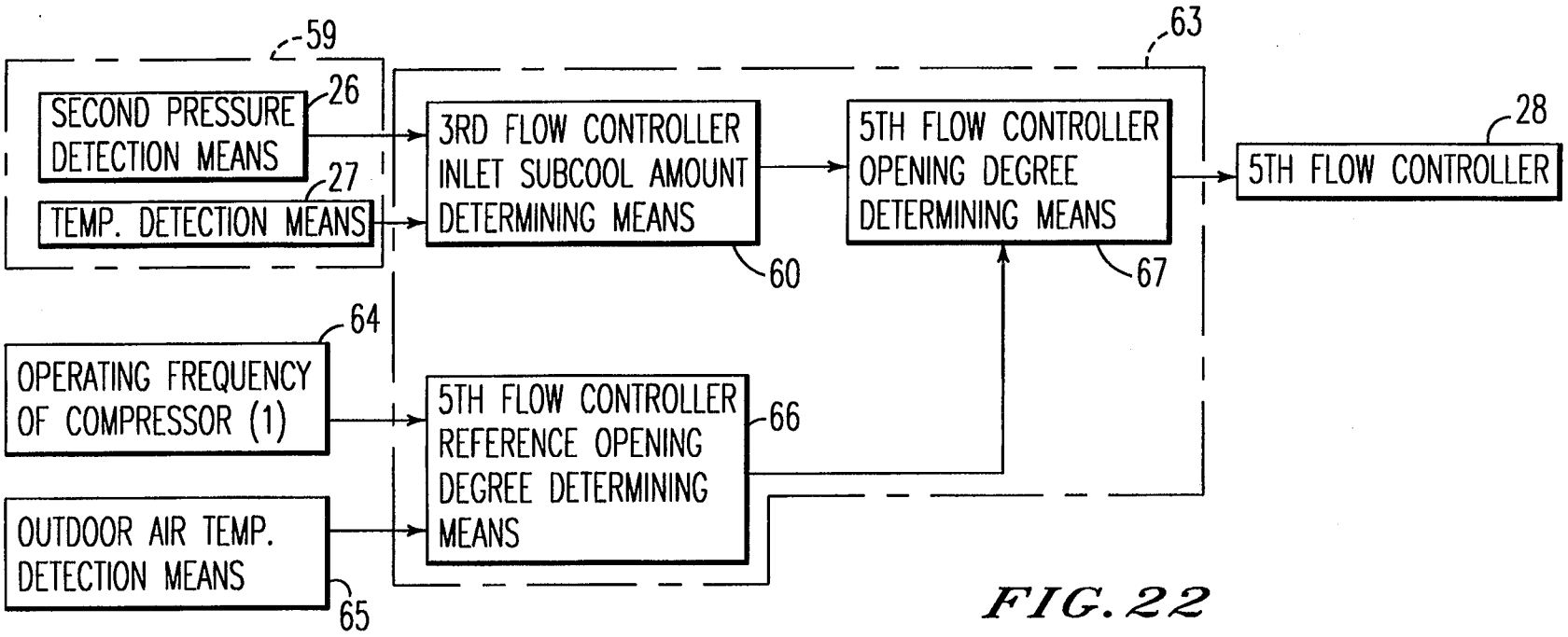
FIG. 22 is a block diagram illustrating the valve-opening degree of the fifth flow rate controller in the cooling-only and the cooling-dominant operations in the air-conditioning system of the tenth embodiment of the present invention.

FIG. 22 is a control block diagram.

The opening degree of the fifth flow controller 28 is ordinarily set to a predetermined opening degree by the fifth flow rate controller reference opening degree determining means 66 on the basis of the compressor operating frequency 64 and the detected temperature from the outdoor air temperature detecting means 65. In addition to this, from the detected pressure of the second pressure detecting means 26 and the detected temperature of the first temperature detecting means 27, the third flow rate controller inlet subcool amount is determined as a sample value of the subcool amount at the inlet of the cooling indoor unit by the third flow rate controller inlet subcool amount determining means 60 in accordance with [subcool amount]=[saturation temperature of the detected pressure]−[detected temperature]. And, determining whether the reference opening degree is to be used or the special opening degree which is larger than the reference opening degree is to be used by the fifth flow rate controller opening degree determining means 67 according to the subcool amount obtained, the fifth flow rate controller 28 is controlled in its opening degree.

Figure 23:
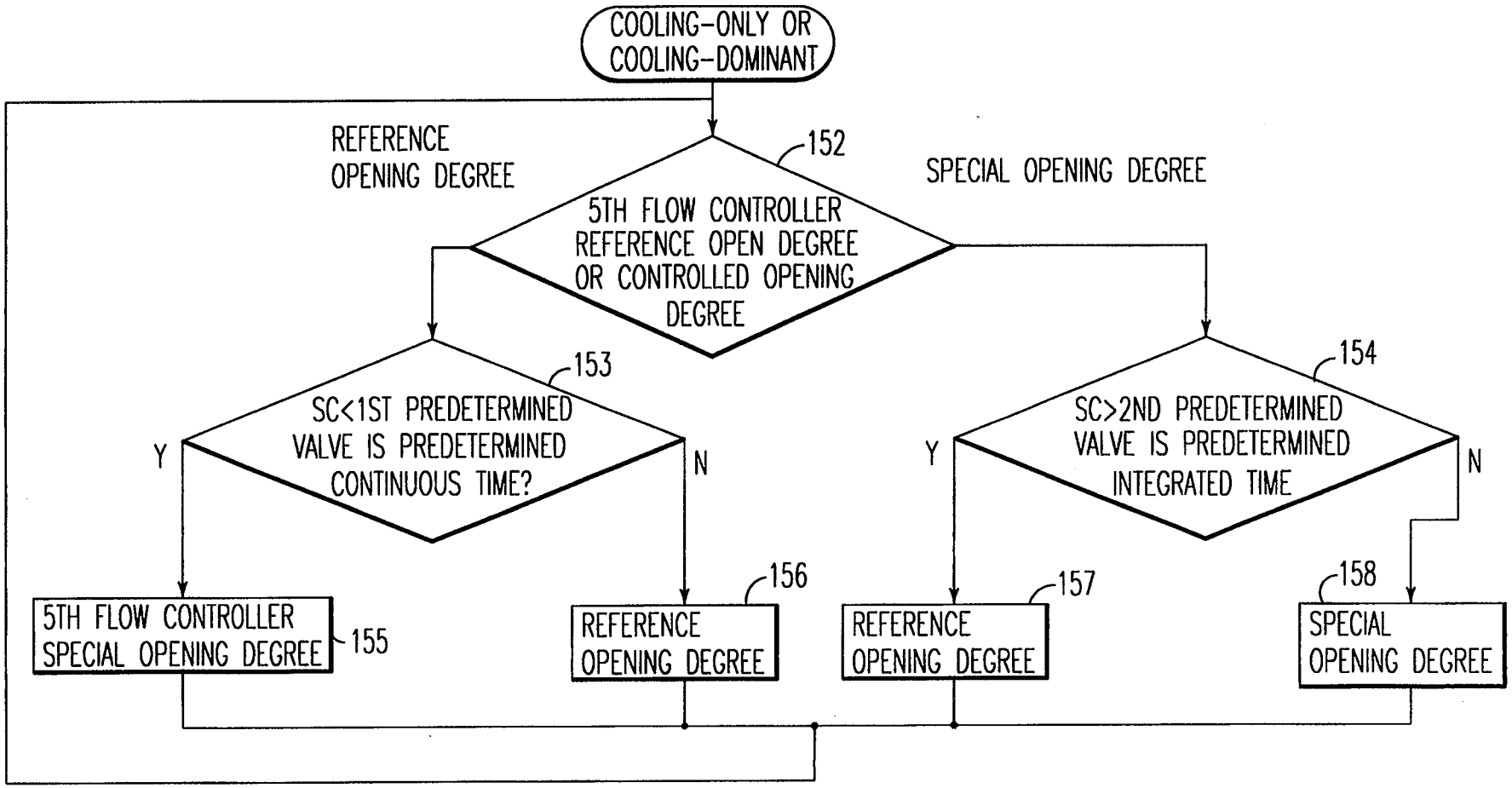
FIG. 23 is a flow chart illustrating the valve-opening degree of the fifth flow rate controller in the cooling-only and the cooling-dominant operations in the air-conditioning system of the tenth embodiment of the present invention.

FIG. 23 is a control flow chart.

Step 152 judges whether the present opening degree of the fifth flow rate controller 28 is a reference opening degree or a special opening degree, and the process proceeds to step 153 if it is a reference opening degree and the process proceeds to step 154 if it is a special value.

In step 153, when the condition that the above-described third flow rate controller inlet subcool amount SC (herein after referred to as SC) is smaller than the first predetermined value is maintained for a predetermined continuous period of time, the process proceeds to step 155 and, if such is not the case, the process proceeds to step 156.

In step 155, the opening degree of the fifth flow rate controller 28 is made the special opening degree.

In step 156, the opening degree of the fifth flow rate controller 28 is kept at the reference opening degree.

In step 154, when the condition SC>the second predetermined value (which is set to be larger than the first predetermined value) is integrated for a period of time equal to or longer than a predetermined integration time, then the process proceeds to step 157 and, if such is not the case, the process proceeds to step 158.

In step 157, the opening degree of the fifth flow rate controller 28 is the reference opening degree.

In step 158, the opening degree of the fifth flow rate controller 28 is the special opening degree.

Thus, according to the above tenth embodiment, the inlet subcool amount of the inlet of the third flow rate controller 15 is used as a sample value of the subcool amount at the inlet of the cooling indoor units to change, when the subcool amount is equal to or lower than the predetermined first value, the opening degree of the fifth flow rate controller 28 to a special opening degree which is larger than the reference opening degree. Therefore, upon the initiation of cooling operation after a long period of halt, upon the switching from the heating operation to the cooling operation and upon the increase of the number of the indoor units in operation, the liquid refrigerant staying in the accumulator 4 can be supplied to the compressor 1 to increase the refrigerant circulation to improve the refrigerant shortage in the refrigerant circuit even when the refrigerant is in the 2-phase state because of the refrigerant distribution amount shortage at the inlets of the cooling indoor unit first flow rate controller 9 and the third flow rate controller 15, which provides a high flow path resistance and a decrease in the low-pressure.

While an example of a multi-room heat pump type air conditioning system has been used in the above tenth embodiment, the present invention is of course equally applicable to heat pumps and coolers having a single outer unit for a single indoor unit.

Eleventh Embodiment

Figure 24:
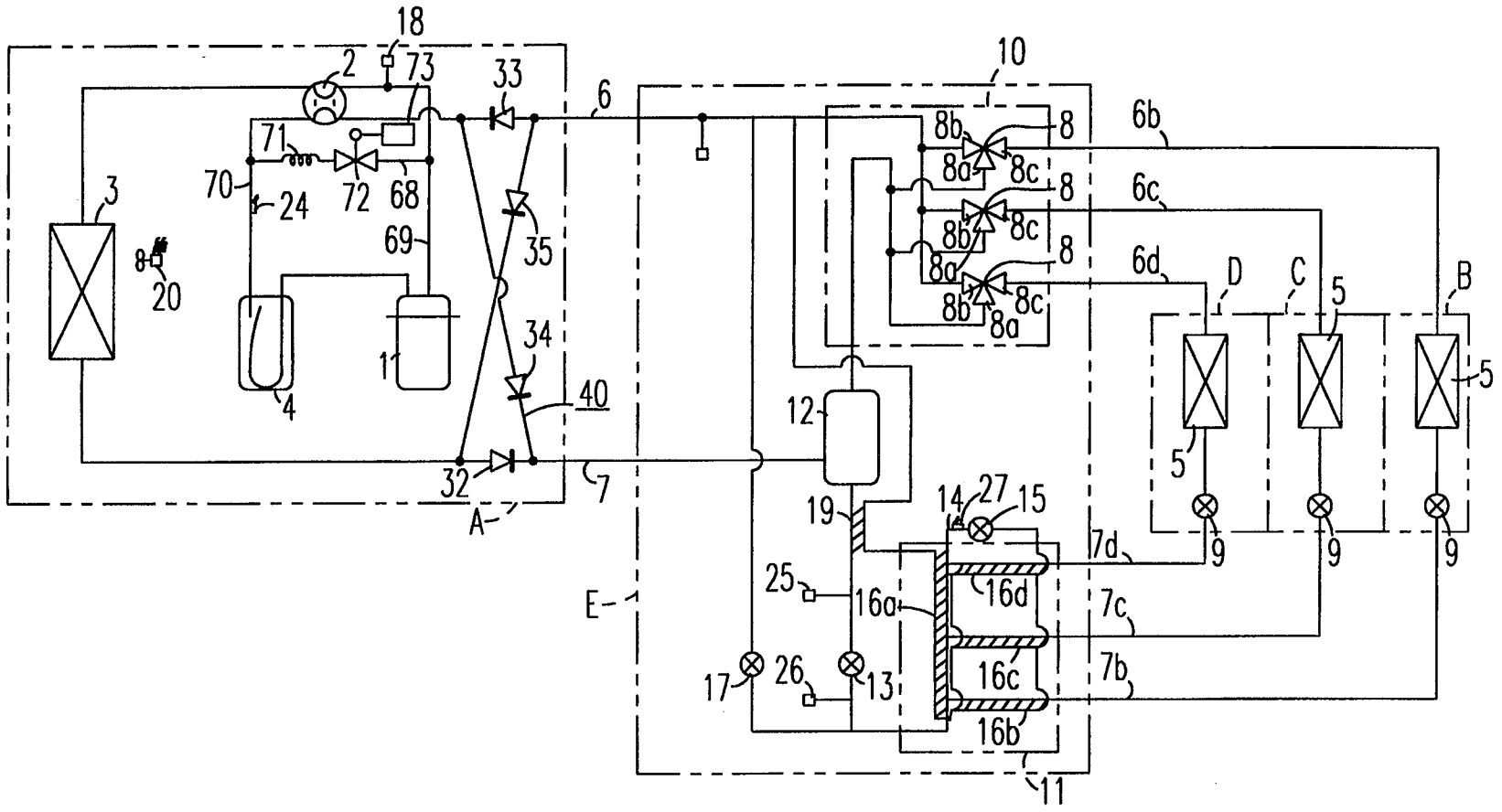
FIG. 24 is a schematic diagram generally illustrating the refrigerant lines of the air-conditioning system of the eleventh embodiment of the present invention.

FIG. 24 is a general schematic diagram illustrating the refrigerant lines of one embodiment of the air-conditioning system of the eighth invention of this application.

In the figure, reference numeral 20 designates a heat source unit side fan of a variable flow rate type, 68 is a second bypass circuit connected through a flow rate regulator 71 between a compressor outlet side high-pressure gas pipe 69 and the accumulator inlet pipe 70 between the four-way valve 2 and the accumulator 4, 72 is a valve for the second bypass circuit 68, 73 is a sixth valve opening degree control means for controlling the valve opening degree of the valve 72 in the second bypass circuit 68 in accordance with the cooling operation indoor unit inlet subcool amount detected by the subcool amount detection means 59 composed of the second pressure detecting means 26 and the first temperature detecting means 27, the sixth valve opening degree control means 73 comprising the third flow rate controller inlet subcool amount determining means 60 and a valve open/close control means 74 for the valve 72 in the second bypass circuit 68.

Next, the operation of the above eleventh embodiment will be described.

The cooling-only and the heating-only operations as well as the heating-dominant and the cooling-dominant operations in the eleventh embodiment are, similar to those of the previously described ninth embodiment except for the following operations.

The operation that is different from the above ninth embodiment is that the refrigerant flowing into the heat source unit side heat exchanger 3 is heat-exchanged in relation to the air supplied from the heat source unit side fan 20 of the flow rate variable type to be condensed into liquid or evaporated into vapor.

Next, the control operation of the valve 72 in the second bypass circuit 68 in the case of the cooling-only operation and the cooling-dominant operation in the concurrent cooling and heating operation will now be described in conjunction with FIGS. 25 and 26.

Figure 25:
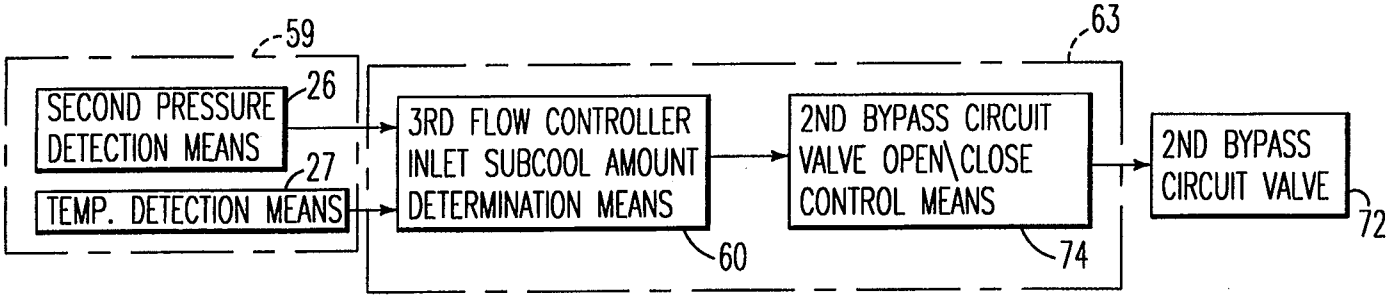
FIG. 25 is a block diagram illustrating the control of the valve of the second bypass circuit in the cooling-only and the cooling-dominant operations in the air-conditioning system of the eleventh embodiment of the present invention.

FIG. 25 is a control block diagram.

From the detected pressure of the second pressure detecting means 26 and the detected temperature of the first temperature detecting means 27, the third flow rate controller inlet subcool amount is determined as a sample value of the subcool amount at the inlet of the cooling indoor unit by the third flow rate controller inlet subcool amount determining means 60 in accordance with [subcool amount]=[saturation temperature of the detected pressure]−[detected temperature].

And, according to the subcool amount obtained, the valve 72 in the second bypass circuit 68 is controlled by the second bypass circuit valve control means 74 for the valve 72 in the second bypass circuit 68. At this time, the flow rate of the refrigerant flowing through the the second bypass circuit 68 is regulated by the flow rate regulator 71 to prevent the return of an excessive amount of the refrigerant to the accumulator 4.

Figure 26:
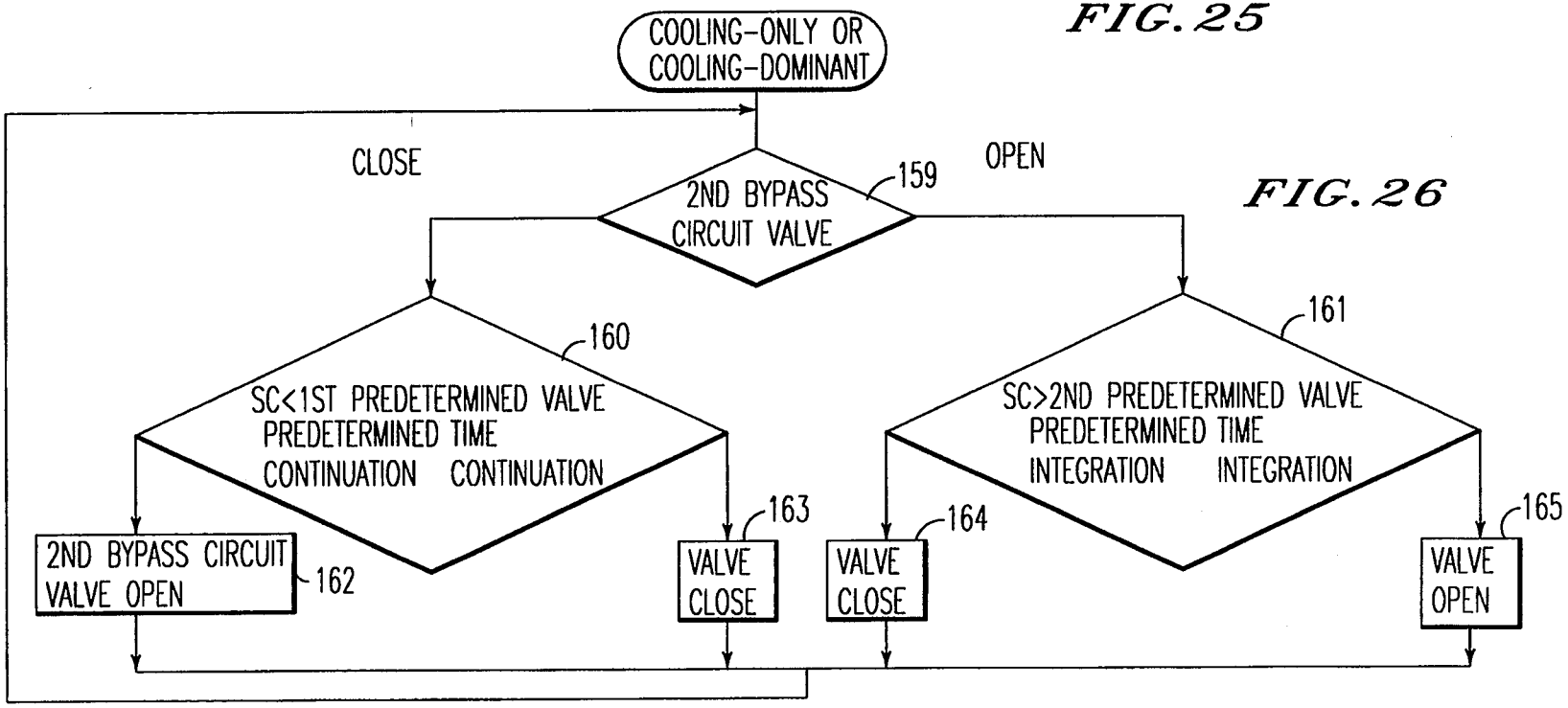
FIG. 26 is a flow chart illustrating the control of the valve of the second bypass circuit in the cooling-only and the cooling-dominant operations in the air-conditioning system of the eleventh embodiment of the present invention.

FIG. 26 is a control flow chart.

Step 159 judges whether the opening valve 72 of the second bypass circuit 68 is in the closed state or in the open state, and the process proceeds to step 160 if it is in the closed state and the process proceeds to step 161 if it is in the open state.

In step 160, when the condition that the above-described third flow rate controller inlet subcool amount SC (herein after referred to as SC) is smaller than the first predetermined value is maintained for a predetermined continuous period of time, the process proceeds to step 162 and, if such is not the case, the process proceeds to step 163.

In step 162, the valve 72 of the second bypass circuit 68 is opened.

In step 163, the valve 72 of the second bypass circuit 68 is kept closed.

In step 161, when the condition SC>the second predetermined value (which is set to be larger than the first predetermined value) is integrated for a period of time equal to or longer than a predetermined integration time, then the process proceeds to step 164 and, if such is not the case, the process proceeds to step 165.

In step 164, the valve 72 of the second bypass circuit 68 is closed.

In step 165, the valve 72 of the second bypass circuit 68 is kept open.

Thus, according to the above eleventh embodiment, the inlet subcool amount of the inlet of the third flow rate controller 15 is used as a sample value of the subcool amount at the inlet of the cooling indoor units to open, when the subcool amount is equal to or lower than the predetermined value, the valve 72 of the second bypass circuit 68. Therefore, upon the initiation of cooling operation after a long period of halt, upon the switching from the heating operation to the cooling operation and upon the increase of the number of the indoor units in operation, the high-pressure vapor is bypassed to the low-pressure side to increase the low-pressure side pressure and the liquid refrigerant staying in the accumulator 4 is evaporated by the high-pressure vapor to increase the refrigeration circulation to improve the refrigerant shortage in the circuit even when the refrigerant is in the 2-phase state because of the refrigerant distribution amount shortage at the inlets of the cooling indoor unit first flow rate controller 9 and the third flow rate controller 15, which provides a high flow path resistance and a decrease in the low-pressure.

While an example of a multi-room heat pump type air conditioning system has been used in the above eleventh embodiment, the present invention is of course equally applicable to heat pumps and coolers having a single outer unit for a single indoor unit.

Twelfth Embodiment

Figure 27:
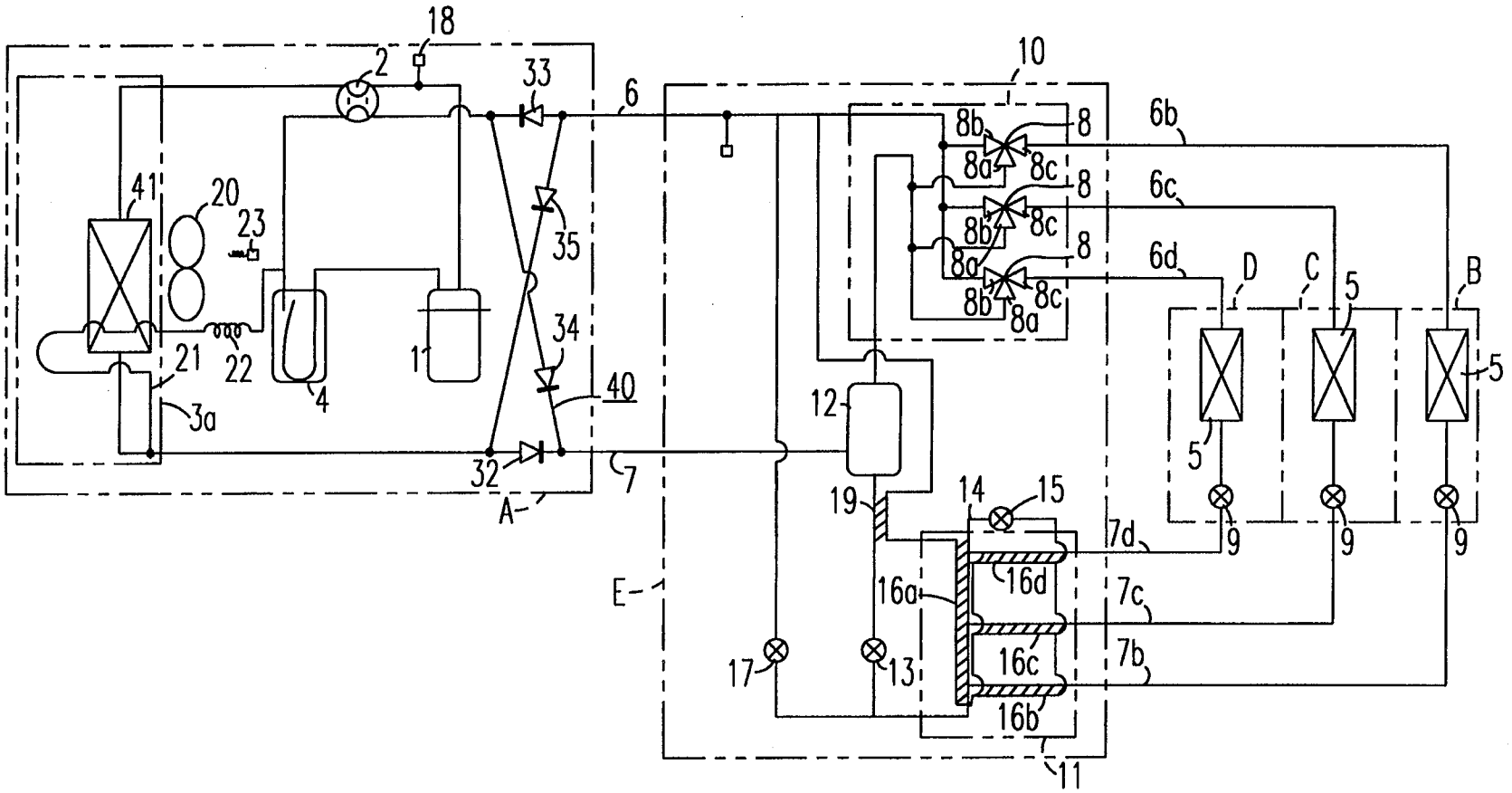
FIG. 27 is a schematic diagram generally illustrating the refrigerant lines of the air-conditioning system of the twelfth embodiment of the present invention.

FIG. 27 is a general schematic diagram illustrating the refrigerant lines of -one embodiment of the air-conditioning system of the ninth invention of the present application.

In the figure, reference numeral 21 designates a takeoff pipe connected at its one end to the liquid side outlet portion of the heat source unit side heat exchanger 41 and at the other end to the inlet of the accumulator 4 and extending through the fin portions of the heat source unit side heat exchanger 41, 22 is a throttle means disposed in the takeoff pipe 21, and 23 is a second temperature detection means disposed between the throttle 22 and the inlet side connection portion of the accumulator 4 of the takeoff pipe 21.

The cooling-only and the heating-only operations as well as the heating-dominant and the cooling-dominant operations in the twelfth embodiment are, similar to those of the previously described eleventh embodiment except for the following operations.

In the cooling-only operation and the cooling-dominant operation, the compressor 1 is capacity controlled to supply a high-temperature and high-pressure refrigerant gas so that the detected temperature at the second temperature detection means 23 is at the predetermined value. One portion of the gas-liquid two phase refrigerant flowing from the liquid side outlet pipe of the heat source unit side heat exchanger 41 is flowed through the takeoff pipe 21, and is heat-exchanged in relation to the air supplied from the heat source unit side fan 20 into liquid refrigerant while passing through the takeoff pipe 21 intersecting with the fins of the heat source unit side heat exchanger 41 to flow into the throttle 22 where it is pressure-reduced to the low-pressure and flows into the accumulator 4.

In the heating-only operation and the heating-dominant operation, the compressor 1 is capacity controlled to supply a high-temperature and high-pressure refrigerant gas so that the detected pressure at-the fourth pressure detection means 18 is at a predetermined value.

Thus, according to the twelfth embodiment, the provision is made of a takeoff pipe 21 connected at one end thereof to a liquid outlet side pipe of said heat source unit side heat exchanger 41 and at the other end thereof to an inlet pipe of said accumulator 4 through a throttle device 22, the takeoff pipe 21 extending through cooling fins of the heat source unit side heat exchanger 41, and a second temperature detector means 23 disposed in the takeoff pipe 21 between the throttle device 22 and the inlet pipe of the accumulator 4. Therefore, the refrigerant flowing through the takeoff pipe 21 is condensed into liquid refrigerant when it flows through the takeoff pipe 21 portion which intersects with the fins of the heat source unit side heat exchanger 41, pressure-reduced to the low-pressure by the throttle device 22, whereby the second temperature detection means 23 is assured to always stably detect the low-pressure side saturation refrigeration temperature.

Thirteenth Embodiment

Figure 28:
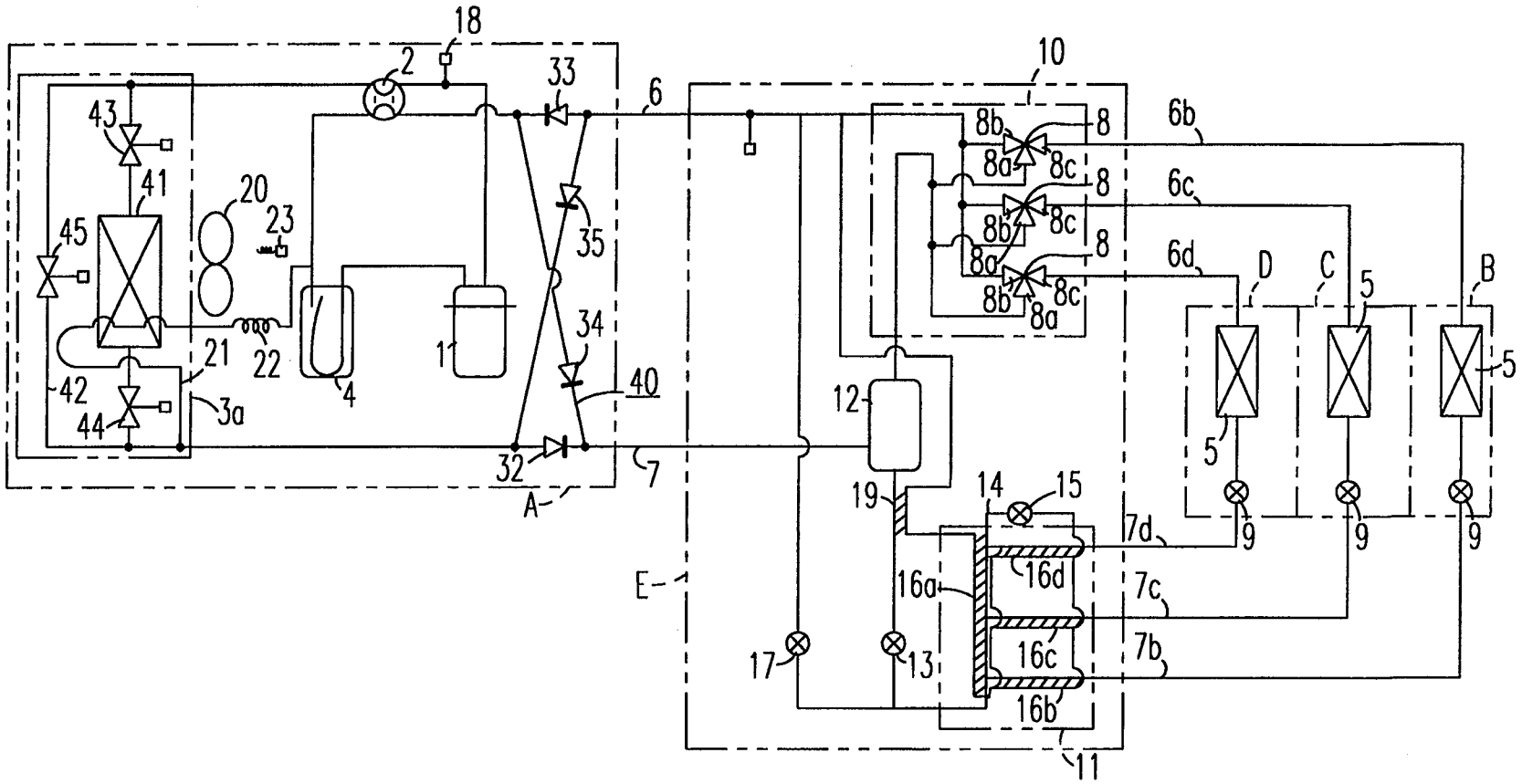
FIG. 28 is a schematic diagram generally illustrating the refrigerant lines of the air-conditioning system of the thirteenth embodiment of the present invention.

FIG. 28 is a general schematic diagram illustrating the refrigerant lines of another embodiment of the air-conditioning system of the tenth invention of this application. In this thirteenth embodiment, a heat source unit side heat exchanging portion 3*a* is composed of the heat source unit side heat exchanger 41, the heat source unit side bypass pipe 42 for bypassing the heat exchanger 41, the first and second solenoid valve 43 and 44 disposed at the refrigerant inlet and outlet portions of the heat source unit side heat exchanger 41 and the third solenoid valve 45 inserted into the bypass pipe 42.

Next, the control of the heat source unit side fan 20, the first, the second and the third solenoid valves 43, 44 and 45 in the cooling-dominant operation will now be described. In the thirteenth embodiment, the heat source unit side heat exchanging portion 3*a* is composed of the heat source unit side heat exchanger 41, the heat source unit side bypass pipe 42 and the first, the second and the third solenoid valves 43, 44 and 45, and the capacity of the heat source unit side heat exchanger is adjustable in three levels in order to obtain a large heat source unit side heat changer capacity when the indoor cooling load is heavy, to obtain a small heat source unit side heat exchanger capacity when the indoor cooling load is small and to make the heat source unit side heat exchanger capacity unnecessary when the indoor cooling load and the heating load are equal to each other.

The first level corresponds to the case where the largest heat source unit side heat exchanger capacity is required, in which the first and the second solenoid valves 43 and 44 are opened and the third solenoid valve 45 is closed, thereby to flow the refrigerant to the heat source unit side heat exchanger 41, and no refrigerant is allowed to flow through the heat source unit side bypass path 42, and the flow rate adjusting range of the heat source unit side fan 20 is set to be from the fan full-speed operation to a predetermined minimum amount, so that, even when the ambient temperature of the heat source unit A is high and the refrigerant flowing into the takeoff pipe 21 is evaporated to become the vapor refrigerant, since the takeoff pipe 21 intersects the fin portions of the heat source unit side heat exchanger 41, the refrigerant is heat-exchanged with the air, the condensed liquid refrigerant may be flowed into the throttle device 22 to reduce its pressure to the low-pressure, whereby the second temperature detector 23 can detects the low-pressure saturation temperature.

The second level corresponds to the case where the next-largest heat source unit side heat-exchanging capacity is required, the first, second and third solenoid valves 43, 44 and 45 are opened to flow the refrigerant to the heat source unit side heat exchanger 41 as well as the heat source unit side bypass path 42 to regulate the air quantity of the heat source unit side fan 20. At this time, the air quantity regulating ranges from the fan full speed operation to the predetermined minimum air quantity, so that, even when the condensed liquid refrigerant from the heat source unit side heat exchanger 41 and the gas refrigerant flowing through the heat source unit side bypass path are mixed to become the vapor-liquid 2 phase refrigerant which flows into the takeoff pipe 21, the takeoff pipe 21 which intersects with the fin portion of the heat source unit side heat exchanger 41 for heat-exchanging between the refrigeration and the air can cause the refrigerant to be condensed into liquid and flowed into the throttle device 22 to pressure-decrease to the low-pressure, ensuring that the low-pressure saturation temperature can be detected by the second temperature detector 23.

The third level corresponds to the case where the smallest heat source unit side heat exchanger capacity is required, in which the first and the second solenoid valves 43 and 44 are closed and the third solenoid valve 45 is opened, thereby to flow the refrigerant to the heat source unit side bypass path 42 and no refrigerant is allowed to flow through the heat source unit side heat exchanger 41 so that the amount of heat exchange in the heat source unit side heat exchanging portion 3 is zero. At this time, the air quantity of the heat source unit side fan 20 is the predetermined minimum quantity, so that, even when the gas refrigerant flowing through the heat source unit side bypass path 42 flows into the takeoff pipe 21, since the takeoff pipe 21 intersects the fin portions of the heat source unit side heat exchanger 41, the refrigerant is heat-exchanged with the air, the condensed liquid refrigerant may be flowed into the throttle device 22 to reduce its pressure to the low-pressure, whereby the low-pressure saturation temperature can be detected by the second temperature detector 23.

Figure 29A:
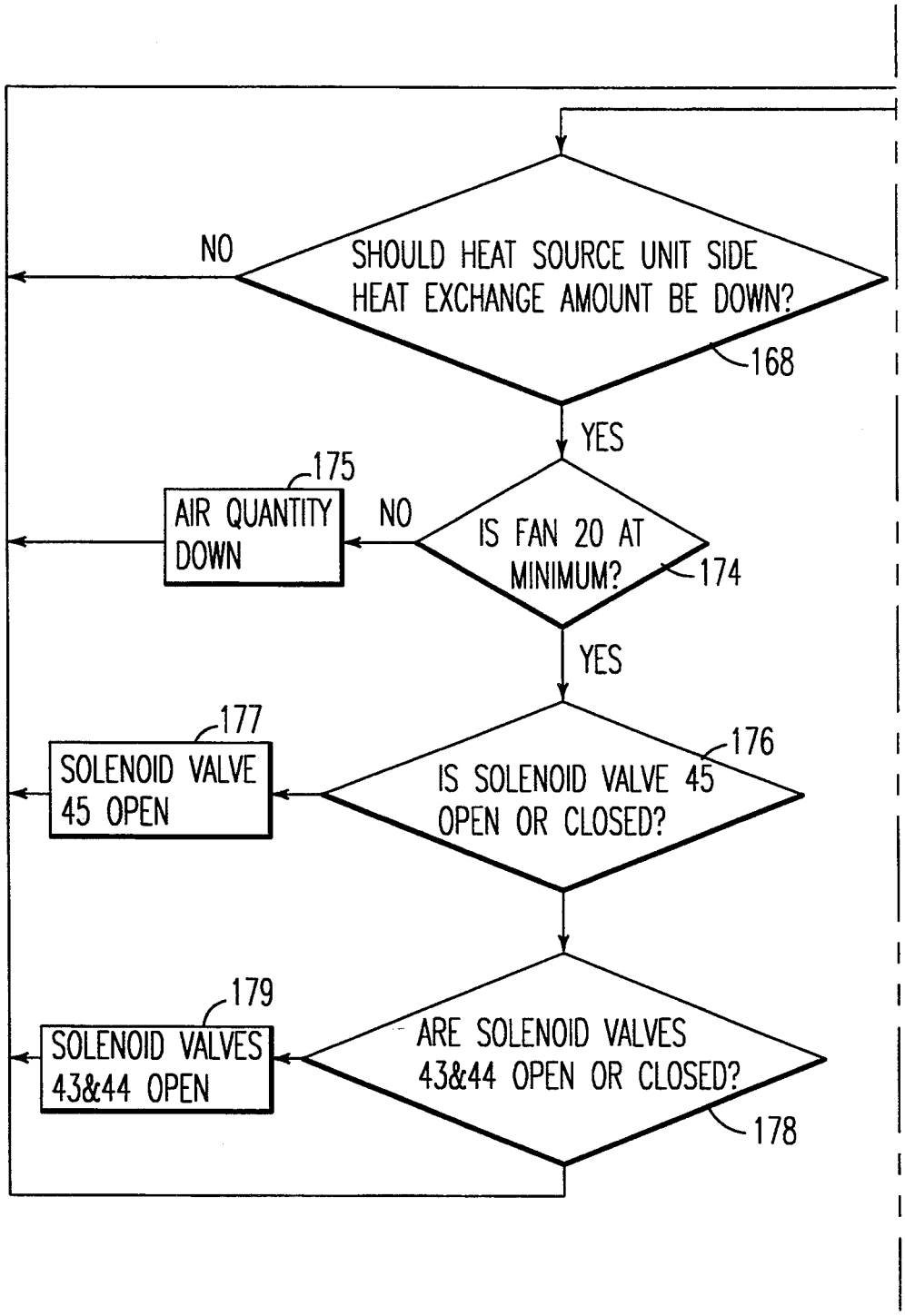
FIG. 29 is a flow chart illustrating the control of the first to third solenoid valves in the cooling-dominant operation in the air-conditioning system of the thirteenth embodiment of the present invention.
Figure 29B:
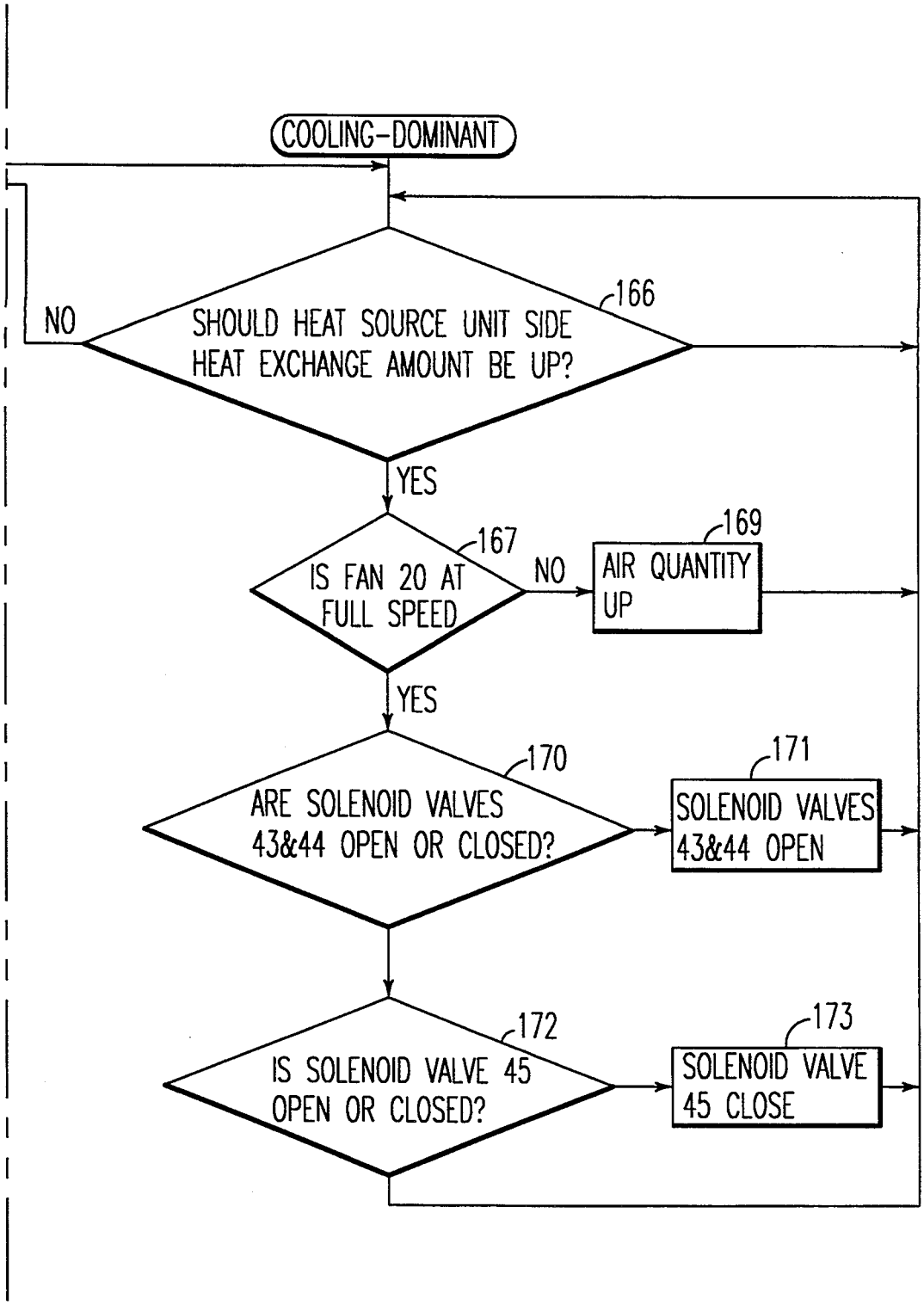

FIG. 29 is a flow chart illustrating the control of the heat source unit side fan 20, the first, the second and the third solenoid valves 43, 44 and 45 in the cooling-dominant operation. In step 166, whether or not the heat source unit side heat changing amount should be increased (UP) is judged, and the process proceeds to step 167 if it is to be UP and the process proceeds to step 168 if it is not to be UP. In step 167, whether or not the heat source unit side fan 20 is driven at full-speed is judged and the process proceeds to step 169 when it is not at full-speed. In step 169, the air quantity is increased and the process returns to step 166. In step 170, whether or not the first and the second solenoid valves 43 and 44 are open or closed is judged, and the process proceeds to step 172 when they are open and the process proceeds to step 171 when they are closed. In step 171, the first and the second solenoid valves 43 and 44 are opened and the process returns to step 166. In step 172, whether the third solenoid valve 45 is open or closed is judged, and the process proceeds to step 173 when it is open and the process returns to step 166 when it is closed. In step 173, the third solenoid valve 45 is closed and the process returns to step 166.

On the other hand, step 168 determines whether or not the heat source unit side heat exchanging amount should be decreased (down), and the process proceeds to step 174 if it is to be decreased and the process returns to step 166 if it is not to be decreased. Step 174 determines whether or not the heat source unit side fan 20 is at the predetermined minimum air quantity, and the process proceeds to step 176 if it is at the minimum quantity and the process proceeds to step 175 if it is not. In step 175, the air quantity is deceased and the process returns to step 166. In step 176, whether the third solenoid valve 45 is opened or closed is determined and the process proceeds to step 177 if it is closed and the process proceeds to step 178 if it is opened. In step 177, the third solenoid valve 45 is opened and returns to step 166. In step 178, whether the first and the second solenoid valve 43 and 44 are opened or closed is determined and the process proceeds to step 179 when opened and the process returns to step 166 when closed.

In step 179, the first and the second solenoid valves 43 and 44 are closed and the process returns to step 166.

According to the above-described thirteenth embodiment, the heat source unit side heat exchanger 41 is provided at a refrigerant inlet and outlet portions with the first and the second valves 43 and 44, respectively, and the heat source unit side bypass pipe 42 bypassing the heat source unit side heat exchanger 41 through a third valve 45 is connected at one end thereof to a liquid outlet side pipe 21 positioned between the heat source unit side heat exchanger 41 and the takeoff pipe connection portion, whereby, even when the gas refrigerant flows into the takeoff pipe 21 when the heat source unit side bypass pipe 42 is communicating, the saturation temperature can be stably detected.

Fourteenth Embodiment

Figure 30:
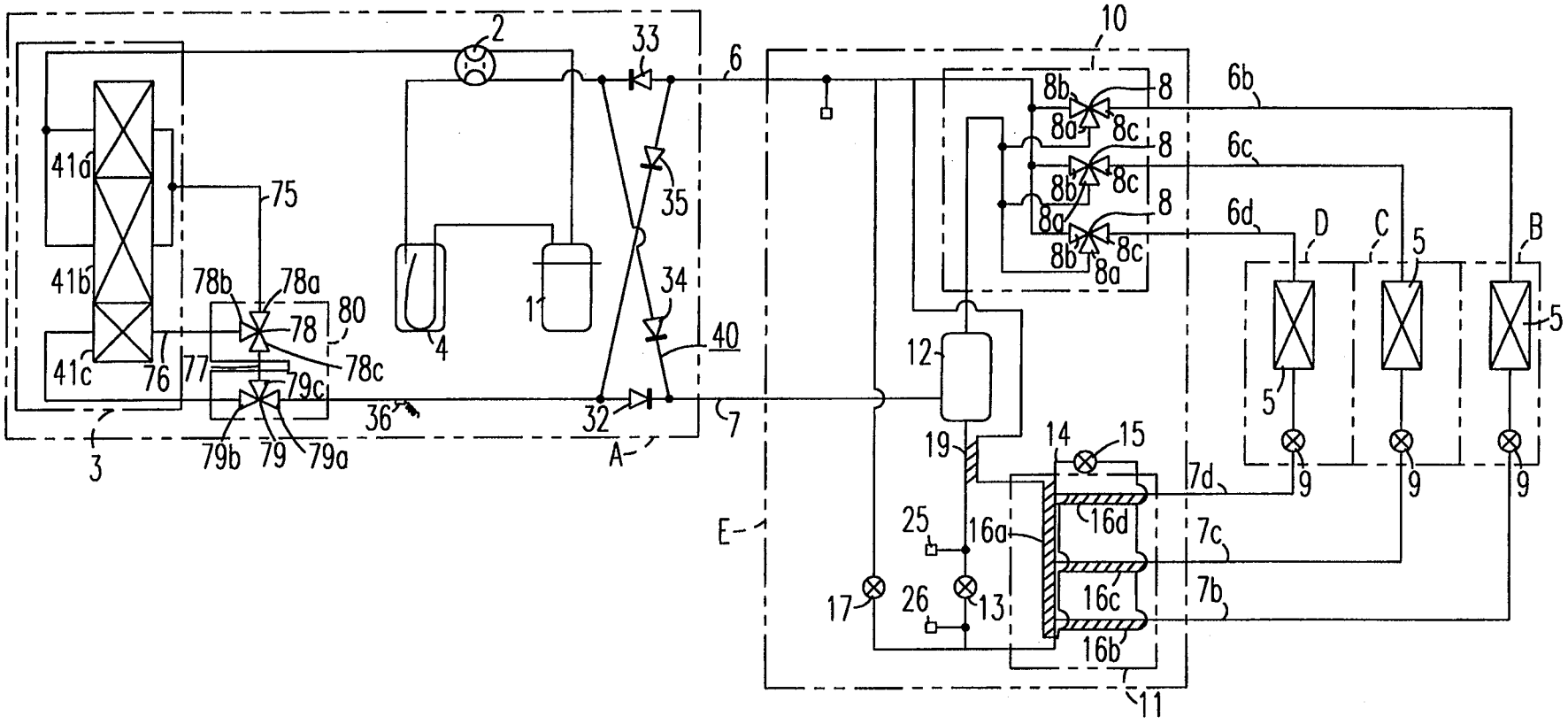
FIG. 30 is a schematic diagram generally illustrating the refrigerant lines of the air-conditioning system of the fourteenth embodiment of the present invention.

FIG. 30 is a general schematic diagram illustrating the refrigerant lines of one embodiment of the air-conditioning system of the tenth invention of the present application.

In the figure, reference numeral 36 designates a fourth temperature detectin means disposed in a pipe connected between the three-way valve 79 and the third check valve 32.

Reference numerals 41*a*, 41*b* and 41*c* are first, second and third heat exchanging elements constituting the heat source unit side heat exchanger 3.

Reference numeral 75 designates a first flow path connecting the first and the second heat exchanging elements 41*a* and 41*b* in parallel, and 76 is a second flow path which connects the third heat exchanging element 41*c* in series with the first flow path 75 so that the liquid refrigernat from the first and the second heat exchanging elements 41*a* and 41*b* is joined together by the first flow path 75, and which is in communication with the second connection pipe 7.

Reference numeral 77 designates a second heat source unit side bypass pipe connected in parallel to the second flow path 76 and have a diameter larger than the second flow path 76, this bypass pipe being connected to the second connection pipe 7 across the third heat exchanging element 41*c*.

Reference numerals 78 and 79 designate three-way valves capable of selectively switching between the second flow path 76 and the second heat source unit side bypass pipe 77, these three-way valves 78 and 79 constituting a change-over means 80.

The operation of the above-described fourteenth embodiment will now be described.

The description will first be made in terms of the cooling-only operation.

The high-temperature, high-pressure refrigerant gas supplied from the compressor 1 flows through the four-way valve 2 and is heat-exchanged and condensed in the first and the second heat exchanging elements 41*a* and 41*b* of the heat source unit side heat exchanger 3. Thereafter, the refrigerant flows into the third heat exchanging element 41*c* through the three-way change over valve 78 and flows into the three-way valve 79 after it is heat-exchanged again in case of an unbalance in heat-exchanging in the first and the second heat exchanging elements 41*a* and 41*b*. At this time, the first openings 78*a* and 79*a* as well as the second openings 78*b* and 79*b* of the three-way valves 78 and 79, respectively, are opened, and the third openings 78*c* and 79*c* are closed.

The heating-only operation will now be described.

The refrigerant which is heat exchanged in the respective indoor units B, C and D to be condensed into liquid flows through the first flow rate controller 9 and the indoor unit side second connection pipes 7*b*, 7*c* and 7*d* into the second junction portion 11 where it is joined and flows further through the fourth flow rate controller 17 where the refrigerant is pressure-decreased to the low-pressure.

Then, the pressure-reduced refrigerant flows through the first connection pipe 6, the sixth check valve 35, the three-way valve 79, the second heat source unit side bypass pipe 77 and the three-way valve 78 into the first and the second heat exchanging elements 41*a* and 41*b*, where the refrigerant is heat-exchanged into gaseous state and supplied to the compressor 1 through the four-way valve 2 and the accumulator 4.

At this time, the first openings 78*a* and 79*a* and the third openings 78*c* and 79*c* of the three-way valves 78 and 79 are opened and the second openings 78*b* and 79*b* are closed.

Other operations are similar to those of the previously described first embodiment.

Next, the heating-dominant operation in the concurrent heating and cooling operation will be described.

The description will be made as to the case where the indoor units B and C are operated for heating and the indoor unit D is operated for cooling.

The refrigerant which heated or cooled the indoor units flows through the first connection pipe 6, the sixth check valve 35, the three-way change-over valve 79, the second heat source unit side bypass pipe 77 and the three-way change-over valve 78 into the first and the second heat exchanging elements 41*a* and 41*b*.

Other operations are similar to those of the previously described first embodiment.

Further, the cooling-dominant operation in the concurrent cooling and heating operation will now be described.

The description will be made as to the case where the indoor units B and C are operated for cooling and the indoor unit D is operated for heating.

The high-temperature, high-pressure refrigerant supplied from the compressor 1 flows through the four-way valve 2 and heat-exchanged by a selected amount in the first and the second heat exchanging elements 41*a* and 41*b* of the heat source unit side heat exchanger 3 to become a 2-phase high-temperature, high-pressure gas and further flows through the second heat source unit side bypass pipe 77 t the three-way change-over valve 79 by bypassing the third heat exchanging element 41*c*. The refrigerant further flows from the three-way valve 79 to the vapor-liquid separator 12 of the junction unit E through the third check valve 32 and the second connection pipe 7.

Other operations are similar to those of the previously described first embodiment.

Figure 31:
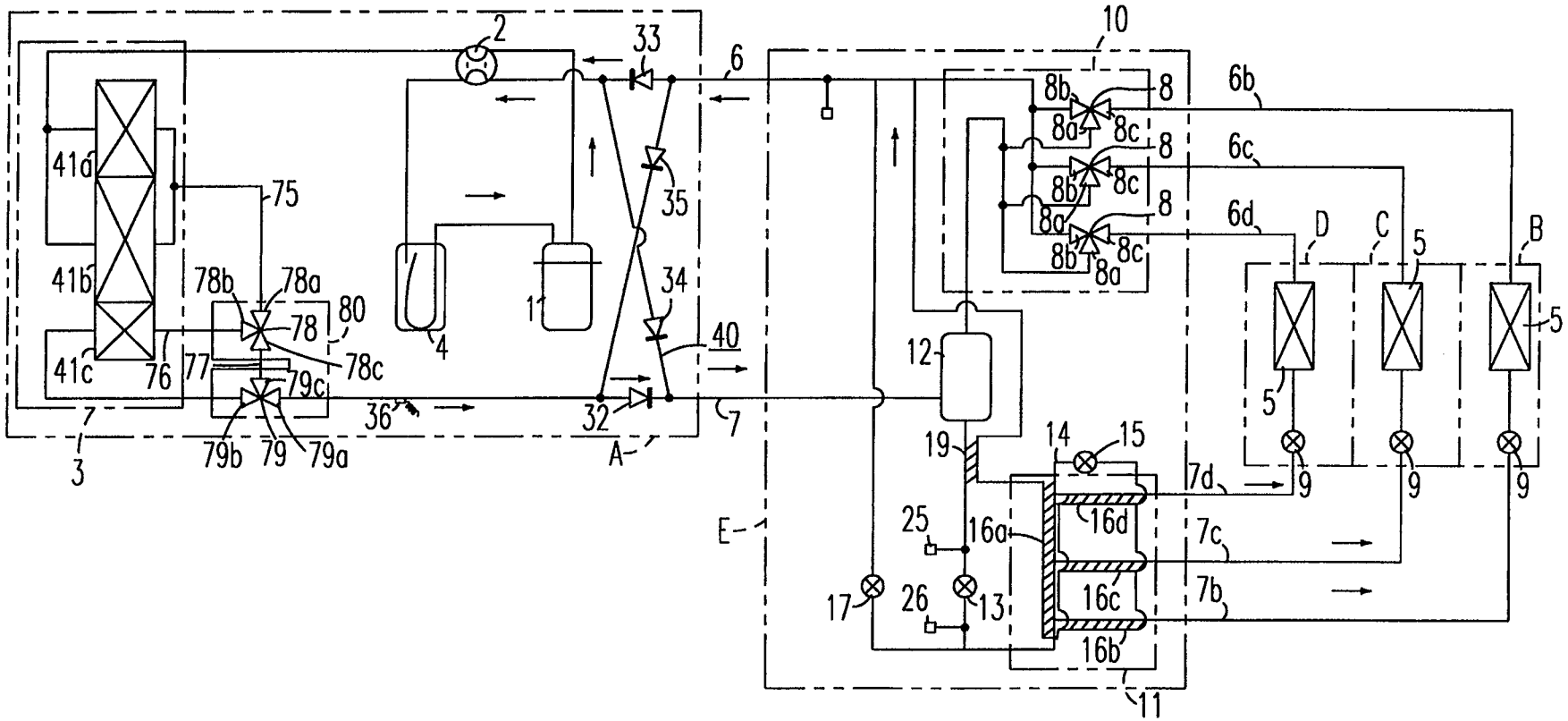
FIG. 31 is a refrigeration circuit for explaining the defrosting operational state in the air-conditioning system of the fourteenth embodiment of the present invention.

The description will now be made as to the defrosting operation in conjunction with FIG. 31. The defrosting operation is carried out with the indoor units B, C and D operated for heating. The defrosting operation is initiated when the formation of frost on the heat source unit side heat exchanger 3 is detected by the decrease of the detected temperature from the fourth temperature detector 36 during the heating-only operation or the heating-dominant operation. Thereafter, when the detected temperature from the fourth temperature detector 36 is increased, it is determined that the defrosting has been completed. That is, during the defrosting operation, as illustrated by arrows in solid lines in FIG. 31, the high-temperature, high-pressure refrigerant gas supplied from the compressor 1 flows through the four-way valve 2 to be heat-exchanged and condensed in the first and the second heat exchanging elements 41*a* and 41*b* of the heat source unit side heat exchanger 3 while melting the frost formed on the first and the second heat exchanging elements 41*a* and 41*b*. The refrigerant then flows through the first flow path 75 and through the three-way valve 78, the second flow path 76, the third heat exchanging element 41*c* and the three-way valve 79 to reach the third check valve 32. Immediately after the initiation of the defrosting operation, the third heat exchanging element 41*c* located under the first and the second heat exchanging elements 41*a* and 41*b* is cooled by the water which flows thereonto from the first and the second heat exchanging elements 41*a* and 41*b* being defrosted, so that the refrigerant which flows through the second flow path 76 is supercooled and the detected temperature from the fourth temperature detector 36 is not elevated. Even when there is an unbalanced defrosting between the first and the second heat exchanging elements 41*a* and 41*b* due to unbalanced formation of frost, the refrigerant which passed through the second flow path 76 decreases in its subcooling degree and the detection temperature at the fourth temperature detector 36 rises after all of the first, the second and the third heat exchanging elements 41*a*, 41*b* and 41*c* have been defrosted and the all the melted water has fallen to the third heat exchanging element 41*c*. At this time, the first openings 78*a* and 79*a* as well as the second openings 78*b* and 79*b* of the three-way valves 78 and 79 are opened and the third openings 78*c* and 79*c* are closed.

The refrigerant then flows from the third check valve 32, through the second connection pipe 7, the vapor-liquid separator 12, the second flow rate regulator 13 and the indoor unit side second connection pipes 7*b*, 7*c* and 7*d*, and flows into the respective indoor units B, C and D. The refrigerant is pressure-reduced to the low-pressure by the first flow rate regulator 9 and is heat-exchanged in relation to the indoor air in the indoor unit side heat exchanger 5 to be evaporated into vapor. This vaporized refrigerant flows through the indoor unit side first connection pipes 6*b*, 6*c* and 6*d*, the three-way change-over valve 8 connected to the indoor units B, C and D, the first junction portion 10, the first connection pipe 6, the fourth check valve 33, the four-way valve 2 and the accumulator 4 into the compressor 1 to define a circulation cycle to carry out the defrosting operation. At this time, the three-way valve 8 connected to the indoor units B, C and D is closed at the first opening 8*a* and opened at the second and the third openings 8*b* and 8*c*.

At this time, the refrigerant flows to the fourth check valve 33 because the first connection pipe 6 is at the low pressure and the second connection pipe 7 is at the high pressure.

While the three-way valve 8 is provided in the above fourteenth embodiment for selectively connecting the indoor unit side first connection pipes 6*b*, 6*c* and 6*d* to either the first connection pipe 6 or the second connection pipe 7, similar operation and results can be obtained by providing an open-close valve such as two solenoid valves 30 and 31.

Also, two three-way valves 78 and 79 are not always necessary, but similar operation and results can be obtained by only one of the three-way valves.

Fifteenth Embodiment

Figure 32:
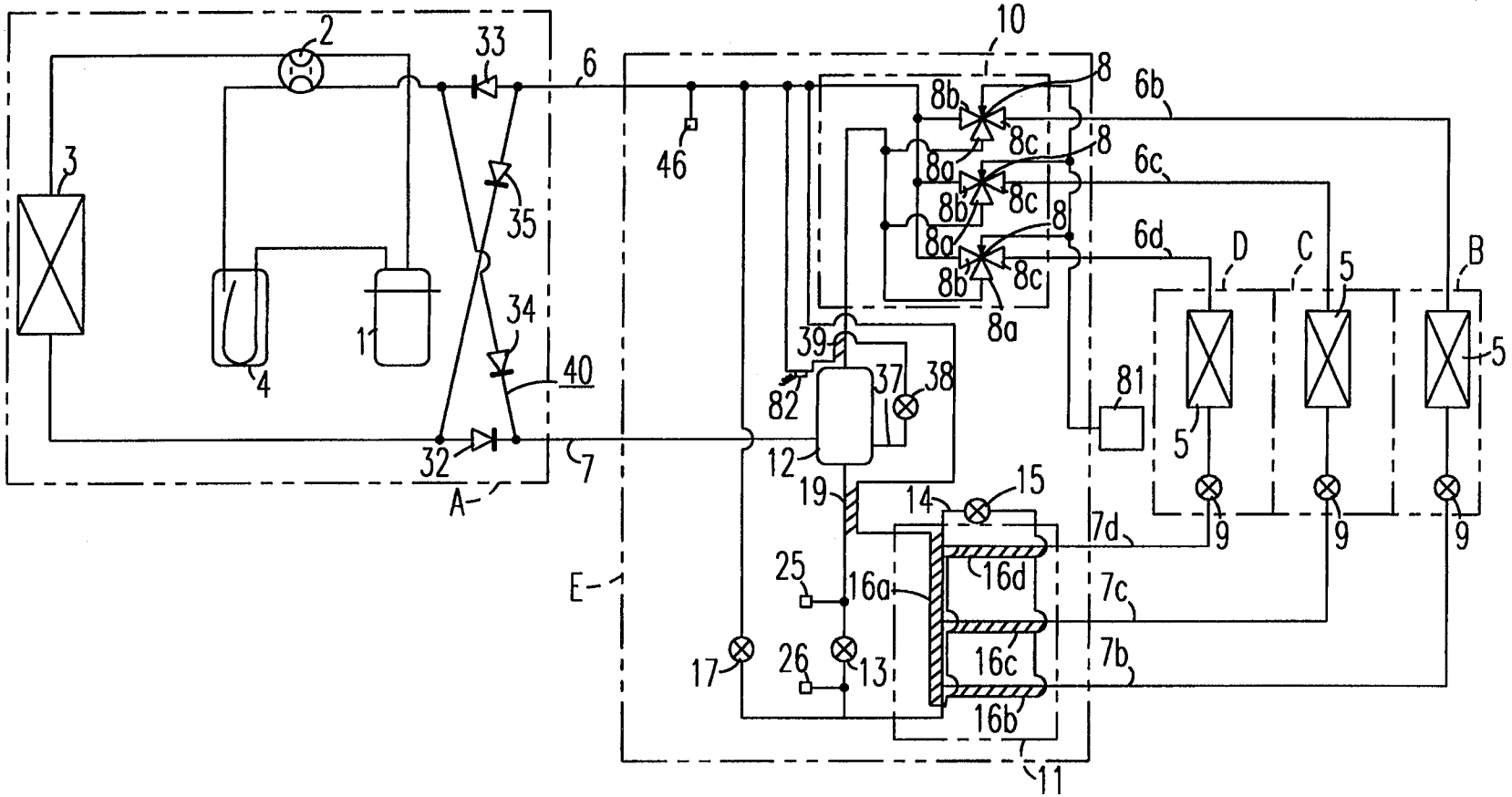
FIG. 32 is a schematic diagram generally illustrating the refrigerant lines of the air-conditioning system of the fifteenth embodiment of the present invention.

FIG. 32 is a general schematic diagram illustrating the refrigerant lines of one embodiment of the air-conditioning system of the eleventh invention of the present application.

In the figure, reference numeral 37 designates a liquid drain pipe connected at one end to the vapor-liquid separator 12 and at the other end to the first connection pipe 6, 38 is a sixth flow rate controller disposed between the vapor-liquid separator 12 of the liquid drain pipe 37 and the first connection pipe 6, 39 is a fourth heat exchanging portion disposed downstream of the sixth flow rate controller 38 of the liquid drain pipe 37 for heat-exchanging in relation to the pipe connected between the vapor-liquid separator and the first junction point 10.

Reference numeral 46 designates a third pressure detection means disposed in the pipe connected between the first connection pipe 6 and the-first junction portion 10, and 82 is a fifth temperature detection means mounted to the outlet side of the fourth heat exchanging portion 39 of the liquid drain pipe 37.

Reference numeral 81 designates a first control unit comprising a first stop time count means 84 for counting the time in which the indoor unit is in halt during the operation of the compressor 1 and a first control means 87 for determining and controlling the position of the three-way valve 8 on the basis of the stop time.

The cooling-only operation, the heating-only operation and the heating-dominant operation in the concurrent cooling and heating operation of the above fifteenth embodiment are similar to those of the first embodiment.

Next, the cooling-dominant operation in the concurrent cooling and heating operation will now be described.

When the liquid level which is a boundary between the gaseous refrigerant and the liquid refrigerant separated in the vapor-liquid separator 12 is below the liquid drain pipe 37 of the vapor-liquid separator 12, the gaseous refrigerant flows into the drain pipe 37 and is pressure-reduced to the low pressure at the six flow rate controller 38. Since the refrigerant is in the gaseous state at the inlet of the sixth flow rate controller 38, only a small amount of refrigerant flows through the sixth flow rate controller 38. Therefore, the refrigerant which flows through the liquid drain pipe 37 is heat-exchanged in the fourth heat exchanging portion 39 in relation to the high-pressure gaseous refrigerant which flows from the vapor-liquid separator 12 into the first junction portion 10 to become a low-pressure superheated gas and flows into the first connection pipe 6.

On the other hand, when the liquid level which is a boundary between the gaseous refrigerant and the liquid refrigerant separated in the vapor-liquid separator 12 is above the liquid drain pipe 37 of the vapor-liquid separator 12, the liquid refrigerant flows into the drain pipe 37 and is pressure-reduced to the low pressure at the six flow rate controller 38. Since the refrigerant is in the liquid state at the inlet of the sixth flow rate controller 38, the amount of the refrigerant which flows through the sixth flow rate controller 38 is larger as compared to that of the above-described gaseous state. Therefore, even when the refrigerant which flows through the liquid drain pipe 37 is heat-exchanged in the fourth heat exchanging portion 39 in relation to the high-pressure gaseous refrigerant which flows from the vapor-liquid separator 12 into the first junction portion 10, the refrigerant does not become a low-pressure superheated gas and flows into the first connection pipe 6 in the 2-phase state. The superheated state of the low-pressure refrigerant heat-exchanged in the fourth heat exchanging portion 39 is determined on the basis of the pressure detected by the third pressure detecting means 46 and the temperature detected by the fifth temperature detecting means 82.

Other operations are similar to those of the previously-described first embodiment.

While the three-way valve 8 is provided in the above fifteenth embodiment for selectively connecting the indoor unit side first connection pipes **6*b*, 6*c* and 6*d* to either the first connection pipe 6 or the second connection pipe 7, similar operation and results can be obtained by providing an open-close valve such as two solenoid valves 30 and 31**.

Further, the description will be made as to the control of the first flow rate controller 9 connected to the indoor unit D and the three-way change-over valve 8 when the indoor units B and C are in the cooling operation and the indoor unit D is in the stoppage during the cooling operation in the fifteenth embodiment.

When the indoor unit D is standing, the first flow rate controller 9 connected to this indoor unit D is closed and the first opening **8*a*, the second opening 8*b* and the third opening 8*c* of the three-way valve 8 are all closed. However, because of refrigerant leaks in the first flow rate controller 9 and the three-way valve 8, the refrigerant flows into the indoor unit side first connection pipe 6*d* and the indoor unit side heat exchanger 5 where it is condensed and accumulated as liquid refrigerant. If the accumulated refrigerant is left as it is, the shortage of the refrigerant occurs in the refrigeration cycle, so that the arrangement is such that, when the indoor unit D is in the stoppage for a period of time longer than a predetermined first set time during the operation of the compressor 1 in the cooling operation, the second opening 8*b* and the third opening 8*c* of the three-way valve 8 of the indoor unit D are opened and the first opening 8*a* is closed for a predetermined second set time. Then, by communicating the indoor unit side heat exchanger 5 and the indoor unit side first connection pipe 6*d* to the first connection pipe 6 through the first junction portion 10 to cause the indoor unit side heat exchanger 5 and the indoor unit side first connection pipe 6*d* to be at the low-pressure, the liquid refrigerant staying in the indoor unit side heat exchanger 5 and the indoor unit side first connection pipe 6*d* can be pumped down to the first junction portion 10 and the first connection pipe 6**, thereby recovering the accumulated liquid refrigerant.

The description will now be made in conjunction with FIGS. 33, 34 and 35.

Figure 33:
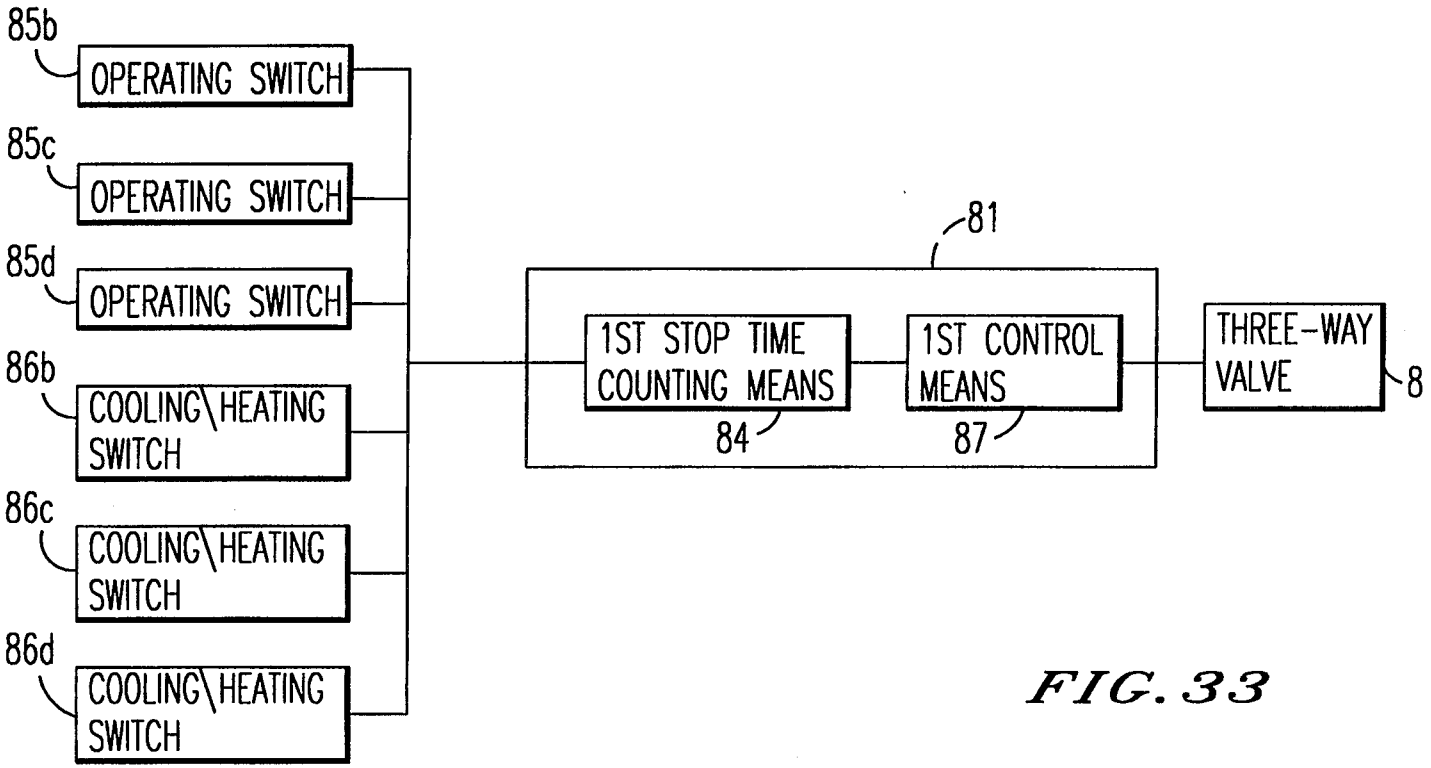
FIG. 33 is a block diagram illustrating the control of the three-way change-over valve in the air-conditioning system of the fifteenth embodiment of the present invention.

FIG. 33 is a diagram illustrating the control of the three-way valve 8 of the above fifteenth embodiment. From operating switches **85*b*, 85*c* and 85*d* of the indoor units B, C and D as well as cooling/heating change-over switches 86*b*, 86*c* and 86*d* of the indoor units B, C and D, the period of time in which the indoor units B, C and D are standing during the cooling operation of the compressor is counted by a first time counting means 84 to determine and control the opening and closing of the three-way valve-8 by a first control means 87** in accordance with the standing time.

Figure 34:
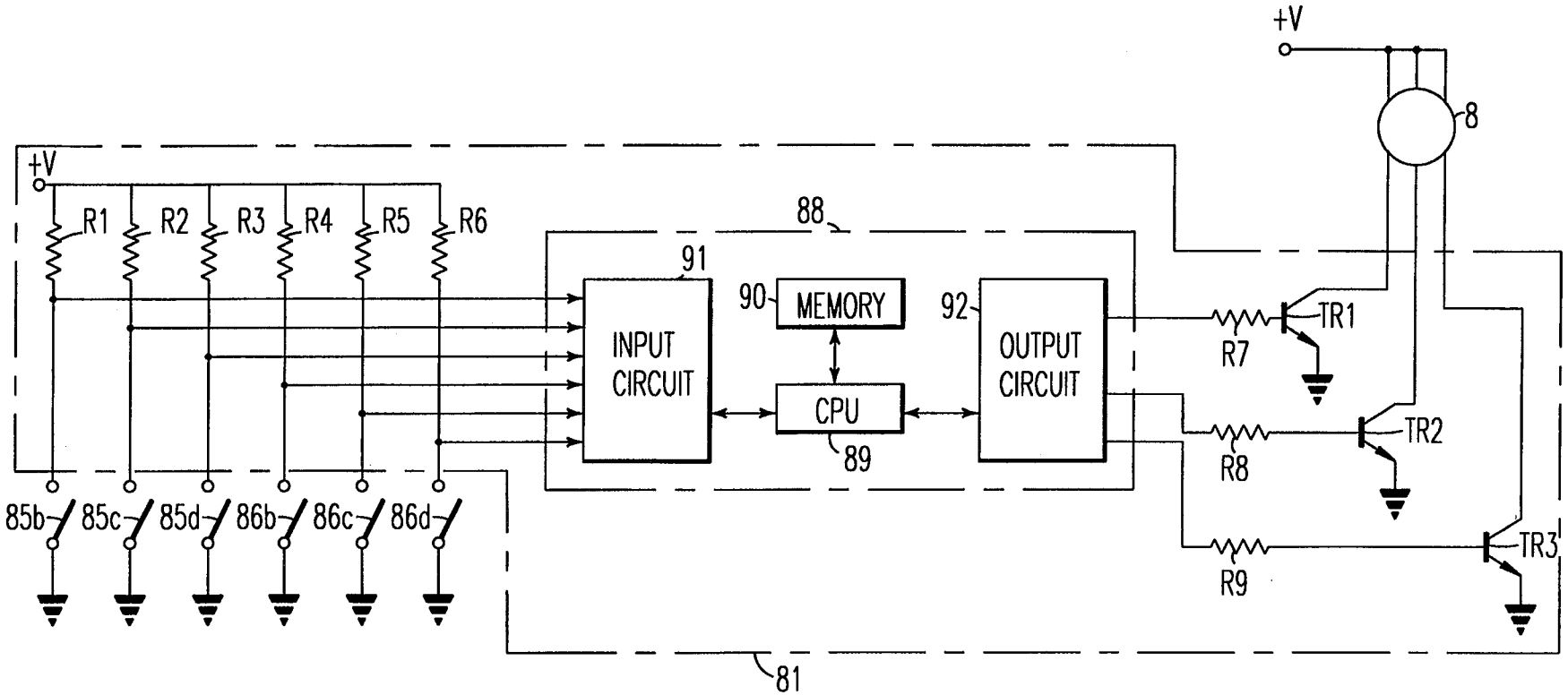
FIG. 34 is a circuit diagram illustrating one example of electrical connections in the air-conditioning system of the fifteenth embodiment of the present invention.

FIG. 34 is a circuit diagram illustrating one embodiment of an electrical connection of said embodiment 15. Reference numeral 88 designates a micro-computer in a first control device 81 and comprises a CPU 89, a memory 90, an input circuit 91 and on output circuit 92. $R_1 \sim R_6$ are resistors series-connected to the operating switch **85*b*, 85*c* and 85*d* and the cooling/heating switches 86*b*, 86*c* and 86*d*, respectively and its outputs are supplied to the input circuit 91. Control transistors $Tr_1$, $Tr_2$ and $Tr_3$ for controlling the opening and closing of the three-way valve 8 are connected to the output circuit 92** through resistors R7~R9.

Figure 35:
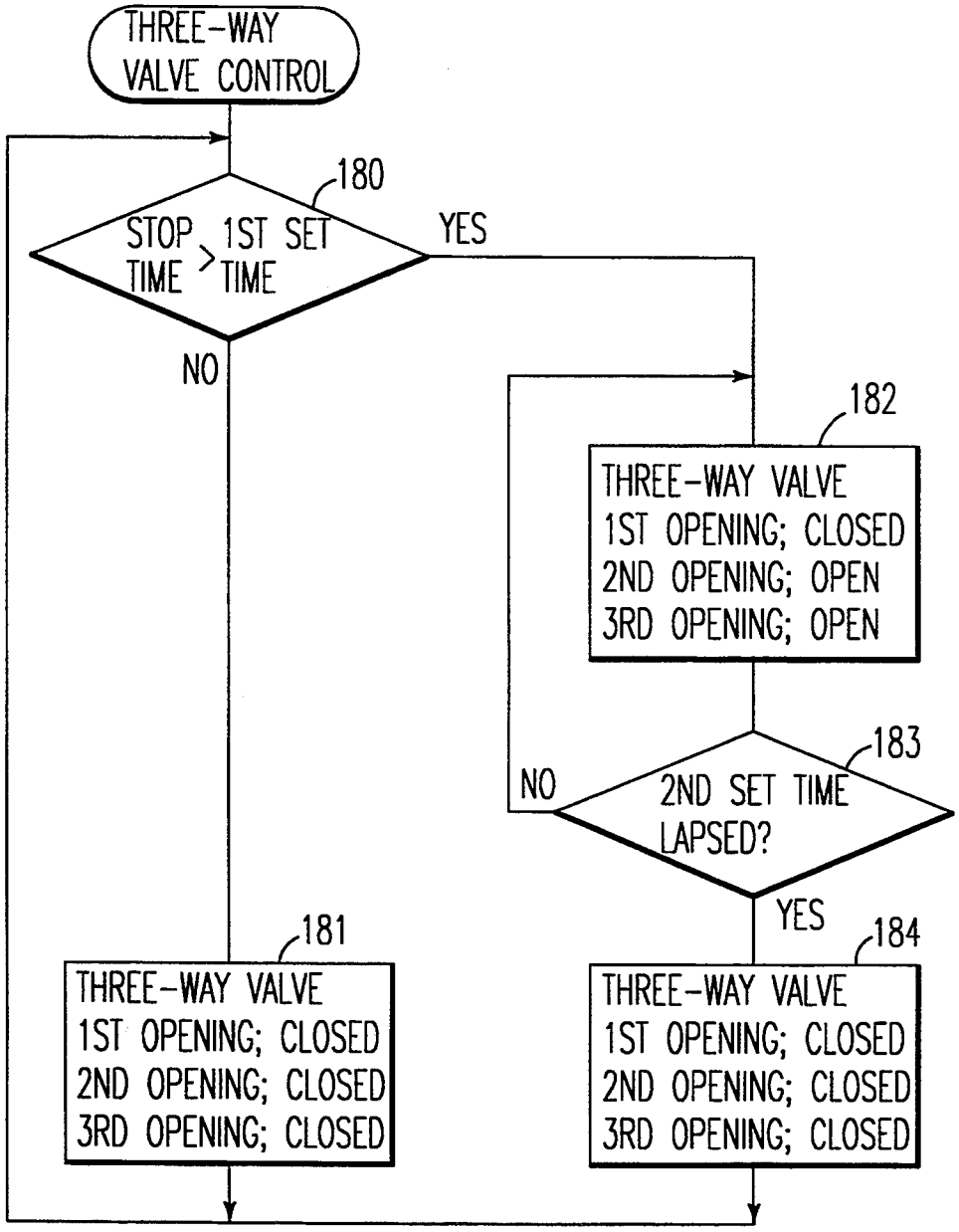
FIG. 35 is a flow chart illustrating the valve-opening degree control program for the three-way valve in the air-conditioning system of the fifteenth embodiment of the present invention.

FIG. 35 is a flow chart illustrating an opening degree control program for the three-way valve 8 stored in the memory of the micro-computer 88. Step 180 determines whether or not the sopping time is longer than the predetermined first set time and the process proceeds to the step 182 when it is longer and the process proceeds to step 181 when it is not the case. In step 181, the first opening **8*a*, the second opening 8*b* and the third opening 8*c* of the three-way valve 8 are closed. In step 182, the second opening 8*b* and the third opening 8*c* are opened but the first opening 8*a* is closed. In step 183, whether or not the period of time after the second opening 8*b* and the third opening 8*c* are opened and the first opening 8*a* is closed is equal to or longer than the predetermined second set time, and the process proceeds to step 184 when such is the case and to step 182 when such is not the case. In step 184, the first opening 8*a*, the second opening 8*b* and the third opening 8*c* of the three-way valve 8** are closed.

While the control of the three-way valve 8 has been described in terms of the cooling operation, similar operation and results can be equally obtained in the heating-only operation, the heating-dominant operation and the cooling-dominant operation.

Sixteenth Embodiment

Figure 36:
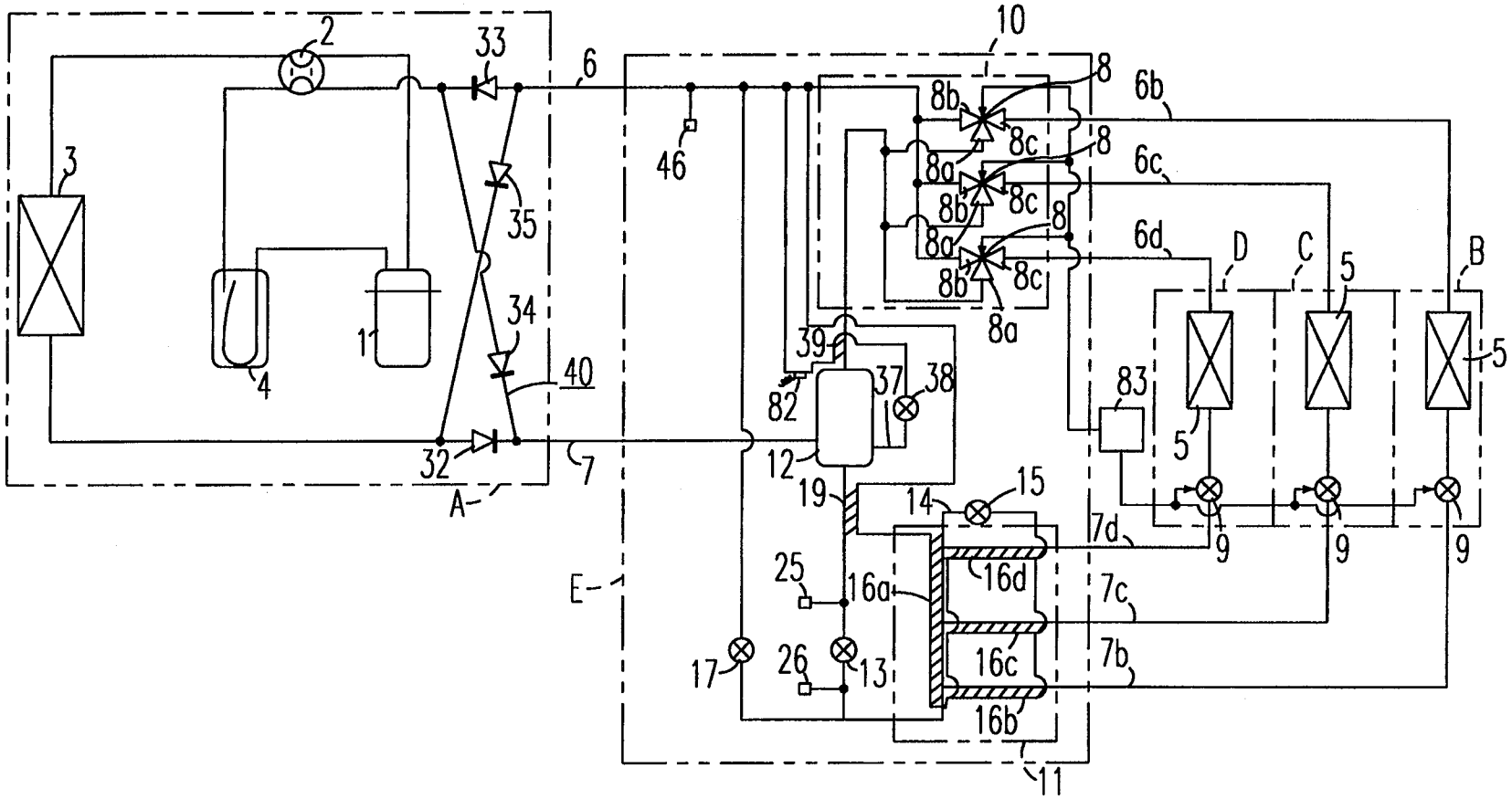
FIG. 36 is a schematic diagram generally illustrating the refrigerant lines of the air-conditioning system of the sixteenth embodiment of the present invention.

FIG. 36 is a general schematic diagram illustrating the refrigerant lines of one embodiment of the air-conditioning system of the twelfth invention of the present application.

In the figure, reference numeral 83 designates a second control unit comprising a second stop time count means 93 for counting the time in which the indoor unit is in stoppage during the operation of the compressor 1 and a second control means 94 for determining and controlling the position of the three-way valve 8 and the first flow rate controller 9 on the basis of the stop time.

The cooling-only operation, the heating-only operation and the heating-dominant and the cooling-dominant operations in the concurrent cooling and heating operation of the above sixteenth embodiment are similar to those of the fifteenth embodiment.

Next, the description will be made as to the control of the first flow rate controller 9 connected to the indoor unit D and the three-way change-over valve 8 when the indoor units B and C are in the heating operation and the indoor unit D is in the stoppage during the heating operation in the sixteenth embodiment.

When the indoor unit D is standing, the first flow rate controller 9 connected to this indoor unit D is closed and the first opening 8*a*, the second opening 8*b* and the third opening 8*c* of the three-way valve 8 are all closed. However, because of refrigerant leaks in the first flow rate controller 9 and the three-way valve 8, the refrigerant flows into the indoor unit side first connection pipe 6*d* and the indoor unit side heat exchanger 5 where it is condensed and accumulated as liquid refrigerant. If the accumulated refrigerant is left as it is, the shortage of the refrigerant occurs in the refrigeration cycle, so that the arrangement is such that, when the indoor unit D is in the stoppage for a period of time longer than a predetermined third set time during the operation of the compressor 1 in the heating operation, the first flow rate controller 9 of the indoor unit D is opened, the first opening 8*a* and the third opening 8*c* of the three-way valve 8 are opened and the second opening 8*b* is closed for a predetermined third set time. This causes the liquid refrigerant, which is formed by the high-temperature, high-pressure refrigerant flowed from the first junction portion 10 and which stays in the indoor unit side heat exchanger 5 and the indoor unit side first connection pipe 6*d*, to flow from the indoor unit side second connection pipe 7*d* to the second junction portion 11, thereby recovering the accumulated liquid refrigerant.

The description will now be made in conjunction with FIGS. 37, 38 and 39.

Figure 37:
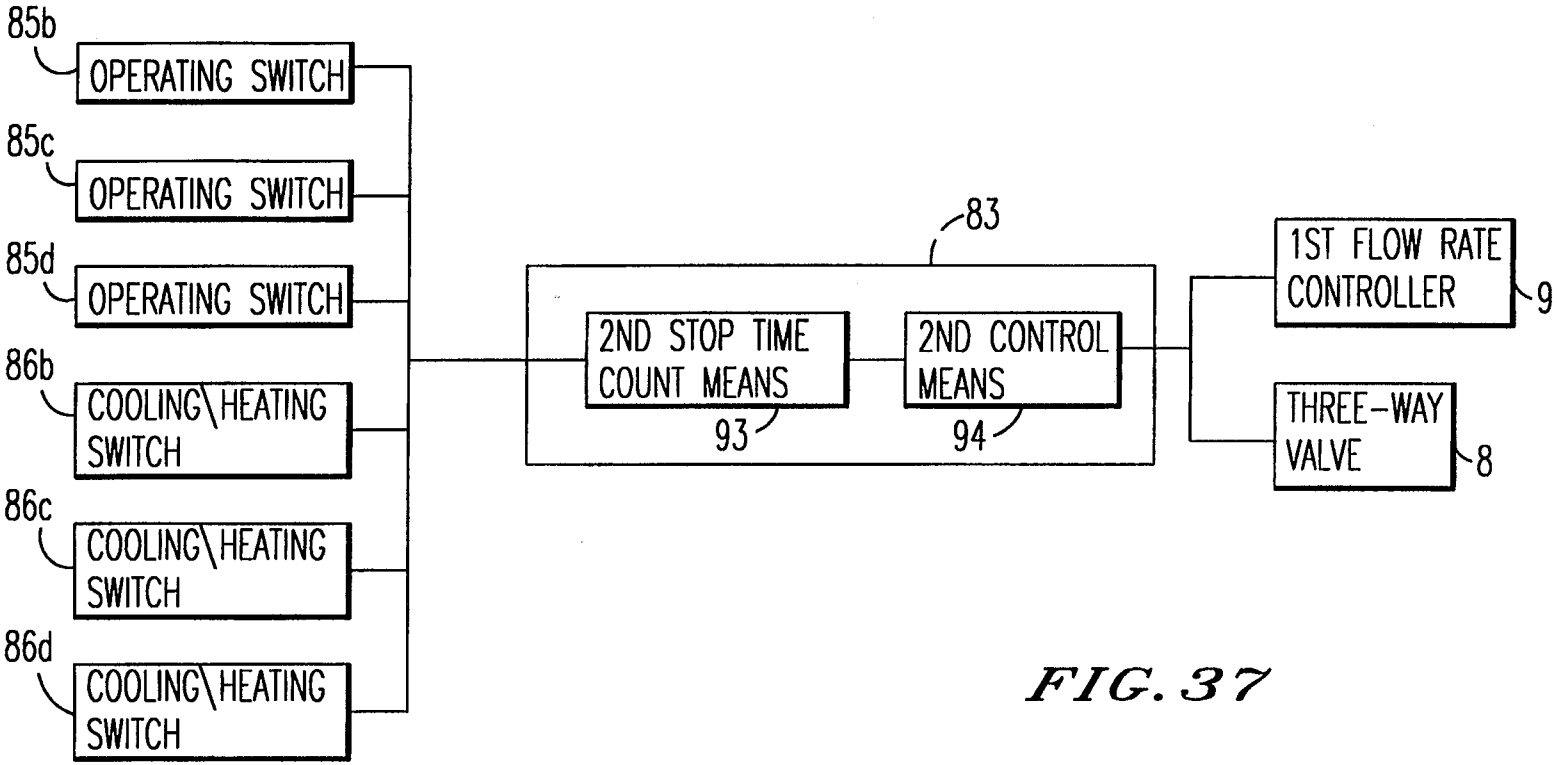
FIG. 37 is a block diagram illustrating the control of the three-way valve and the first flow rate controller of the air-conditioning system of the sixteenth embodiment of the present invention.
Figure 38:
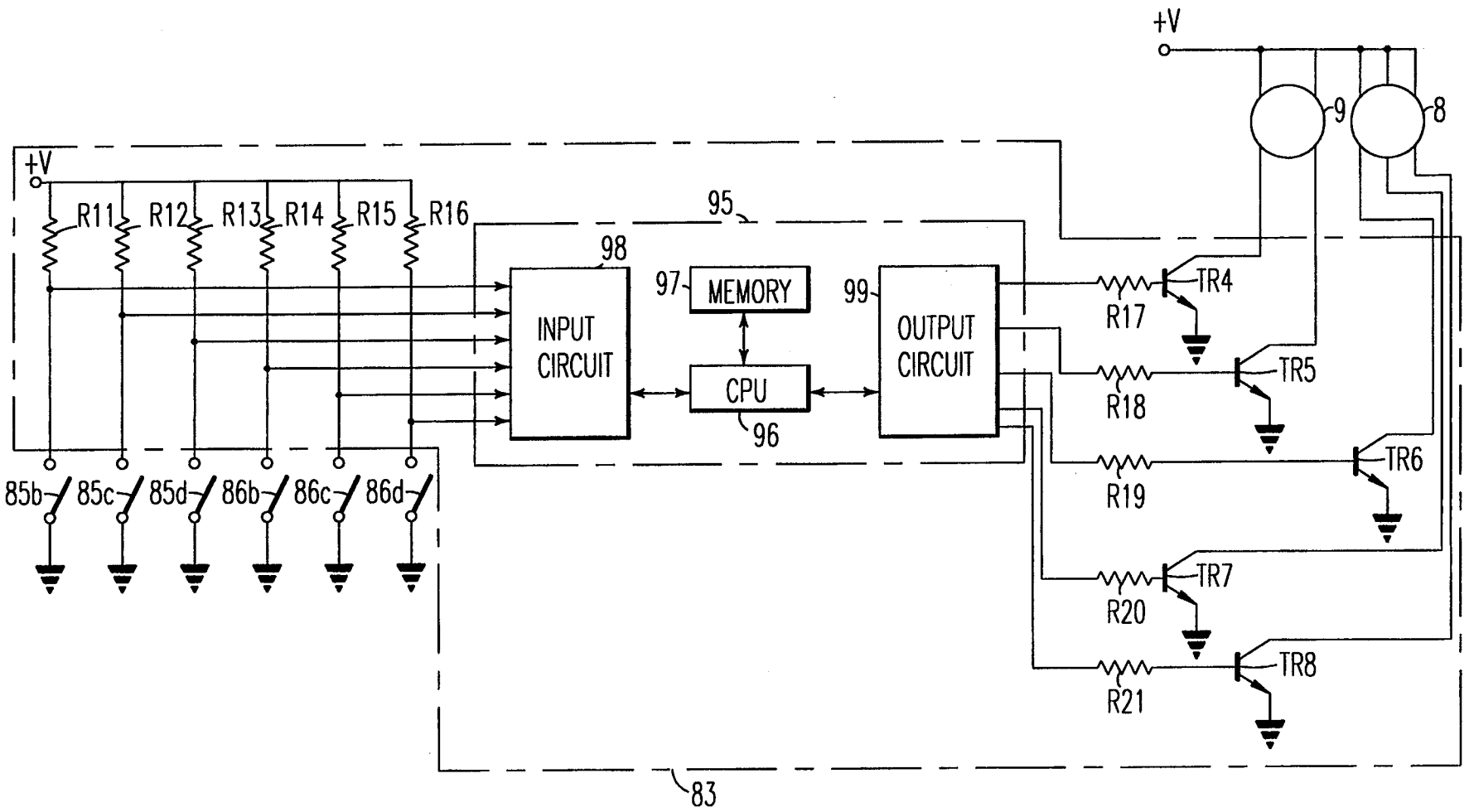
FIG. 38 is a circuit diagram illustrating one example of electrical connections in the air-conditioning system of the sixteenth embodiment of the present invention.

FIG. 37 is a diagram illustrating the control of the first flow rate controller 9 and the three-way valve 8 of the above sixteenth embodiment. From operating switches 85*b*, 85*c* and 85*d* of the indoor units B, C and D as well as cooling/heating change-over switches 86*b*, 86*c* and 86*d* of the indoor units B, C and D, the period of time in which the indoor units B, C and D are standing during the cooling operation of the compressor is counted by the second time counting means 93 to determine and control the opening and closing of the three-way valve 8 by the second control means 94 in accordance with the standing time. FIG. 38 is a circuit diagram illustrating one example of an electrical connection of the above sixteenth embodiment. Reference numeral 95 designates a micro-computer in the first control device 83 and comprises a CPU 96, a memory 97, an input circuit 98 and an output circuit 99. $R_{11} \sim R_{16}$ are resistors series-connected to the operating switch 85*b*, 85*c* and 85*d* and the cooling/heating switches 86*b*, 86*c* and 86*d*, respectively, and its outputs are supplied to the input circuit 98. Control transistors $Tr_4$ and $Tr_5$ for controlling the opening degree of the first flow rate controller 9 are connected to the output circuit 99 through the resistors $R_{17}$ and $R_{18}$, and control transistors $Tr_6$, $Tr_7$ and $Tr_8$ for controlling the opening and closing of the three-way valve 8 are connected to the output circuit 99 through resistors $R_{19}$, $R_{20}$ and $R_{21}$.

Figure 39:
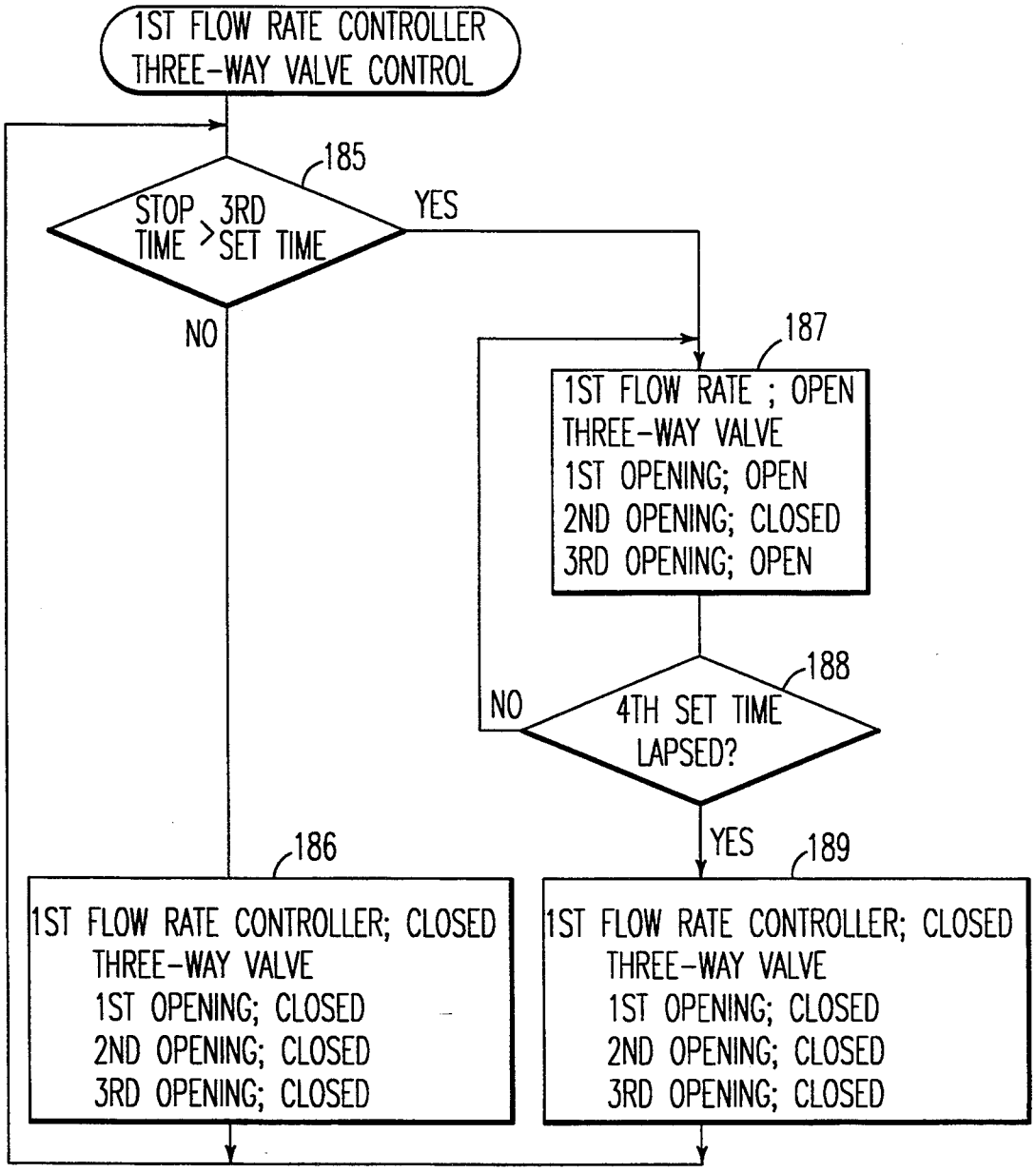
FIG. 39 is a flow chart illustrating the valve-opening degree control program for the three-way valve and the first flow rate controller in the air-conditioning system of the sixteenth embodiment of the present invention.
Figure 41:
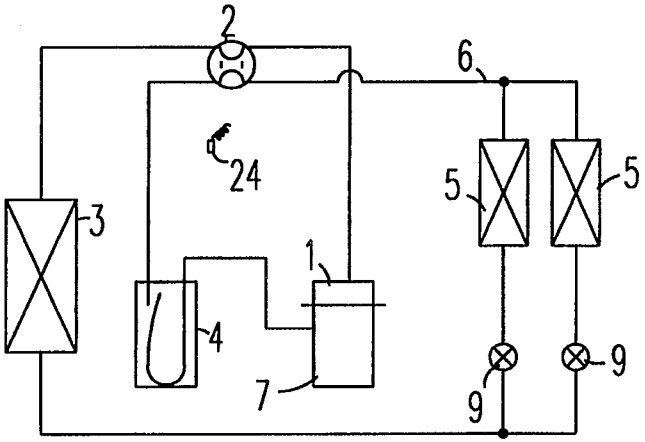
FIG. 41 PRIOR ART
FIG. 41 is a schematic diagram illustrating another example of a conventional air-conditioning system.
Figure 40:
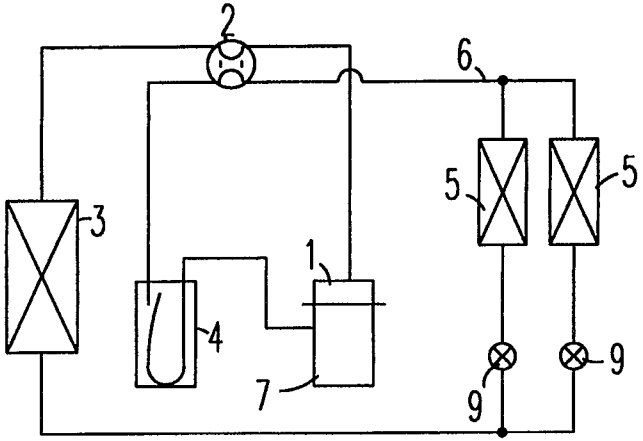
FIG. 40 PRIOR ART
FIG. 40 is a schematic diagram illustrating one example of a conventional air-conditioning system.
Figure 42:
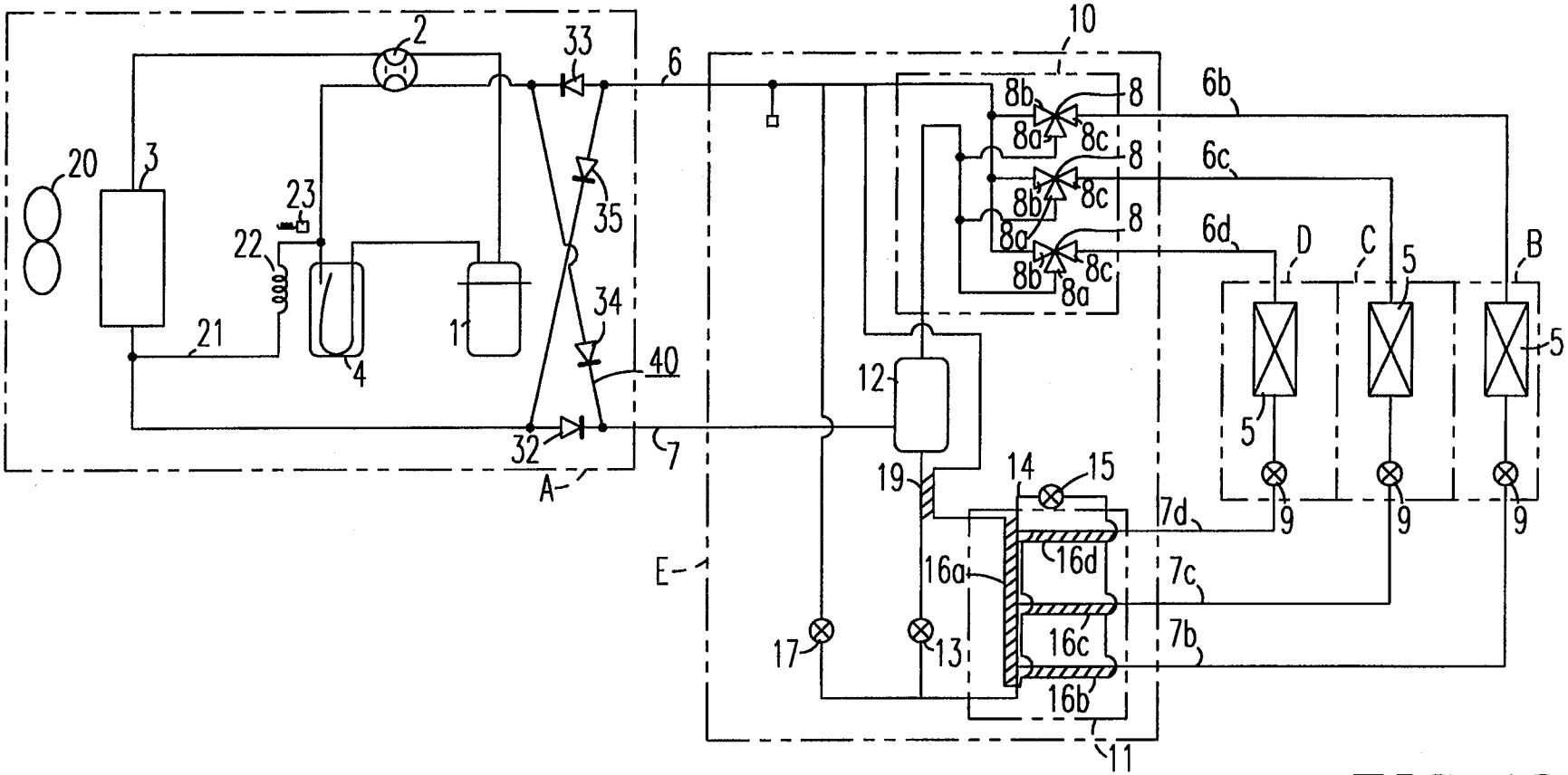
FIG. 42 PRIOR ART
FIG. 42 is a schematic diagram illustrating a further example of a conventional air-conditioning system.

FIG. 39 is a flow chart illustrating an opening degree control program for the three-way valve 8 and the first flow rate controller 9 stored in the memory 97 of the microcomputer 95. Step 185 determines whether or not the stopping time is longer than the predetermined third set time, and the process proceeds to step 187 when it is longer and the process proceeds to step 186 when it is not. In step 187, the first flow rate controller 9 is opened, the first opening 8*a* and the third opening 8*c* of the three-way valve 8 are opened and the second opening 8*b* of the three-way valve 8 is closed. In step 188, whether or not the period of time after the first flow rate controller 9 is opened, the first opening 8*a* and the third opening 8*c* are opened and the second opening 8*b* is closed is equal to or longer than the predetermined fourth set time, and the process proceeds to step 189 when such is the case and to step 187 when such is not the case. In step 189, the first flow rate controller 9 is closed, the first opening 8*a*, the second opening 8*b* and the third opening 8*c* of the three-way valve 8 are closed.

While the control of the first flow rate controller 9 and the three-way valve 8 has been described in terms of the heating operation, similar operation and results can be equally obtained in the heating-dominant operation and the cooling-dominant operation. Also, similar results can be equally obtained when the solenoid valves 30 and 31 are employed instead of the three-way change-over valve 8.

The present invention is constructed as above described, so that the following advantageous results can be obtained.

According to the first invention of the present application, the minimum valve opening degree of the first flow rate controller of the indoor unit is set and controlled in accordance with the difference between the detected temperature of the suction air and the predetermined target temperature previously set in the indoor unit in the cooling operation, so that the amount of the refrigerant supplied to the indoor unit side heat exchanger can be suitably regulated and a continuous stable operation of the indoor unit can be carried out. Also, since the influences to other indoor units, the junction unit and the heat source unit can be suppressed, cooling and heating can be selectively carried out by a plurality of indoor units or cooling by some of the indoor units and heating by the other indoor units can concurrently and stably be carried out.

According to the second invention of this application, the provision is made of the second valve opening degree controlling means which decreases, when heating operation load on the indoor unit is increased, the valve opening degree of the second flow rate controller by a predetermined amount corresponding to an amount of increase of the heating operation load, and which increases, when heating operation load on the indoor unit is decreased, the valve opening degree of the second flow rate controller by a predetermined amount corresponding to an amount of decrease of the heating operation load, so that, even when the heating load is increased or decreased, an abrupt pressure change of the refrigerant can be suppressed and the disturbance of the refrigerant cycle can be reduced, enabling a continuous stable operation. Also, the fear of damages of the compressor because of the pressure increase upon the decrease of the heating operation load on the indoor unit.

According to the third invention of the present application, the provision is made of the third valve opening degree controlling means which decreases, when cooling operation load on the indoor-unit is increased, the valve opening degree of the third flow rate controller by a predetermined amount corresponding to an amount of increase of the cooling operation load, and which increases, when cooling operation load on the indoor unit is decreased, the valve opening degree of the third flow rate controller by a predetermined amount corresponding to an amount of decrease the cooling operation load, so that, even when the cooling load is increased or decreased, an abrupt pressure change of the refrigerant can be suppressed and the disturbance of the refrigerant cycle can be reduced, enabling a continuous stable operation. Also, the fear of damages of the compressor 1 because of the exhaust temperature rise due to the pressure decease upon the decrease of the cooling operation load on the indoor unit.

According to the fourth invention of this application, the first flow rate controller is arranged to be kept, when an indoor unit of the plurality of indoor units which had been operated is stopped, at a valve opening degree which is a predetermined percentage of the valve opening degree immediately before the stopping of the indoor unit for a predetermined time period and is closed, so that an excessive increase of the high pressure (an excessive decrease of the low pressure in the cooling operation) due to an excessive reduction of the condensing capacity (the evaporating capacity in the cooling operation) when the indoor unit in the heating operation comes to a halt can be prevented, whereby the influences on other indoor units, the junction unit and the heat source unit can be suppressed, and the air-conditioning system, in which a plurality of indoor units carry out the selective cooling and heating operations and, alternatively, the concurrent cooling and heating operation is carried out with groups of the indoor units, can operate stably and continuously.

According to the fifth invention of the present application, the provision is made of the first bypass circuit which is connected between the first connection pipe and the second connection pipe and which opens when during the defrosting operation, so that the heat of the refrigerant filled in the second connection pipe immediately before the defrosting operation and the heat of the second connection pipe itself can be recovered, thereby to quickly and reliably melt the frost formed on the heat source unit side heat exchanger. Also, immediately after the initiation of the defrosting operation, the high-temperature and high-pressure vapor refrigerant filled in the second connection pipe flows through the first bypass circuit to the low-pressure side, so that there is no noise generated by the high-temperature and high-pressure vapor refrigerant in the junction unit. Also, since the refrigerant condensed and liquidified by the heat-exchange in relation to the frost in the heat source unit side heat exchanger is pressure-reduced to the low pressure through the first bypass circuit, no noise of the refrigerant is generated in the junction unit, realizing the reduction of noise of the junction unit during the defrosting operation.

According to the sixth invention of the present application, the provision is made of the subcool amount detecting means for detecting the indoor unit inlet subcool amount in the cooling operation and of the compressor capacity control means for changing the capacity control target value in accordance with the detected subcool amount from the subcool amount detecting means and for controlling the capacity of the compressor on the basis of the capacity control target value, so that, upon the switching from the heating operation to the cooling operation and upon the increase of the number of the indoor units in operation after a long period of stoppage, the compressor capacity is controlled to increase rather than to decrease to ensure a sufficient amount of refrigeration circulation to improve the refrigerant shortage in the circuit and the increase speed of the cooling capacity even when the refrigerant distribution amount shortage due to the accumulation of a large amount of liquid refrigerant in the accumulator or the like.

According to the seventh invention of the present application, the provision is made of the subcool amount detecting means for detecting the indoor unit inlet subcool amount during the cooling operation, the fifth flow rate controller disposed in the pipe connected between the lower portion of the accumulator and the accumulator outlet side pipe, and a fifth valve opening degree control means for controlling valve opening degree of the fifth flow rate controller in accordance with the subcool amount, so that, upon the initiation of cooling operation after a long period of stoppage, upon the switching from the heating operation to the cooling operation and upon the increase of the number of the indoor units in operation, the liquid refrigerant staying in the accumulator can be supplied to the compressor by increasing the opening degree of the fifth flow rate controller to increase the refrigerant circulation to improve the refrigerant shortage in the refrigerant circuit and rising speed of the cooling capacity even when the refrigerant distribution amount is in shortage at the inlets of the cooling indoor unit due to the accumulation of the large amount of the liquid refrigerant in the accumulator or the like.

According to the eighth invention of the present application, the provision is made of the subcool amount detecting means for detecting the indoor unit inlet subcool amount during the cooling operation, the second bypass circuit connected between the high-pressure gas pipe at the compressor outlet side and the accumulator outlet side pipe, and a sixth valve opening degree control means for controlling valve opening degree of the second bypass pipe in accordance with the subcool amount, so that, upon the initiation of cooling operation after a long period of stoppage, upon the switching from the heating operation to the cooling operation and upon the increase of the number of the indoor units in operation, the liquid refrigerant staying in the accumulator can be supplied to the compressor by opening the second bypass circuit to increase the low-pressure and to evaporate the liquid refrigerant stayed in the accumulator by the high-temperature gas to increase the refrigerant circulation and improve the refrigerant shortage in the refrigerant circuit and rising speed of the cooling capacity even when the refrigerant distribution amount is in shortage at the inlets of the cooling indoor unit due to the accumulation of the large amount of the liquid refrigerant in the accumulator or the like.

According to the ninth invention of the present application, the provision is made of a takeoff pipe connected at one end thereof to a liquid outlet side pipe of the heat source unit side heat exchanger and at the other end thereof to an inlet pipe of said accumulator through a throttle device, the takeoff pipe extending through cooling fins of the heat source unit side heat exchanger, and a second temperature detector means disposed in the takeoff pipe between the throttle device and the inlet pipe of the accumulator, so that even when the refrigerant is evaporated by the temperature about the heat source unit or the refrigerant is supplied from the heat source side heat exchanger in the vapor-liquid phase due to the control conditions of the fan, the refrigerant can be condensed into liquid in the takeoff pipe portion which intersects with the fin portion, whereby the second temperature detection means is assured to always stably detect the low-pressure side saturation refrigeration temperature.

According to the tenth invention of the present application, the heat source unit side heat exchanger is composed of at least first, second and third heat exchanging elements, a first flow path connecting the first and the second heat exchanging elements in parallel to each other and a second flow path connecting the third heat exchanging element in series being connected to the second connection pipe, and the provision is being made of the heat source unit side bypass pipe connecting the first flow path to the second connection pipe with the third heat exchanging element bypassed and of the change-over means for selectively changing over the first flow path to the third heat exchanging element side pipe or to the heat source unit side bypass pipe.

Therefore, the selective cooling and the heating as well as the concurrent cooling in some of the indoor units and the heating in other of the indoor units can be carried out.

Also, during the cooling operation, the refrigerant can be sufficiently condensed even when there is a heat-exchanging unbalance between the first and the second heat exchanging elements by heat-exchanging again in the third heat exchanging element through the change-over means after the refrigerant is heat-exchanged and condensed by the first and the second heat exchanging elements of the heat source unit side heat exchanger, so that the refrigerant can be sufficiently subcooled before it is distributed to the indoor units, improving the distribution of the liquid refrigerant.

Also, in the defrosting operation, by heat-exchanging the refrigerant again by the third heat exchanging element through the change-over means after it is heat-exchanged and condensed for the defrosting operation by the first and the second heat exchanging elements of the heat source unit side heat exchanger, the refrigerant temperature at the outlet of the heat source unit side heat exchanger is not raised until all of the first to the third heat exchanging elements have been sufficiently defrosted even when the defrosting of the first and the second heat exchanging element is unbalanced due to the unbalanced formation of frost, the defrosting operation can be completed with the frost stayed thereon, whereby the heating capacity shortage due to the heating operation being carried out while the frost is staying can be prevented.

During the heating-dominant operation, the change-over means causes the refrigerant to flow through the heat source unit side bypass pipe, with the third heat exchanging element of the heat source unit side heat exchanger bypassed, and to evaporate in the first and the second heat exchanging elements, whereby the pressure loss generated upon the passage of the low-pressure 2-phase refrigerant through the heat source unit side heat exchanger can be made low, the evaporation temperature increase in the indoor unit for the cooling operation can be suppressed, so that the cooling capacity can be improved.

Also, during the cooling-dominant operation, the change-over means causes the refrigerant, which is heat-exchanged to become a high-pressure 2-phase refrigerant at the first and the second heat exchanging elements, to flow through the second heat source unit side bypass pipe, with the third heat exchanging element bypassed, and to evaporate in the first and the second heat exchanging elements, whereby the pressure loss generated upon the passage of the refrigerant through the heat source unit side heat exchanger can be made low, the condensation temperature decrease in the indoor unit for the heating operation can be suppressed, so that the cooling capacity can be improved.

According to the eleventh invention of the present application, the provision is made of the first stop time counting means for counting the stop time of the indoor unit while the compressor is in operation and the first control means for changing over the connection of the indoor unit, which is in stoppage for a time period exceeding the predetermined first set time, to the first connection pipe for the predetermined second set time, so that the refrigeration cycle is not in the refrigerant shortage even when the liquid refrigerant accumulated in the indoor unit side heat exchanger of the standing indoor unit is recovered and the number of the running indoor units is changed, whereby the increase of the compressor outlet temperature due to the refrigerant shortage operation can be prevented and the decrease of the reliability of the compressor due to the compressor outlet temperature rise can be prevented.

According to the twelfth invention of the present application, the provision is made of the second stop time counting means for counting the stop time of the indoor unit while the compressor is in operation, and the second control means for changing over the connection of the indoor unit, which is in stoppage for a time period exceeding the predetermined third set time, to the second connection pipe for the predetermined fourth set time and for opening the first flow rate controller for the standing indoor unit, so that the liquid refrigerant staying in the indoor unit side het exchanger of the standing indoor unit can be quickly purged by the pressure difference between the high-pressure side and the low-pressure side which are communicated to each other, and the refrigeration cycle is not in the refrigerant shortage even when the number of the running indoor units is changed, whereby the increase of the compressor outlet temperature due to the refrigerant shortage operation can be prevented and the decrease of the reliability of the compressor due to the compressor outlet temperature rise can be prevented.

What is claimed is:

1. An air-conditioning system wherein a single heat source unit having a compressor, a four-way valve, a heat source unit side heat exchanger and an accumulator is connected to a plurality of indoor units having an indoor side heat exchanger and a first flow rate controller through first and second connection pipes;

a first branch joint including a valve device for selectively connecting one of said plurality of indoor units to said first connection pipe or said second connection pipe and a second branch joint connected to another of said indoor side heat exchangers of said plurality of indoor units through said first flow rate controller and connected to said second connection pipe through said second flow rate controller are connected to each other through a second flow rate controller and a gas-liquid separating unit;

said second branch joint and said first connection pipe are connected through a fourth flow rate controller;

said second branch joint and said first connection pipe are connected through a bypass pipe having a third flow rate controller therein; and said air conditioning system comprises;

a first heat exchanger portion for carrying out a heat-exchange between said bypass pipe between said third flow rate controller and said first connection pipe and pipings connecting said second connection pipe and said second flow rate controller;

a flow path change over unit for allowing, when said heat source unit side heat exchanger is operated as a condenser, a flow of a refrigerant from a refrigerant outlet side of said condenser only to said second connection pipe and a flow of the refrigerant from said first connection pipe only to said four-way valve side, and allowing, when said heat source unit side heat exchanger is operated as an evaporator, a flow of the refrigerant from said first connection pipe only to a refrigerant inlet side of said evaporator and a flow of the refrigerant from said four-way valve only to said second connection pipe; and a junction unit disposed between said plurality of heat source units, said junction unit comprising said first branch joint, said second branch joint, a gas-liquid separator, said second flow rate controller, said third flow rate controller, said fourth flow rate controller, said first heat exchanger portion and said bypass pipes;

characterized by the provision of:

suction air temperature detecting means for detecting a suction air temperature of said plurality of indoor units;

opening degree setting means for setting a minimum valve opening degree of said first flow rate controller in response to a difference between a detected temperature of said suction air temperature detection means and a predetermined target temperature; and first valve opening degree controlling means for controlling the valve opening degree of said first flow rate controller at a predetermined rate determined by said first valve opening degree controlling means such that said first flow rate controller is moved to said minimum valve opening degree set by said opening degree setting means at said predetermined rate.

2. The air conditioning system of claim 1, further including means for controlling movement of the first flow rate controller in response to a difference between an outlet superheat value and a target superheat value where the difference between a detected temperature and the predetermined target temperature exceed a predetermined value.

* * * * *